US006107016A

United States Patent [19]

Ito et al.

[11] Patent Number: 6,107,016

[45] Date of Patent: Aug. 22, 2000

[54] SILVER HALIDE COLOR PHOTOGRAPHIC LIGHTSENSITIVE MATERIAL

[75] Inventors: Takayuki Ito; Koji Takaku; Yasuhiro Shimada; Akira Ikeda; Hidetoshi Kobayashi, all of Minami-Ashigara, Japan

[73] Assignee: Fuji Photo Film Co., Ltd., Kanagawa, Japan

[21] Appl. No.: 09/293,179

[22] Filed: Apr. 16, 1999

[30] Foreign Application Priority Data

| | | | |
|---|---|---|---|
| Apr. 16, 1998 | [JP] | Japan | 10-106796 |
| Dec. 18, 1998 | [JP] | Japan | 10-375832 |
| Mar. 1, 1999 | [JP] | Japan | 11-052732 |

[51] Int. Cl.[7] ..... G03C 1/34; G03C 1/295

[52] U.S. Cl. ..... 430/544; 430/543; 430/955; 430/957; 430/958

[58] Field of Search ..... 430/544, 543, 430/955, 957, 958

[56] References Cited

U.S. PATENT DOCUMENTS

| | | | |
|---|---|---|---|
| 3,245,795 | 4/1966 | Gasper | 430/376 |
| 3,443,940 | 5/1969 | Bloom et al. | 430/223 |
| 3,751,406 | 8/1973 | Bloom | 534/650 |
| 3,958,993 | 5/1976 | Fujiwhara et al. | 430/443 |
| 4,482,629 | 11/1984 | Nakagawa et al. | 430/542 |
| 4,985,351 | 1/1991 | Matejec et al. | 430/598 |
| 5,151,343 | 9/1992 | Begley et al. | 430/382 |

*Primary Examiner*—Hoa Van Le

*Attorney, Agent, or Firm*—Birch, Stewart, Kolasch & Birch, LLP

[57] ABSTRACT

A silver halide color photographic material contains a coupler capable of releasing a photographically useful group or its precursor by a coupling reaction between the coupler and a developing agent in an oxidized form, wherein the coupler releases the photographically useful group or its precursor by an intramolecular nucleophilic substitution reaction using the nitrogen atom that directly bonds to a coupling position of a product obtained by the coupling reaction and that originates from the developing agent.

21 Claims, No Drawings

SILVER HALIDE COLOR PHOTOGRAPHIC LIGHTSENSITIVE MATERIAL

BACKGROUND OF THE INVENTION

The present invention relates to a silver halide color photographic lightsensitive material containing a coupler which releases a photographically useful group or its precursor (hereinafter may be simply referred to as "photographically useful group-releasing coupler"). More particularly, the present invention relates to a silver halide color photographic light-sensitive material containing a novel photographically useful group-releasing coupler that is capable of forming a cyclization product along with releasing a photographically useful group or its precursor by an intramolecular nucleophilic substitution reaction effected by a nitrogen atom of a coupling product that is produced by a reaction of the coupler with a developing agent in an oxidized form, the nitrogen atom originated from the developing agent and directly bonded to the coupling position of the coupler.

In the field of color photographic lightsensitive materials, it is known that the performance of photographic image is markedly enhanced by releasing a photographically useful group in a silver image-wise manner simultaneously with the formation of silver image.

For example, a DIR coupler exerts the effects, such as the enhancement of the graininess of color image, the enhancement of sharpness through edge effect and the enhancement of color reproducibility through the diffusion of inhibitor to another layer, by releasing a development inhibitor through a coupling reaction with a developing agent in an oxidized form at the time of development. These are described in detail in, for example, U.S. Pat. (hereinafter referred to as "U.S. Pat.") No. 4,248,962 and Jpn. Pat. Appln. KOKAI Publication No. (hereinafter referred to as "JP-A-") 5-313322.

Further, it is described in, for example, JP-A-57-150845 and JP-A-59-170840 that the enhancement of the graininess of color image and the increase of sensitivity are attained by the use of a coupler which releases a competing compound, a development accelerator or a fogging agent by a coupling reaction with a developing agent in an oxidized form. Still further, it is described in, for example, JP-A-62-218962 and JP-A-63-202745 that the formation of color image, the increase of the density of dye formed from the coupler and the improvement or correction of the hue of the dye or another dye can be realized by releasing a dye or a dye precursor through a coupling reaction with a developing agent in an oxidized form.

As apparent from the above, couplers which release a photographically useful group contribute to the enhancement of color image quality and the increase of sensitivity. However, the coupling reaction of these couplers with a developing agent in an oxidized form leads to not only the release of PUG but also the formation of an azomethine dye, so that it is not rare that the color reproducibility of color image is unfavorably influenced, thereby becoming a major cause of the restraints on the general applicability, use amount, molecular design, etc. of such functional couplers.

As the means for overcoming these problems, the coupler (colorless compound-forming coupler) which can release PUG substantially without the formation of a dye by coupling with a developing agent in an oxidized form is described in, for example, Jpn. Pat. Appln. KOKOKU Publication No. (hereinafter referred to as JP-B-) 52-46817 and U.S. Pat. No. 4,315,070. Further, the coupler (outflow dye-forming coupler) which forms a dye simultaneously with the release of PUG by a coupling reaction with a developing agent in an oxidized form, this dye, however, outflowing into a processing solution during the photographic processing, is described in, for example, JP-B-1-52742, JP-A-4-356042 and JP-A-8-44011. However, the former colorless compound-forming coupler has drawbacks in that the coupling activity is low and that the stability of the coupler is poor. On the other hand, the latter outflow dye-forming coupler has the problem that the outflow dye contaminates the processing solution, this being unfavorable in these days in which the reduction of replenisher is being promoted in the processing.

Moreover, the method of utilizing a redox reaction with a developing agent in an oxidized form is known as means for releasing PUG without the formation of any dye. For example, this method comprises the use of DIR-hydroquinones as described in, for example, JP-A-49-129536 and U.S. Pat. No. 4,377,643; the use of DIR-aminophenols as described in JP-A-52-57828; the use of p-nitrobenzyl derivatives as described in, for example, European Patent (hereinafter referred to as "EP") No. 45,129; and the use of hydrazine derivatives as described in, for example, JP-A-8-211542. However, these redox compounds generally have drawbacks in that the stability against time thereof in the light-sensitive material is low and the release of PUG after the redox reaction is slow, as compared with those of the above functional couplers.

On the other hand, the scheme of releasing a photographically useful group, which is a dye, from a non-coupling site through a cyclization reaction which occurs subsequent to the coupling reaction between a coupler and a developing agent in an oxidized form is described in, for example, U.S. Pat. Nos. 3,443,940 and 3,751,406. However, in this scheme, not only is the cyclization product obtained after the cyclization reaction composed of a dye without exception but also problems are encountered such that (1) the scope of selection of photographically useful group which can be released is small and (2) a sequence of reactions including coupling→cyclization reaction→release of photographically useful group are not always rapid.

BRIEF SUMMARY OF THE INVENTION

An object of the present invention is to provide a photographically useful group-releasing coupler which exhibits high coupling activity with a developing agent in an oxidized form and which, after the coupling reaction with the developing agent in an oxidized form, can rapidly release a photographically useful group or its precursor without the formation of an azomethine dye or an azo dye, the photographically useful group-releasing coupler being excellent in storage life. Another object of the present invention is to provide a silver halide color photographic lightsensitive material containing such a photographically useful group-releasing coupler.

DETAILED DESCRIPTION OF THE INVENTION

The inventors have conducted extensive and intensive studies. As a result, the above object has been attained by the following photographic materials mentioned in (1) to (20) below:

(1) A silver halide color photographic material containing a coupler capable of releasing a photo-graphically useful group or its precursor by a coupling reaction between the coupler and a developing agent in an oxidized form, wherein the coupler releases the photographically useful group or its precursor by an intramolecular nucleophilic substitution reaction using the nitrogen atom that directly bonds to a coupling position of a product obtained by the coupling reaction and that originates from the developing agent.

(2) The material according to (1), wherein the coupler is represented by formula (I):

$$\text{COUP—A—E—B} \quad \text{(I)}$$

wherein COUP represents a coupler residue capable of coupling with the developing agent in an oxidized form; E represents an electrophilic portion; A represents a single bond or a divalent linking group capable of releasing B along with forming a 4- to 8-membered ring by the intramolecular nucleophilic substitution reaction using the nitrogen atom that directly bonds to the coupling position of the product obtained by the coupling reaction and that originates from the developing agent, wherein A may bond to the coupling position of COUP or A may bond to the position other than the coupling position of COUP; and B represents the photographically useful group or its precursor.

(3) The material according to (2), wherein the divalent linking group represented by A bonds to the coupling position of COUP.

(4) The material according to (2), wherein the linking group represented by A bonds to an atom other than the coupling position of COUP.

(5) The material according to (2), wherein the linking group represented by A represents a group selected from the group consisting of:

$X—(CO)_{n1}—(Y')_{n2}—\{C(R_{41})(R_{42})\}_{n4}—XX$,
$X—(CO)_{n1}—\{N(R_{43})\}_{n3}—\{C(R_{41})(R_{42})\}_{n4}—XX$,
$X—(Y')_{n2}—(CO)_{n1}—\{C(R_{41})(R_{42})\}_{n4}—XX$,
$X—\{N(R_{43})\}_{n3}—(CO)_{n1}—\{C(R_{41})(R_{42})\}_{n4}—XX$,
$X—(CO)_{n1}—\{C(R_{41})(R_{42})\}_{n4}—(Y')_{n2}—XX$,
$X—(CO)_{n1}—\{C(R_{41})(R_{42})\}_{n4}—\{N(R_{43})\}_{n3}—XX$,
$X—(Y')_{n2}—XX$, and
$X—\{N(R_{43})\}_{n3}—XX$ wherein X represents a position that bonds to COUP; XX represents a position that bonds to E; Y' represents an oxygen atom or a sulfur atom; $R_{41}$, $R_{42}$, and $R_{43}$ each represent a hydrogen atom, an aliphatic group, an aryl group, or a heterocyclic group, wherein two of $R_{41}$, $R_{42}$, and $R_{43}$ may bond together to form a ring, or COUP and any one of $R_{41}$, $R_{42}$, and $R_{43}$ may bond together to form a ring; n1 and n3 each represent an integer from 0 to 2; n2 represents 0 or 1; n4 represents an integer from 1 to 5; provided that when each of n3 and n4 represents an integer of 2 or more, each of the groups $N(R_{43})$'s and each of the groups $C(R_{41})(R_{42})$'s may be the same or different from each other, and each of the values n1+n2+n4, n1+n3+n4, n2, and n3 is so selected that the 4- to 8-membered ring can be formed by the intramolecular nucleophilic substitution reaction of the electrophilic portion represented by E, with the nitrogen atom of the coupling product obtained by the reaction between COUP and the developing agent in an oxidized form, wherein the nitrogen atom directly bonds to the coupling position and originates from the developing agent; and provided that when $—N(R_{43})—$ directly bonds to E, $R_{43}$ is not a hydrogen atom, and when the linking group represented by A bonds to the coupling position of COUP, A does not bond to COUP directly via Y'.

(6) The material according to (2), wherein E in formula (I) represents —CO—, —CS—, —COCO—, —SO—, $—SO_2—$, $—P(=O)(R_{51})—$, $—P(=S)(R_{51})$, or $—C(R_{52})(R_{53})—$, wherein $R_{51}$ represents an aliphatic group, an aryl group, an aliphatic oxy group, an aryl oxy group, an aliphatic thio group, or an aryl thio group, and $R_{52}$ and $R_{53}$ each represent a hydrogen atom, an aliphatic group, an aryl group, or a heterocyclic group.

(7) The material according to (2), wherein B in formula (I) is represented by formula (III):

$$—(T)_k—\text{PUG} \quad \text{(III)}$$

wherein T represents a timing group capable of releasing PUG after T is released from E in formula (I); k represents an integer from 0 to 2; and PUG represents the photographically useful group.

(8) The material according to (2), wherein the linking group represented by A bonds to the coupling position of COUP in formula (I); and A represents a group selected from the group consisting of:

$X—CO—C(R_{41})(R_{42})—C(R_{41})(R_{42})—XX$,
$X—C(R_{41})(R_{42})—C(R_{41})(R_{42})—XX$,
$X—C(R_{41})(R_{42})—C(R_{41})(R_{42})—C(R_{41})(R_{42})—XX$,
$X—C(R_{41})(R_{42})—N(R_{43})—XX$
$X—C(R_{41})(R_{42})—C(R_{41})(R_{42})—O—XX$,
$X—C(R_{41})(R_{42})—C(R_{41})(R_{42})—S—XX$, and
$X—C(R_{41})(R_{42})—C(R_{41})(R_{42})—N(R_{43})—XX$ wherein X represents the position that bonds to COUP;

XX represents the position that bonds to E; $R_{41}$, $R_{42}$, and $R_{43}$ each represent a hydrogen atom, an aliphatic group, an aryl group, or a heterocyclic group, and two of $R_{41}$, $R_{42}$, and $R_{43}$ may bond together to form a ring, or COUP and any one of $R_{41}$, $R_{42}$, and $R_{43}$ may bond together to form a ring; and when the linking group represented by A has two ore more $—C(R_{41})(R_{42})—$'s, each of $R_{41}$'s and each of $R_{42}$'s may be the same or different from each other.

(9) The material according to (2), wherein the linking group represented by A bonds to the atom next to the coupling position of COUP in formula (I), and A represents a group selected from the group consisting of:

$X—C(R_{41})(R_{42})—XX$,
$X—C(R_{41})(R_{42})—C(R_{41})(R_{42})—XX$,
X—O—XX,
X—S—XX,
$X—N(R_{43})—XX$,
$X—C(R_{41})(R_{42})—O—XX$,
$X—C(R_{41})(R_{42})—S—XX$, and
$X—C(R_{41})(R_{42})—N(R_{43})—XX$ wherein X represents the position that bonds to COUP;

XX represents the position that bonds to E; $R_{41}$, $R_{42}$, and $R_{43}$ each represent a hydrogen atom, an aliphatic group, an aryl group, or a heterocyclic group; two of $R_{41}$, $R_{42}$, and $R_{43}$ may bond together to form a ring, or COUP and any one of $R_{41}$, $R_{42}$, and $R_{43}$ may bond together to form a ring; and when the linking group represented by A has two or more $—C(R_{41})(R_{42})—$'s, each of $R_{41}$'s and each of $R_{42}$'s may be the same or different from each other.

(10) The material according to (2), wherein the bonding group represented by A bonds to the atom next but one to the coupling position of COUP in formula (I), and A represents a group selected from the group consisting of:

X—C($R_{41}$)($R_{42}$)—XX,

X—O—XX,

X—S—XX, and

X—N($R_{43}$)—XX, wherein X represents the position that bonds to COUP in formula (I); XX represents the position that bonds to E in formula (I); $R_{41}$, $R_{42}$, and $R_{43}$ each represent a hydrogen atom, an aliphatic group, an aryl group, or a heterocyclic group; and two of $R_{41}$, $R_{42}$, and $R_{43}$ may bond together to form a ring, or COUP and one of $R_{41}$, $R_{42}$, and $R_{43}$ may bond together to form a ring.

(11) The material according to (1), wherein the photographically useful group is a development inhibitor.

(12) The material according to (1), wherein the photographically useful group is a bleach accelerator.

(13) The material according to (1), wherein the photographically useful group is a development accelerator.

(14) The material according to (1), wherein the photographically useful group is a dye.

(15) The material according to (1), wherein the photographically useful group is a brightening agent.

(16) The material according to (1), wherein the photographically useful group is a reducing agent.

(17) The material according to (1), wherein the photographically useful group is a coupler.

(18) The material according to (1), wherein the coupler represented by formula (I) is represented by formula (I-3a):

(I-3a)

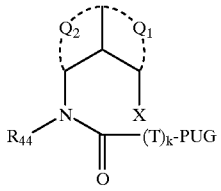

wherein $Q_1$ and $Q_2$ each represent a group of nonmetallic atoms required to form a 5-membered or 6-membered ring and to induce the coupling reaction, with a developing agent in an oxidized form, at the atom of the joint part of X; X represents a hydrogen atom, a halogen atom, $R_{31}$—, $R_{31}O$—, $R_{31}S$—, $R_{31}OCOO$—, $R_{32}COO$—, $R_{32}(R_{33})NCOO$—, or $R_{32}CON(R_{33})$—, wherein $R_{31}$ represents an aliphatic group, an aryl group or a heterocyclic group, $R_{32}$ and $R_{33}$ each represent a hydrogen atom, an aliphatic group, an aryl group, or a heterocyclic group; T represents a timing group capable of releasing PUG after T is released from —C(=O)— in formula (I-3a); k represents an integer from 0 to 2; PUG represents the photographically useful group; $R_{44}$ represents a hydrogen atom, an aliphatic group, an aryl group, or a heterocyclic group.

(19) The material according to (1), wherein the coupler represented by formula (I) is represented by formula (I-3b):

(I-3b)

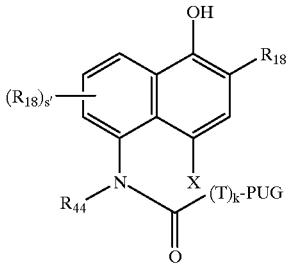

wherein $R_{18}$ represents $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$—, $R_{32}(R_{33})NCO$—, $R_{32}(R_{33})NSO_2$—, $R_{31}OCO$—, a cyano group or a halogen atom, wherein $R_{31}$ represents an aliphatic group, an aryl group or a heterocyclic group, $R_{32}$ and $R_{33}$ each represent a hydrogen atom, an aliphatic group, an aryl group or a heterocyclic group; s' represents an integer of 0 to 4; $R_{44}$ represents a hydrogen atom, an aliphatic group, an aryl group, or a heterocyclic group; X represents a hydrogen atom, a halogen atom, $R_{31}$—, $R_{31}O$—, $R_{31}S$—, $R_{31}OCOO$—, $R_{32}COO$—, $R_{32}(R_{33})NCOO$—, or $R_{32}CON(R_{33})$—, wherein $R_{31}$ represents an aliphatic group, an aryl group or a heterocyclic group, $R_{32}$ and $R_{33}$ each represent a hydrogen atom, an aliphatic group, an aryl group, or a heterocyclic group; T represents a timing group capable of releasing PUG after T is released from —C(=O)— in formula (I-3b); k represents an integer from 0 to 2; and PUG represents the photographically useful group.

(20) The material according to (1), wherein the coupler represented by formula (I) is represented by formula (I-3c):

(I-3c)

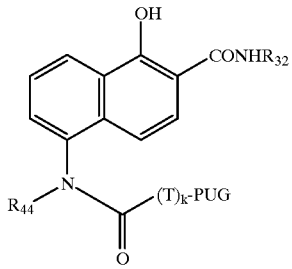

wherein $R_{32}$ represents a hydrogen atom, an aliphatic group, an aryl group or a heterocyclic group; $R_{44}$ represents a hydrogen atom, an aliphatic group, an aryl group, or a heterocyclic group; T represents a timing group capable of releasing PUG after T is released from —C(=O)— in formula (I-3c); k represents an integer from 0 to 2; and PUG represents the photographically useful group.

The photographically useful group-releasing coupler for use in the silver halide color photographic lightsensitive material of the present invention (hereinafter may be referred to as "the sensitive material of the present invention" or "the lightsensitive material of the present invention") will be described in detail below.

The photographically useful group-releasing coupler for use in the present invention is one characterized by coupling with a developing agent in an oxidized form to thereby form a coupling product and effecting not only a cyclization but also a release of a photographically useful group or its precursor through an intramolecular nucleophilic substitution reaction with a nitrogen atom of the coupling product, originated from the developing agent and directly bonded to the coupling position of the coupler. Preferably, the photographically useful group-releasing coupler is represented by the general formula (I):

COUP—A—E—B (I)

In formula (I), COUP represents a coupler residue capable of coupling with a developing agent in an oxidized form. E represents an electrophilic moiety. A represents a single bond or a divalent linking group capable of releasing B along with forming a 4- to 8-membered ring, wherein B is released through an intramolecular nucleophilic substitution reaction between the electrophilic moiety, E, and the nitrogen atom is contained in of a coupling product that is obtained by the coupling reaction between COUP and the developing agent in an oxidized form, is originated from the developing agent, and is directly bonded to the coupling position of COUP. B represents a photographically useful group or its precursor.

The developing agent usable in the present invention can be selected from among, for example, phenylenediamine and aminophenol developing agents described in, for example, U.S. Pat. Nos. 2,193,015, 2,592,364, and 5,240,821, JP-A-48-64933 and JP-A-4-121739 (page 9, right upper column, line 1 to left lower column, line 11); sulfonylhydrazine developing agents described in, for example, EP No. 545,491 A1 and EP No. 565,165 A1; and carbamoylhydrazine developing agents described in, for example, JP-A-8-286340, JP-A-9-152702 and JP-A-9-211818, the disclosures of which are herein incorporated by reference. Of these, preferred use is made of p-phenylenediamine developing agents such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 3-methyl-4-amino-N-ethyl-N-β-methoxyethylaniline.

The coupler residue represented by COUP may be any of yellow coupler residues (for example, open-chain ketomethine coupler residues such as acylacetanilide and malondianilide), magenta coupler residues (for example, 5-pyrazolone and pyrazolotriazole coupler residues) and cyan coupler residues (for example, phenol, naphthol and pyrrolotriazole coupler residues) which are generally known as photographic couplers, or may be any of yellow, magenta or cyan dye-forming coupler residues having novel skeletons described in, for example, U.S. Pat. No. 5,681,689, JP-A-7-128824, JP-A-7-128823, JP-A-6-222526, JP-A-9-258400, JP-A-9-258401, JP-A-9-269573 and JP-A-6-27612, the disclosures of which are herein incorporated by reference. Further, the coupler residue represented by COUP may be selected from among other coupler residues, for example, coupler residues capable of reacting with aromatic amine developing agent in an oxidized forms to thereby form colorless substances as described in, for example, U.S. Pat. Nos. 3,632,345 and 3,928,041 and coupler residues capable of reacting with aromatic amine developing agent in an oxidized forms to thereby form black or intermediate-color substances as described in, for example, U.S. Pat. Nos. 1,939,231 and 2,181,944, the disclosures of which are herein incorporated by reference.

The coupler residue represented by COUP may be a monomer or a part of a dimer coupler, an oligomer coupler or a polymer coupler. In the case where COUP is an oligomer coupler or a polymer coupler, two or more PUG's may be contained in the coupler.

Preferred examples of residues COUP for use in the present invention are as follows, which however do not limit those usable in the present invention:

(I-1A)

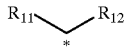

(I-2A)

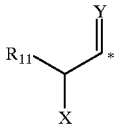

(I-1B)

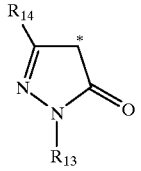

(I-2B)

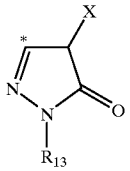

(I-1C)

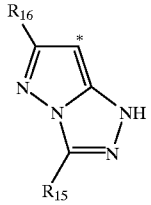

(I-2C)

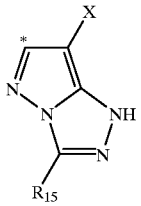

(I-1D)

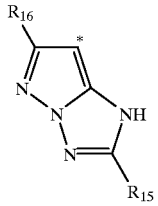

(I-2D)

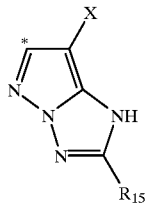

-continued (I-1E)

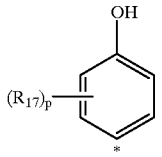

(I-2E)

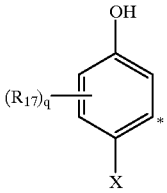

(I-1F)

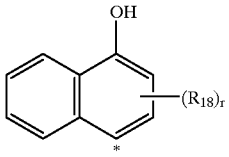

(I-2F)

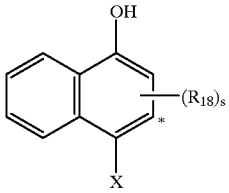

(I-3F)

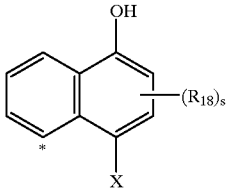

(I-1G)

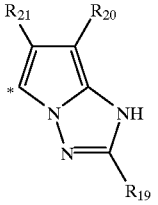

(I-2G)

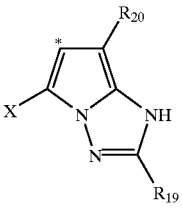

In the formulae, the mark, *, represents the bonding site with A. X represents a hydrogen atom, a halogen atom (for example, fluorine atom, chlorine atom, bromine atom or iodine atom), $R_{31}$—, $R_{31}O$—, $R_{31}S$—, $R_{31}OCOO$—, $R_{32}COO$—, $R_{32}(R_{33})NCOO$— or $R_{32}CON(R_{33})$—, and Y represents an oxygen atom, a sulfur atom, $R_{32}N$= or $R_{32}ON$=.

Herein, $R_{31}$ represents an aliphatic group, an aryl group or a heterocyclic group. The aliphatic group defines a saturated or unsaturated, chain or cyclic, linear or branched, substituted or unsubstituted aliphatic hydrocarbon group; this definition applies hereinafter.

The aliphatic group represented by $R_{31}$ is preferably an aliphatic group having 1 to 32 carbon atoms, more preferably 1 to 22 carbon atoms, which is, for example, methyl, ethyl, vinyl, ethynyl, propyl, isopropyl, 2-propenyl, 2-propynyl, butyl, isobutyl, t-butyl, t-amyl, hexyl, cyclohexyl, 2-ethylhexyl, octyl, 1,1,3,3-tetramethylbutyl, decyl, dodecyl, hexadecyl or octadecyl. The terminology "carbon atoms" used herein means the total number of carbon atoms which, when the aliphatic group is a substituted aliphatic group, includes the number of carbon atoms of the substituent. With respect to the groups other than the aliphatic group as well, the total number of carbon atoms including that of any substituent thereof is meant for the term "carbon atoms".

The aryl group represented by $R_{31}$ is preferably a substituted or unsubstituted aryl group having 6 to 32 carbon atoms, more preferably 6 to 22 carbon atoms, which is, for example, phenyl, tolyl or naphthyl.

The heterocyclic group represented by $R_{31}$ is preferably a substituted or unsubstituted heterocyclic group having 1 to 32 carbon atoms, more preferably 1 to 22 carbon atoms, which is, for example, 2-furyl, 2-pyrrolyl, 2-thienyl, 3-tetrahydrofuranyl, 4-pyridyl, 2-pyrimidinyl, 2-(1,3,4-thiadiazolyl), 2-benzothiazolyl, 2-benzoxazolyl, 2-benzimidazolyl, 2-benzoselenazolyl, 2-quinolyl, 2-oxazolyl, 2-thiazolyl, 2-selenazolyl, 5-tetrazolyl, 2-(1,3,4-oxadiazolyl) or 2-imidazolyl.

Each of $R_{32}$ and $R_{33}$ independently represents a hydrogen atom, an aliphatic group, an aryl group or a heterocyclic group. The aliphatic group, aryl group and heterocyclic group represented by $R_{32}$ and $R_{33}$ have the same meaning as that of $R_{31}$.

It is preferred that X represents a hydrogen atom, an aliphatic group, an aliphatic oxy group, an aliphatic thio group or $R_{32}CON(R_{33})$— and Y represent an oxygen atom.

The substituents suitable to the above or below mentioned groups and the below mentioned substituents include, for example, halogen atoms (for example, fluorine, chlorine, bromine and iodine atoms), a hydroxyl group, a carboxyl group, a sulfo group, a cyano group, a nitro group, alkyl groups (for example, methyl, ethyl and hexyl), fluoroalkyl groups (for example, trifluoromethyl), aryl groups (for example, phenyl, tolyl and naphthyl), heterocyclic groups (for example, heterocyclic groups mentioned with respect to $R_{31}$), alkoxy groups (for example, methoxy, ethoxy and octyloxy), aryloxy groups (for example, phenoxy and naphthyloxy), alkylthio groups (for example, methylthio and butylthio), arylthio groups (for example, phenylthio), amino groups (for example, amino, N-methylamino, N,N-dimethylamino and N-phenylamino), acyl groups (for example, acetyl, propionyl and benzoyl), alkyl- or arylsulfonyl groups (for example, methylsulfonyl and phenylsulfonyl), acylamino groups (for example, acetylamino and benzoylamino), alkyl- or arylsulfonylamino groups (for example, methanesulfonylamino and benzenesulfonylamino), carbamoyl groups (for example, carbamoyl, N-methylamincarbonyl, N,N-dimethylaminocarbonyl and N-phenylaminocarbonyl), sulfamoyl groups (for example, sulfamoyl, N-methylaminosulfonyl, N,N-dimethylaminosulfonyl and N-phenylaminosulfonyl), alkoxycarbonyl groups (for example, methoxycarbonyl, ethoxycarbonyl and octyloxycarbonyl), aryloxycarbonyl groups (for example, phenoxycarbonyl and naphthyloxycarbonyl), acyloxy groups (for example, acetyloxy and benzoyloxy), alkoxycarbonyloxy groups (for example, methoxycarbonyloxy and ethoxycarbonyloxy), aryloxycarbonyloxy groups (for example, phenoxycarbonyloxy), alkoxycarbonylamino groups (for example, methoxycarbonylamino and butoxycarbonylamino), aryloxycarbonylamino groups (for example, phenoxycarbonylamino), aminocarbonyloxy groups (for example, N-methylaminocarbonyloxy and N-phenylaminocarbonyloxy) and aminocarbonylamino groups (for example, N-methylaminocarbonylamino and N-phenylaminocarbonylamino).

Each of $R_{11}$ and $R_{12}$ independently represents $R_{32}CO$—, $R_{31}OCO$—, $R_{32}(R_{33})NCO$—, $R_{31}SO_n$—, $R_{32}(R_{33})NSO_2$— or a cyano group. These $R_{31}$, $R_{32}$ and $R_{33}$ are as defined above, and n is 1 or 2.

$R_{13}$ represents the same group as defined by the above $R_{31}$.

$R_{14}$ represents $R_{32}$—, $R_{32}CON(R_{33})$—, $R_{32}(R_{33})N$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NCO$— or a cyano group. These $R_{31}$, $R_{32}$ and $R_{33}$ are as defined above, and $R_{34}$ represents the same group as defined by the above $R_{32}$.

Each of $R_{15}$ and $R_{16}$ independently represents a substituent and preferably represents $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NCO$—, a halogen atom or a cyano group. More preferably, each of $R_{15}$ and $R_{16}$ represents the same group as represented by $R_{31}$. These $R_{31}$, $R_{32}$, $R_{33}$ and $R_{34}$ are as defined above.

$R_{17}$ represents a substituent, p is an integer of 0 to 4, and q is an integer of 0 to 3. Preferred substituents represented by $R_{17}$ include $R_{31}$—, $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$— and halogen atoms. These $R_{31}$, $R_{32}$, $R_{33}$ and $R_{34}$ are as defined above. When each of p and q is 2 or greater, the groups $R_{17}$ may be the same or different from each other. Adjacent groups $R_{17}$ may be bonded with each other to thereby form a ring. In preferred forms of the general formulae (I-1E) and (I-2E), at least one ortho position to the hydroxyl group is substituted with $R_{32}CONH$—, $R_{31}OCONH$— or $R_{32}(R_{33})NCONH$—.

$R_{18}$ represents a substituent, r is an integer of 0 to 6, and s is an integer of 0 to 5. Preferred substituents represented by $R_{18}$ include $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$—, $R_{32}(R_{33})NCO$—, $R_{32}(R_{33})NSO_2$—, $R_{31}OCO$—, a cyano group and halogen atoms. These $R_{31}$, $R_{32}$, $R_{33}$ and $R_{34}$ are as defined above. When each of r and s is 2 or greater, the groups $R_{18}$ may be the same or different from each other. Adjacent groups $R_{18}$ may be bonded with each other to thereby form a ring. In preferred forms of the general formulae (I-1F), (I-2F) and (I-3F), the ortho position to the hydroxyl group is substituted with $R_{32}CONH$—, $R_{32}HNCONH$—, $R_{32}(R_{33})NSO_2$— or $R_{32}NHCO$—.

$R_{19}$ represents a substituent and preferably represents $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NSO_2$—, $R_{32}(R_{33})NCO$—, a halogen atom or a cyano group. More preferably, $R_{19}$ represents the same group as represented by $R_{31}$. These $R_{31}$, $R_{32}$, $R_{33}$ and $R_{34}$ are as defined above.

Each of $R_{20}$ and $R_{21}$ independently represents a substituent and preferably represents $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{32}(R_{33})NCO$—, $R_{32}(R_{33})NSO_2$—, $R_{31}OCO$—, a halogen atom or a cyano group. More preferably, each of $R_{20}$ and $R_{21}$ represents $R_{32}(R_{33})NCO$—, $R_{32}(R_{33})NSO_2$—, a trifluoromethyl group, $R_{31}OCO$— or a cyano group. These $R_{31}$, $R_{32}$, $R_{33}$ and $R_{34}$ are as defined above.

E represents an electrophilic group such as —CO—, —CS—, —COCO—, —SO—, —$SO_2$—, —P(=O)($R_{51}$)—, or —P(=S)($R_{51}$)—, wherein $R_{51}$ represents an aliphatic group, an aryl group, an aliphatic oxy group, an aryl oxy group, an aliphatic thio group or an aryl thio group, or —C($R_{52}$)($R_{53}$)—, wherein each of $R_{52}$ and $R_{53}$ independently represent a hydrogen atom, an aliphatic group, an aryl group, or a heterocyclic group, wherein the aliphatic, aryl and heterocyclic groups are as defined above. E preferably represents —CO—.

A represents a single bond or a divalent linking group which is capable of forming a ring, which is preferably a 4- to 8-membered ring, more preferably, a 5- to 7-membered ring, much more preferably a 6-memebered ring, along with releasing the photographically useful group represented by B through an intramolecular nucleophilic substitution reaction between the electrophilic moiety E and the nitrogen atom of a COUP/developing agent in an oxidized form coupling product. The nitrogen atom is originated from the developing agent and directly bonded to the coupling position.

Preferred examples of the linking group represented by A are as follows:

X—$(CO)_{n1}$—$(Y')_{n2}$—$\{C(R_{41})(R_{42})\}_{n4}$—XX,
X—$(CO)_{n1}$—$\{N(R_{43})\}_{n3}$—$\{C(R_{41})(R_{42})\}_{n4}$—XX,
X—$(Y')_{n2}$—$(CO)_{n1}$—$\{C(R_{41})(R_{42})\}_{n4}$—XX,
X—$\{N(R_{43})\}_{n3}$—$(CO)_{n1}$—$\{C(R_{41})(R_{42})\}_{n4}$—XX,
X—$(CO)_{n1}$—$\{C(R_{41})(R_{42})\}_{n4}$—$(Y')_{n2}$—XX,
X—$(CO)_{n1}$—$\{C(R_{41})(R_{42})\}_{n4}$—$\{N(R_{43})\}_{n3}$—XX,
X—$(Y')_{n2}$—XX, and X—$\{N(R_{43})\}_{n3}$—XX.

In the groups mentioned above, X represents a position that bonds to COUP. XX represents a position that bonds to E. Y' represents an oxygen atom or a sulfur atom. $R_{41}$, $R_{42}$, and $R_{43}$ each represent a hydrogen atom, an aliphatic group, an aryl group, or a heterocyclic group, wherein the aliphatic group, the aryl group, and the heterocyclic group are the same as the aliphatic group, the aryl group, and the heterocyclic group defined for $R_{31}$, respectively, wherein two of $R_{41}$, $R_{42}$, and $R_{43}$ may bond together to form a ring, or COUP and any one of $R_{41}$, $R_{42}$, and $R_{43}$ may bond together to form a ring. $n_1$ and $n_3$ each represent an integer from 0 to 2. $n_2$ represents 0 or 1. $n_4$ represents an integer from 1 to 5. Provided that when each of n3 and n4 represent integers of 2 or more, each of the groups $N(R_{43})$ and $C(R_{41})(R_{42})$ may be the same or different from each other, and the values of n1+n2+n4, n1+n3+n4, n2, and n3 are so selected that the 4- to 8-membered ring can be formed by the intramolecular nucleophilic substitution reaction of the electrophilic portion represented by E with the nitrogen atom of the coupling product obtained by the reaction between COUP and the developing agent in an oxidized form, wherein the nitrogen atom directly bonds to the coupling position and originates from the developing agent; provided that when —$N(R_{43})$— directly bonds to E, $R_{43}$ is not preferably a hydrogen atom, and when the linking group represented by A bonds to the coupling position of COUP, A does not directly bond to COUP through Y'.

The position in COUP at which A bonds is not limited as long as B is released along with formation of the ring, which is preferably a 4- to 8-membered, more preferably 5- to 7-membered, and much more preferably 6-membered ring, by the intramolecular nucleophilic substitution reaction of the electrophilic moiety represented by E, with the nitrogen atom that is contained in the coupling product obtained after the reaction of the coupler and the developing agent in an oxidized form, and that is originated from the developing agent. However, it is preferable that A bonds to COUP at the coupling position or one of the near positions to the coupling position, which is the atom next to the coupling position, or the atom next but one to the coupling position.

The reactions of a primary amine development agent in an oxidized form and the couplers represented by formula (I) of the invention in the three cases of the position at which A bonds COUP, i.e., 1) A bonds to the coupling position, 2) A bonds to the atom next to the coupling position, and 3) A bonds to the atom next but one to the coupling position of the coupler residue represented by COUP may be illustrated in the formulas set forth below. In the formulas, $ArNH_2$ represents the development agent, and Ar'═NH represents the development agent in an oxidized form.

1) In the case where A binds at the coupling position of COUP.

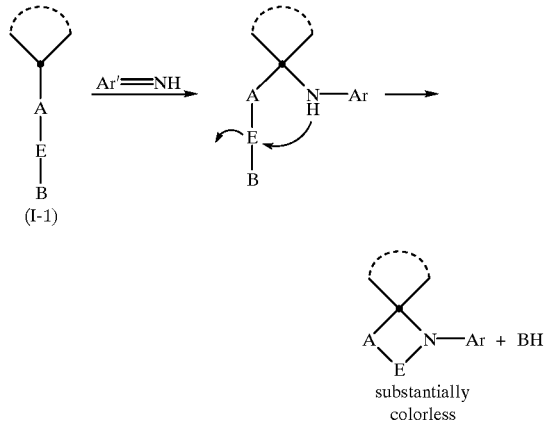

2) In the case where A bonds at the atom next to the coupling position of COUP.

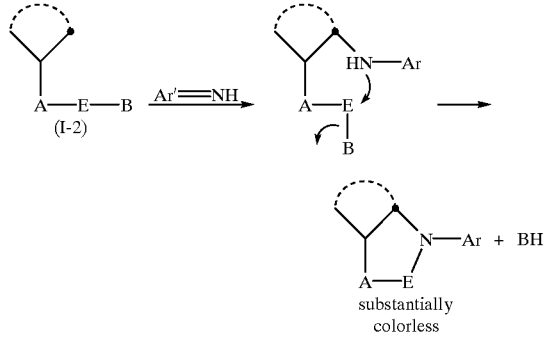

3) In the case where A binds at the atom next but one to the coupling position of COUP.

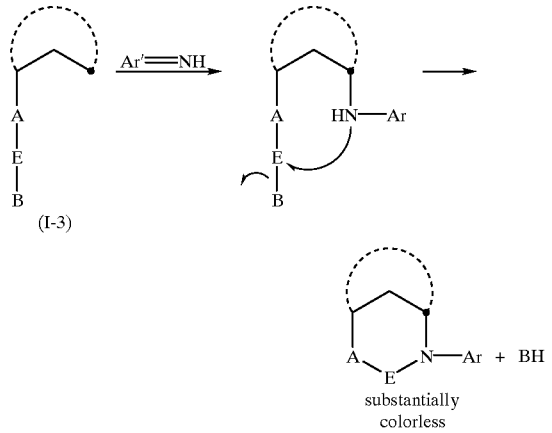

In the above formulas, each of

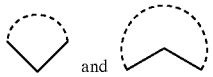

represents a coupler residue capable of coupling with a development agent in an oxidized form, which does not necessarily represent a ring structure. • (dot) represents the coupling position. —— (line) represents a linkage between nonmetal atoms.

In the case of the coupler represented by formula (I) of the invention is represented by formula (I-1), as set forth in 1) mentioned above, where A bonds to the coupling position of COUP that is preferably represented by any one of formulas (I-1A), (I-1B), (I-1C), (I-1D), (I-1E), (I-1F) and (I-1G), A in formula (I) is preferably:

X—(CO)—C($R_{41}$)($R_{42}$)—C($R_{41}$)($R_{42}$)—XX,

X—C($R_{41}$)($R_{42}$)—C($R_{41}$)($R_{42}$)—XX,

X—C($R_{41}$)($R_{42}$)—C($R_{41}$)($R_{42}$)—C($R_{41}$)($R_{42}$)—XX,

X—C($R_{41}$)($R_{42}$)—N($R_{43}$)—XX,

X—C($R_{41}$)($R_{42}$)—C($R_{41}$)($R_{42}$)—O—XX,

X—C($R_{41}$)($R_{42}$)—C($R_{41}$)($R_{42}$)—S—XX, or

X—C($R_{41}$)($R_{42}$)—C($R_{41}$)($R_{42}$)—N($R_{43}$)—XX, and more preferably:

X—C($R_{41}$)($R_{42}$)—N($R_{43}$)—XX,

X—C($R_{41}$)($R_{42}$)—C($R_{41}$)($R_{42}$)—O—XX, or

X—C($R_{41}$)($R_{42}$)—C($R_{41}$)($R_{42}$)—N($R_{43}$)—XX wherein X, XX, $R_{41}$, $R_{42}$ and $R_{43}$ are as defined above, provided that the number of the group, —C($R_{41}$)($R_{42}$)—, is two or more in the linking group, each of the $R_{41}$'s and each of the $R_{42}$'s may be the same or different from each other.

In the case of the coupler represented by formula (I) of the invention is represented by formula (I-2), as set forth in 2) mentioned above, where A bonds to the atom next to the coupling position of COUP that is preferably represented by any one of formulas (I-2A), (I-2B), (I-2C), (I-2D), (I-2E), (I-2F), and (I-2G), A in formula (I) is preferably:

X—C($R_{41}$)($R_{42}$)—XX, X—C($R_{41}$)($R_{42}$)—C($R_{41}$)($R_{42}$)—XX,

X—O—XX, X—S—XX, X—N($R_{43}$)—XX,

X—C($R_{41}$)($R_{42}$)—O—XX,

X—C($R_{41}$)($R_{42}$)—S—XX, or X—C($R_{41}$)($R_{42}$)—N($R_{43}$)—XX, and more preferably:

X—O—XX, X—N($R_{43}$)—XX, X—C($R_{41}$)($R_{42}$)—O—XX, or X—C($R_{41}$)($R_{42}$)—N($R_{43}$)—XX wherein X, XX, $R_{41}$, $R_{42}$, and $R_{43}$ are as defined above, provided that the number of the group, —C($R_{41}$)($R_{42}$)—, is two or more in the linking group, each of the $R_{41}$'s and each of the $R_{42}$'s may be the same or different from each other.

In the case of the coupler represented by formula (I) of the invention is represented by formula (I-3), as set forth in 3) mentioned above, where A bonds to the atom next but one to the coupling position of COUP that is preferably represented by formula (I-3F), A in formula (I) is preferably:

X—C($R_{41}$)($R_{42}$)—XX, X—O—XX, X—S—XX, or X—N($R_{43}$)—XX, and more preferably X—O—XX, or X—N($R_{43}$)—XX, and much more preferably X—N($R_{43}$)—XX, wherein X, XX, $R_{41}$, $R_{42}$, and $R_{43}$ are as defined above.

B represents a photographically useful group or its precursor. Preferred form of group B is represented by the following general formula (III):

#–(T)*k*–PUG (III)

In this formula (III), # represents the position that link to the electrophilic group E. T represents a timing group capable of releasing PUG after being released from the electrophilic group E. k is an integer of 0 to 2, preferably 0 or 1. PUG represents a photographically useful group.

The timing group represented by T can be selected from among, for example, groups capable of releasing PUG by a cleavage reaction of hemiacetal as described in, for example, U.S. Pat. No. 4,146,396, U.S. Pat. No. 4,652,516 and U.S. Pat. No. 4,698,297; groups capable of releasing PUG by an intramolecular cyclization reaction as described in, for example, JP-A-9-114058, U.S. Pat. No. 4,248,962, U.S. Pat. No. 5,719,017 and U.S. Pat. No. 5,709,987; groups capable of releasing PUG by an electron transfer through p electron as described in, for example, JP-B-54-39727, JP-A-57-136640, JP-A-57-154234, JP-A-4-261530, JP-A-4-211246, JP-A-6-324439, JP-A-9-114058, U.S. Pat. No. 4,409,323 and U.S. Pat. No. 4,421,845; groups capable of producing carbon dioxide to thereby release PUG as described in, for example, JP-A-57-179842, JP-A-4-261530 and JP-A-5-313322; groups capable of releasing PUG by a hydrolytic reaction of iminoketal as described in U.S. Pat. No. 4,546,073; groups capable of releasing PUG by a hydrolytic reaction of ester as described in German Offenlegungschrift (hereinafter referred to as "DOS") No. 2,626,317; and groups capable of releasing PUG by a reaction with sulfite ion as described in EP 572,084, the disclosures of which are herein incorporated by reference.

Preferred examples of timing groups represented by T in the present invention are as follows, which however do not limit those usable in the present invention:

(T1)

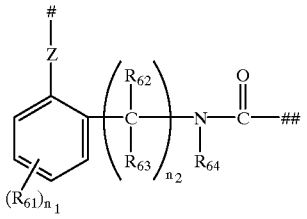

(T2)

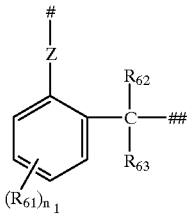

(T3)

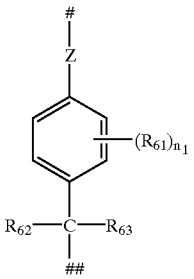

(T4)

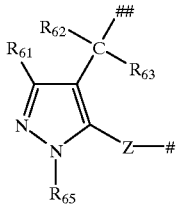

In this formula, # represents the position that bonds to the electrophilic moiety, E, or that bonds to ##, and ## represents the position that bonds to PUG or that bonds to #. Z represents an oxygen atom or a sulfur atom, preferably an oxygen atom. $R_{61}$ represents a substituent and preferably represents $R_{31}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{32}(R_{33})NCO$—, $R_{32}(R_{33})NSO_2$—, $R_{31}OCO$—, a halogen atom a nitro group or a cyano group. These $R_{31}$, $R_{32}$, $R_{33}$ and $R_{34}$ are as defined above. $R_{61}$ may be bonded with any of $R_{62}$, $R_{63}$ and $R_{64}$ to thereby form a ring. $n_1$ is an integer of 0 to 4. When $n_1$ is an integer of 2 or greater, the groups $R_{61}$ may be the same or different from each other, and adjacent groups $R_{61}$ may be bonded with each other to thereby form a ring.

Each of $R_{62}$, $R_{63}$ and $R_{64}$ represents the same group as defined by $R_{32}$. $n_2$ is 0 or 1. $R_{62}$ and $R_{63}$ may be bonded with each other to thereby form a spiro ring. Each of $R_{62}$ and $R_{63}$ preferably represents a hydrogen atom or an aliphatic group having 1 to 20 carbon atoms, preferably 1 to 10 carbon atoms, and more preferably represents a hydrogen atom. $R_{64}$ preferably represents an aliphatic group having 1 to 20 carbon atoms, more preferably 1 to 10 carbon atoms, or an aryl group having 6 to 20 carbon atoms, more preferably 6 to 10 carbon atoms. $R_{65}$ represents $R_{32}$—, $R_{32}(R_{33})NCO$—, $R_{32}(R_{33})NSO_2$—, $R_{31}OCO$— or $R_{32}CO$—. These $R_{31}$, $R_{32}$ and $R_{33}$ are as defined above. $R_{65}$ preferably represents $R_{32}$, more preferably an aryl group having 6 to 20 carbon atoms.

Examples of the timing group are set forth below, however, the present invention is not limited to these. In the examples, the mark, *, represents the position that bonds to the electrophilic moiety represented by E, and the mark, **, represents the position that bonds to PUG.

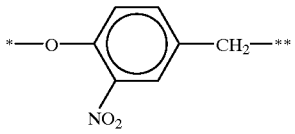

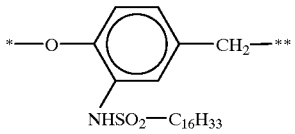

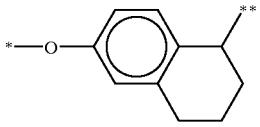

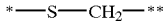

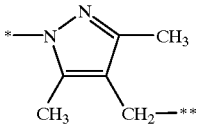

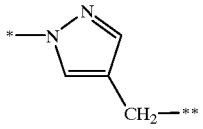

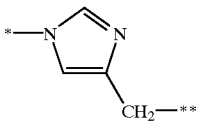

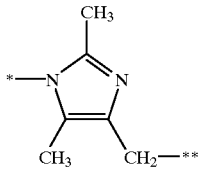

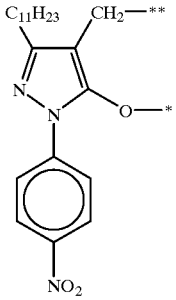

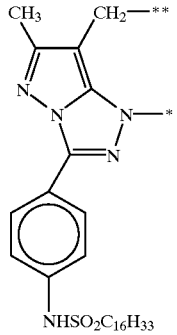

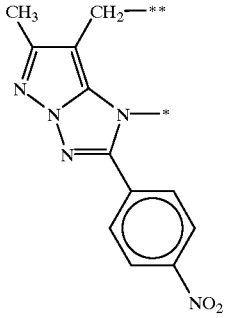

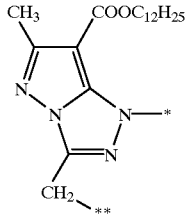

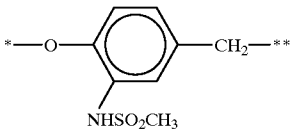

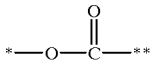

-continued

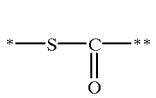

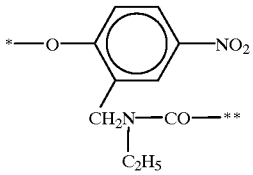

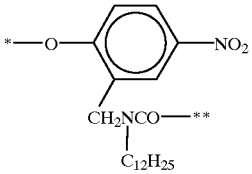

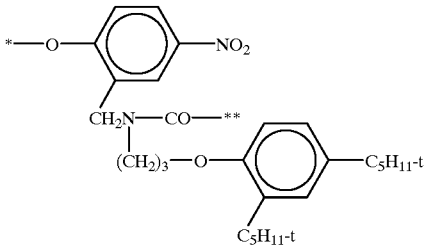

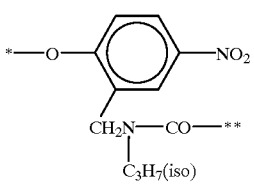

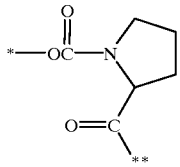

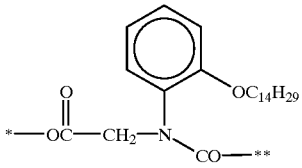

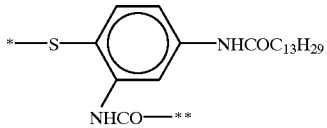

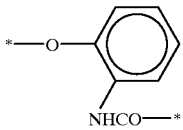

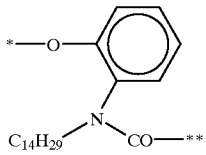

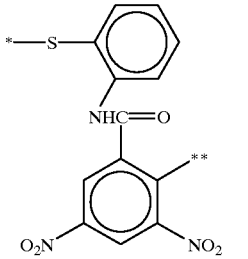

-continued

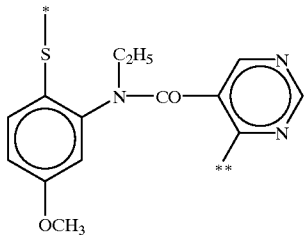

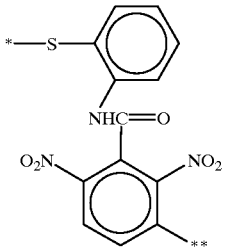

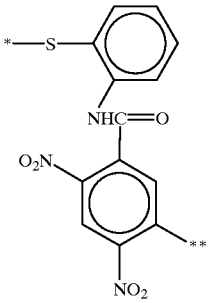

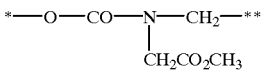

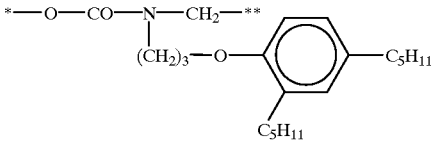

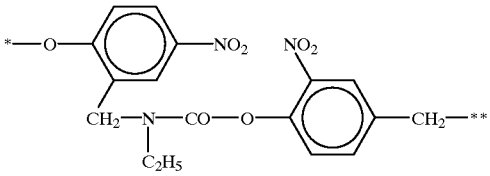

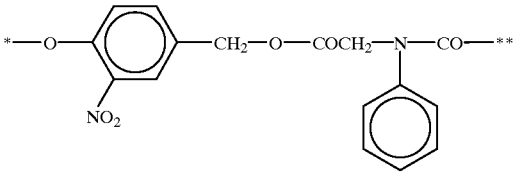

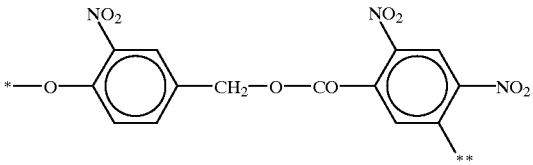

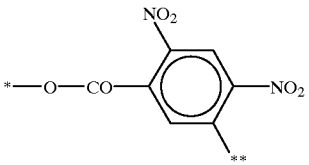

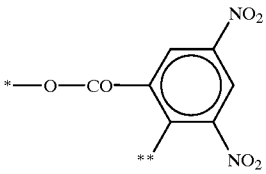

-continued

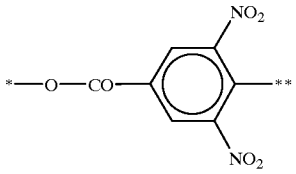

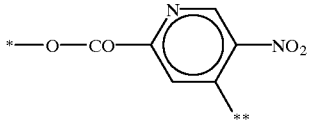

The photographically useful group represented by PUG may be any of those generally known in the art to which the present invention pertains.

Examples thereof include a development inhibitor, a bleaching accelerator, a development accelerator, a dye, a bleaching inhibitor, a coupler, a developing agent, a development aid, a reducing agent, a silver halide solvent, a silver complex-forming agent, a fixing agent, an image toner, a stabilizer, a film hardener, a tanning agent, a fogging agent, an ultraviolet absorber, an antifoggant, a nucleating agent, a chemical sensitizer or spectral sensitizer, a desensitizer and a brightening agent. These, however, do not limit the scope of photographically useful groups usable in the present invention.

PUG is preferably selected from among development inhibitors (for example, those described in U.S. Pat. Nos. 3,227,554, 3,384,657, 3,615,506, 3,617,291, 3,733,201, and 5,200,306 and British Patent (hereinafter referred to "GB") No. 1,450,479), bleaching accelerators (for example, those described in Research Disclosure 1973, Item No. 11,449, EP No. 193,389, and U.S. Pat. Nos. 4,959,299, 4,912,024, and 5,318,879), dyes (for example, those described in U.S. Pat. Nos. 3,880,658, 3,931,144, 3,932,380, 3,932,381 and 3,9429,987), couplers (for example, those described in U.S. Pat. Nos. 2,998,314, 2,808,329, 2,689,793, 2,742,832 and 5,348,847), development aids (for example, those described in U.S. Pat. No. 4,859,578 and JP-A-10-48787), development accelerators (for example, those described in U.S. Pat. No. 4,390,618 and JP-A-2-56543), reducing agents (for example, those described in JP-A-63-109439 and JP-A-63-128342) and brightening agents (for example, those described in U.S. Pat. Nos. 4,774,181 and 5,236,804), all the disclosures of which are herein incorporated by reference. The pKa value of the conjugate acid of PUG is preferably 13 or less, more preferably 11 or less.

PUG is most preferably a development inhibitor, which can be selected from among, for example, mercaptotetrazole derivatives, mercaptotriazole derivatives, mercaptothiadiazole derivatives, mercaptooxadiazole derivatives, mercaptoimidazole derivatives, mercaptobenzimidazole derivatives, mercaptobenzthiazole derivatives, mercaptobenzoxazole derivatives, tetrazole derivatives, 1,2,3-triazole derivatives, 1,2,4-triazole derivatives and benzotriazole derivatives.

Examples of the development inhibitor are set forth below, however, the present invention is not limited to these.

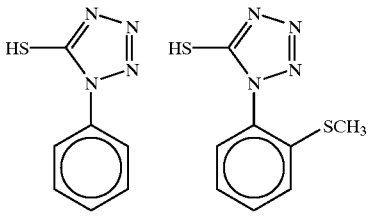
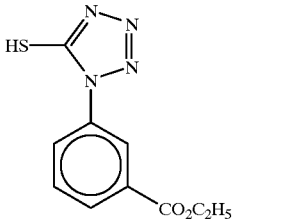
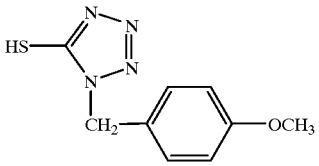
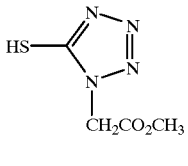
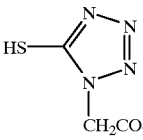
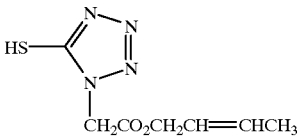
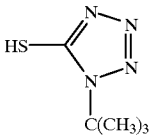
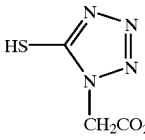
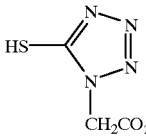
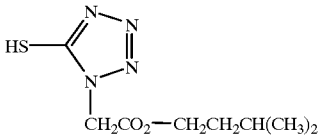
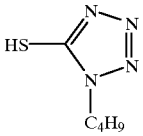
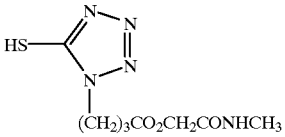
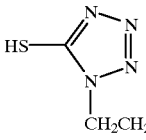
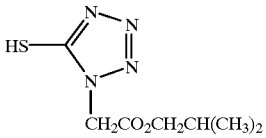
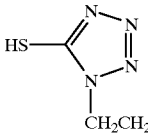
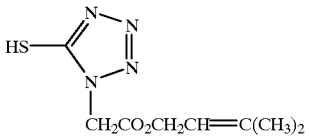
-continued
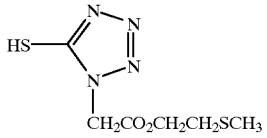
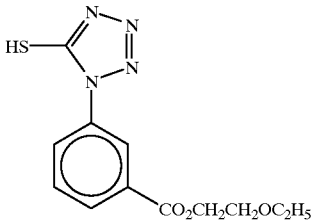
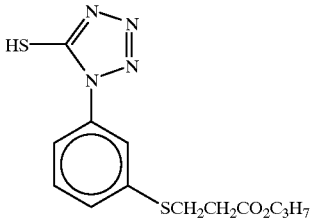
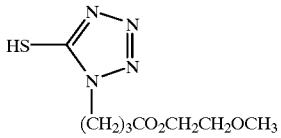
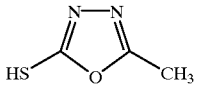
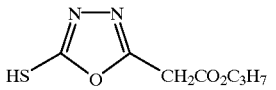
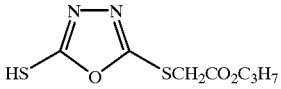
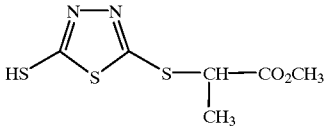
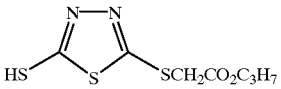
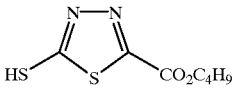
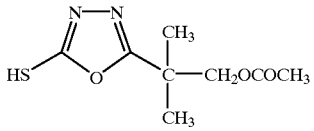
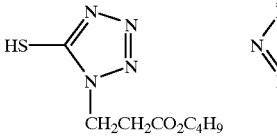
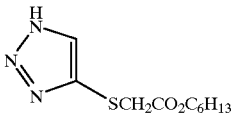
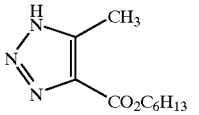
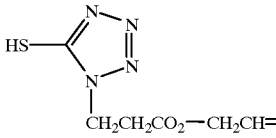

-continued

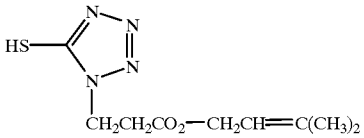

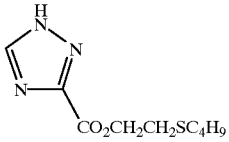

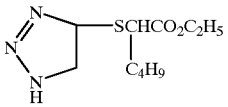

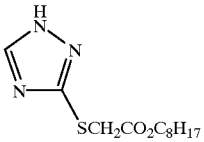

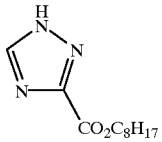

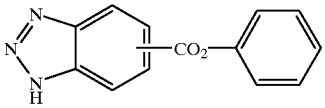

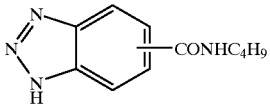

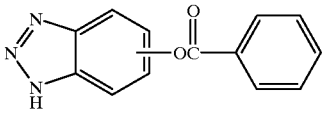

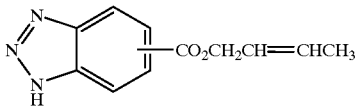

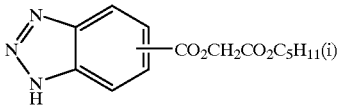

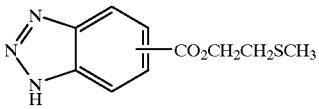

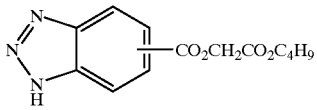

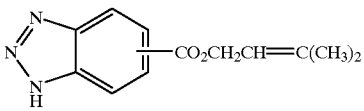

-continued

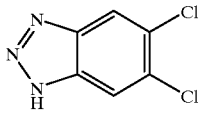

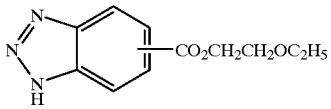

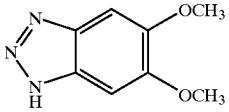

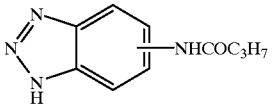

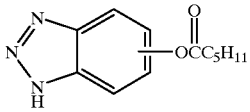

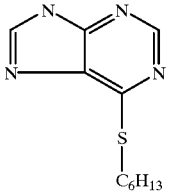

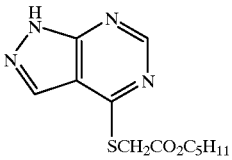

In the present invention, at least the following groups are excluded from the photographically useful group represented by PUG

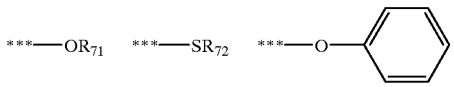

wherein *** represents the position that bonds to the electrophilic group represented by E in formula (I) mentioned above or the timing group represented by T in formula (III) mentioned above, $R_{71}$ represents a substituted or unsubstituted aliphatic group, and $R_{72}$ represents an unsaturated aliphatic group.

In a preferred embodiment of the present invention, the coupler represented by formula (I) is represented by formula (I-2) or (I-3), and the coupler represented by formula (I-3) is more preferred, wherein A, E, and B, and preferred A, E, and B are the same as those mentioned above.

In a more preferred embodiment, the coupler represented by formula (I-3) is represented by formula (I-3a), the coupler represented by formula (I-3b) is much more preferred, and the coupler represented by formula (I-3c) is still much more preferred. The structure of the cyclization product obtained by the reaction between the coupler represented by formula (I-3c) and the oxidized form, i.e., Ar'═NH, of the aromatic amine developing agent, i.e., $ArNH_2$, may be illustrate as follows:

(I-3a)

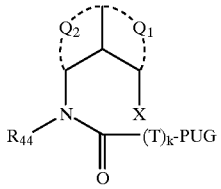

(I-3b)

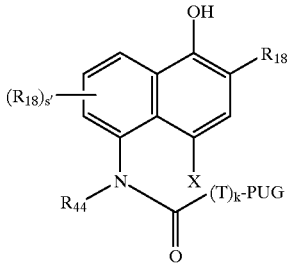

(I-3c)

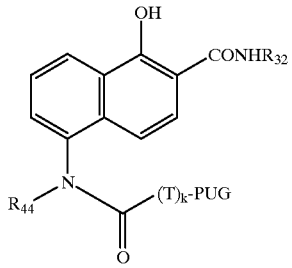

-continued (IV)

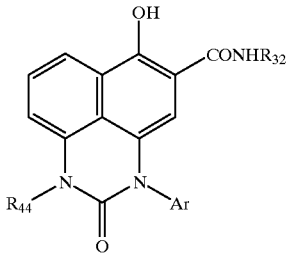

wherein $Q_1$ and $Q_2$ each represent a group of nonmetallic atoms required to form a 5-membered or 6-membered ring and induce the coupling reaction with a developing agent in a oxidized form at the atom of the joint part of X; X, T, k, PUG, $R_{18}$, s', and $R_{32}$ are as defined above; and $R_{44}$ represents a hydrogen atom, an aliphatic group, an aryl group, or a heterocyclic group, preferably an aliphatic group, an aryl group or a heterocyclic group, more preferably an aliphatic group. The aliphatic group, aryl group and heterocyclic group are the same as defined above for $R_{31}$.

Specific examples of the couplers for use in the lightsensitive material of the present invention will be set forth below, which, however, do not limit the scope of the couplers usable in the present invention.

(1)

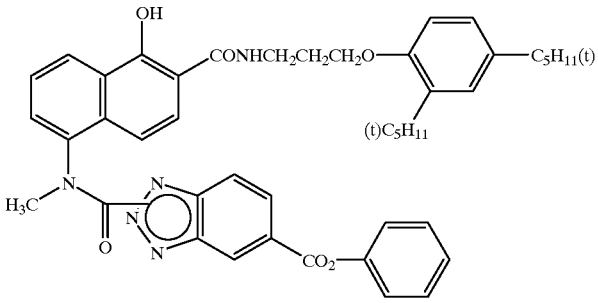

(2)

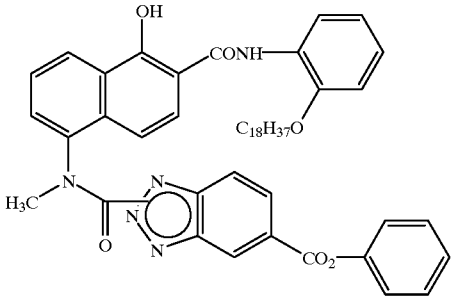

-continued
(3)
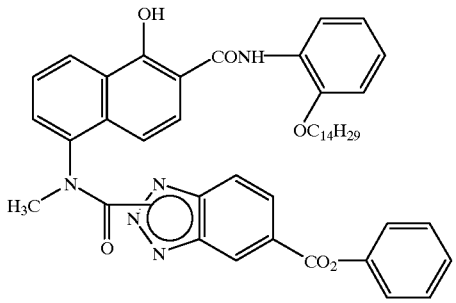
(4)
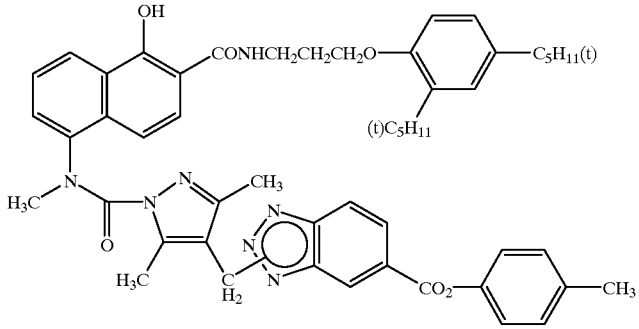
(5)
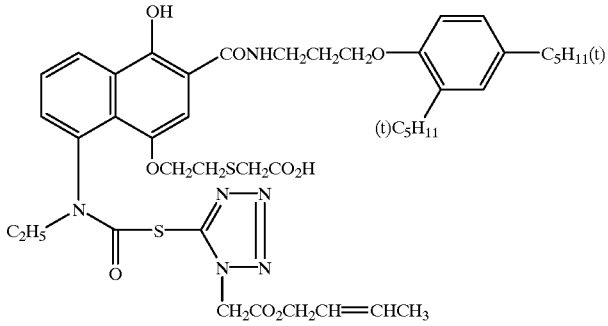
(6)
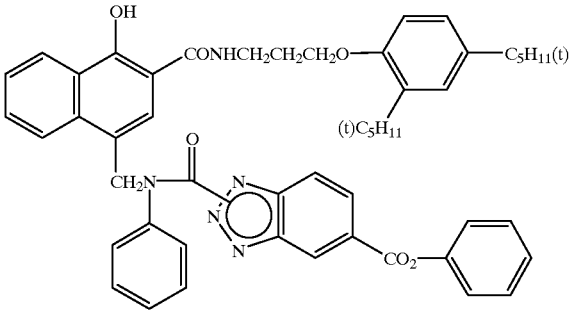
(7)
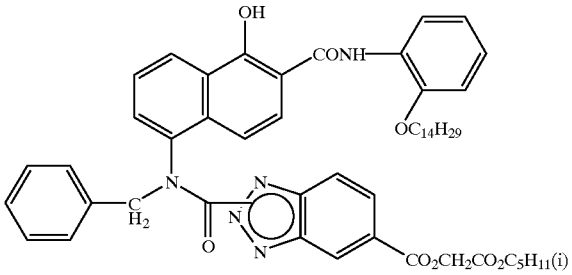

-continued
(8)
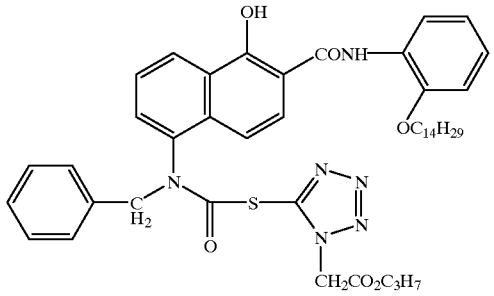
(9)
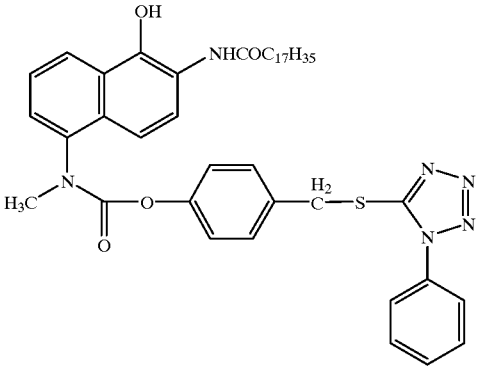
(10)
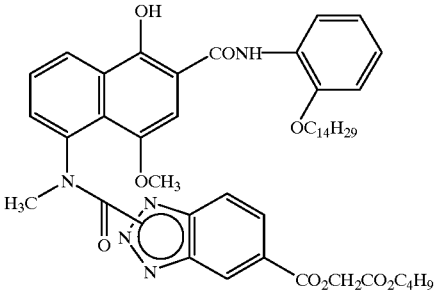
(11)
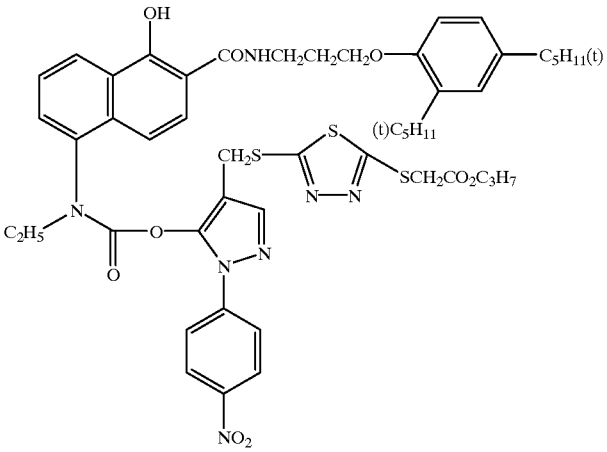

-continued
(12)
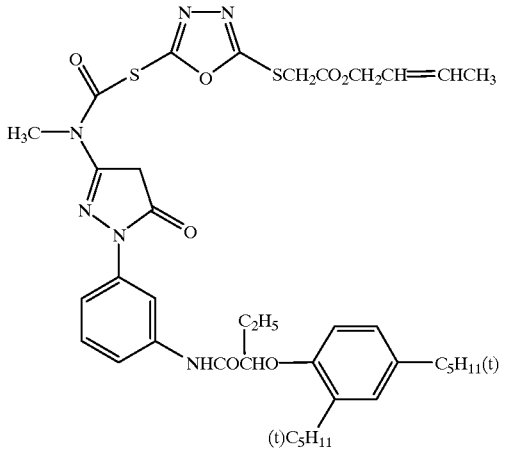
(13)
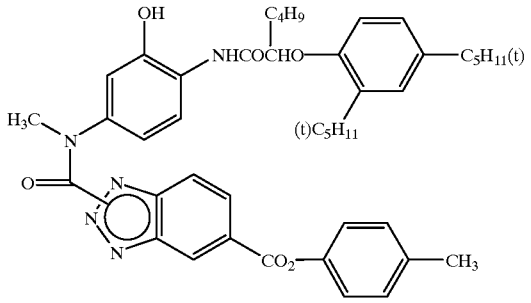
(14)
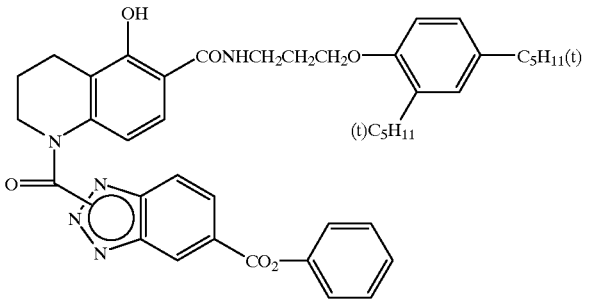
(15)
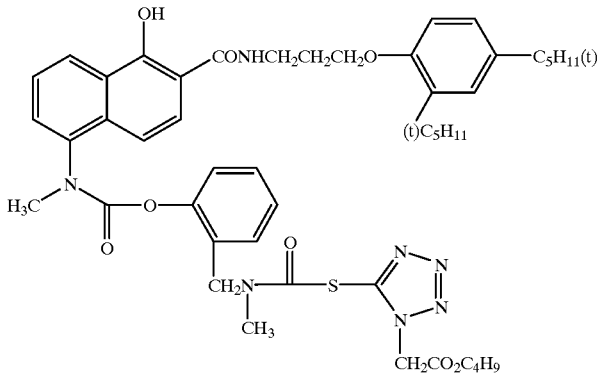

-continued
(16)
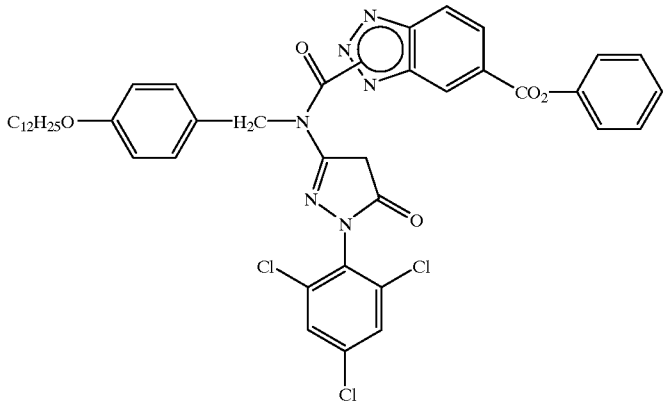
(17)
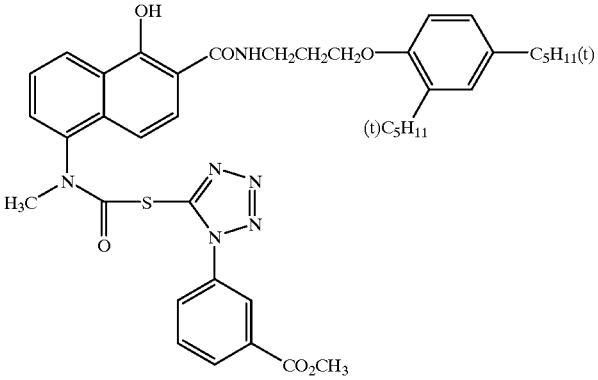
(18)
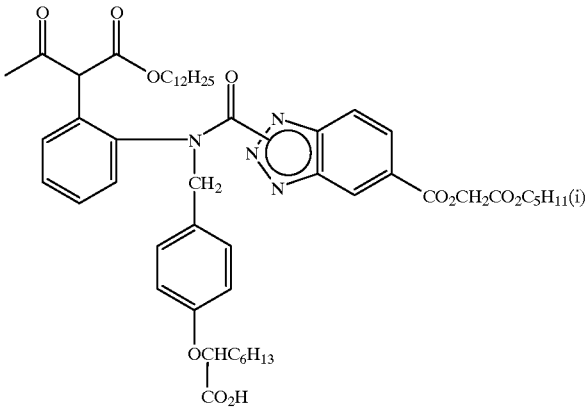

-continued
(19)
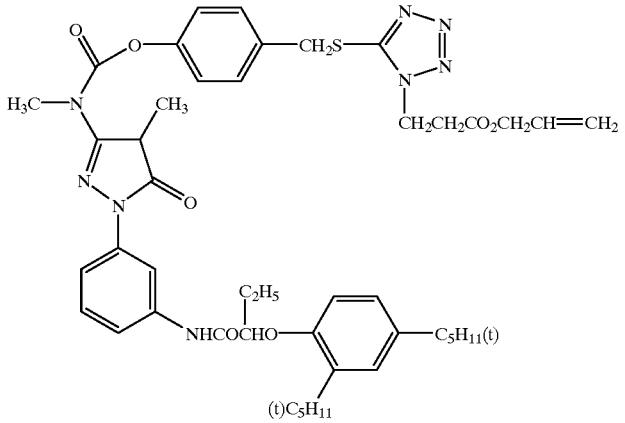
(20)
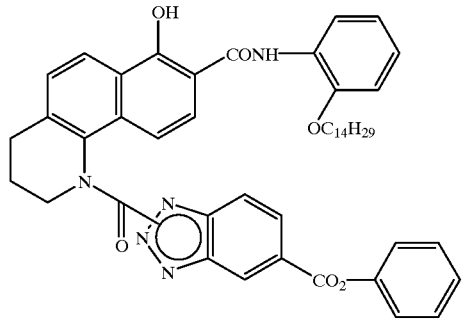
(21)
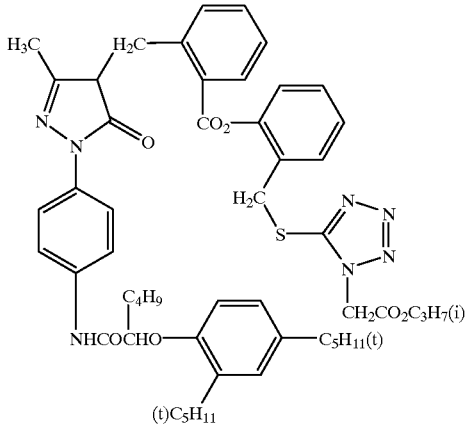
(22)
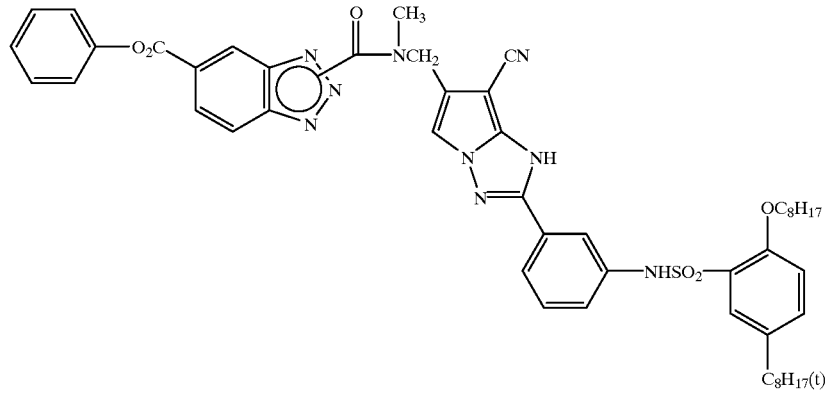

-continued
(23)
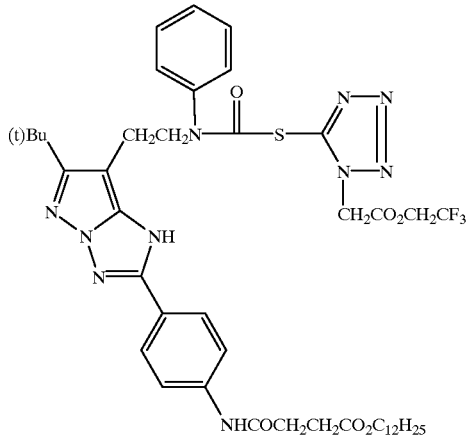
(24)
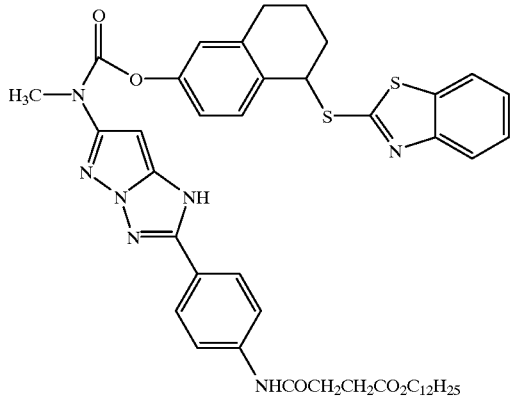
(25)
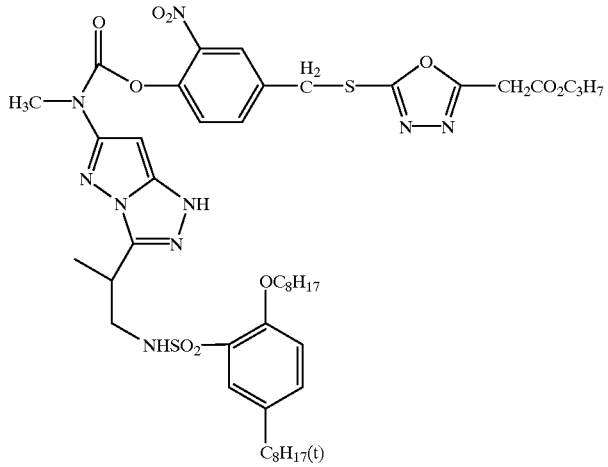

-continued
(26)
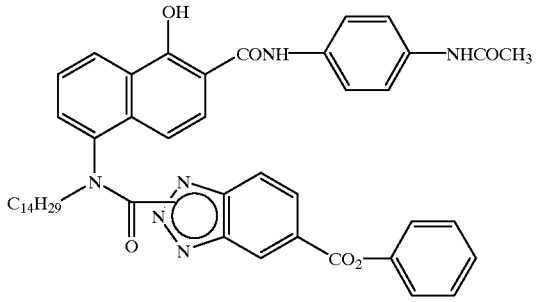
(27)
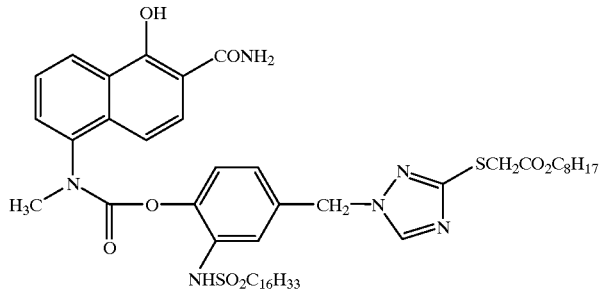
(28)
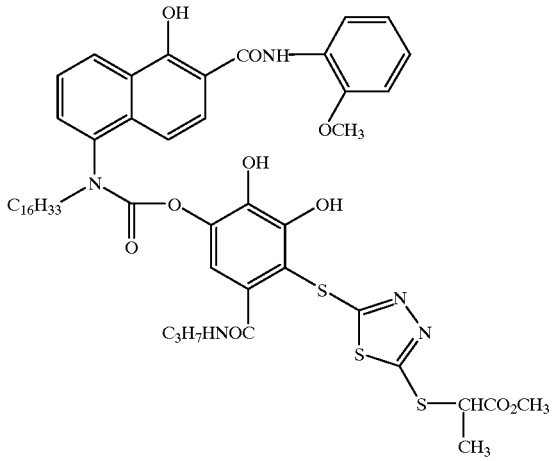
(29)
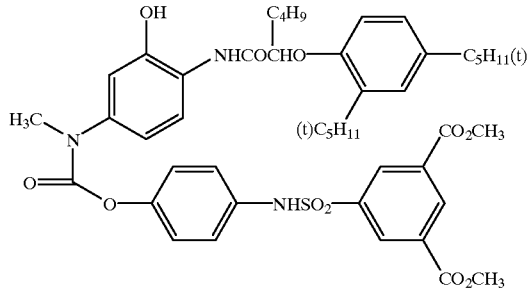

-continued
(30)
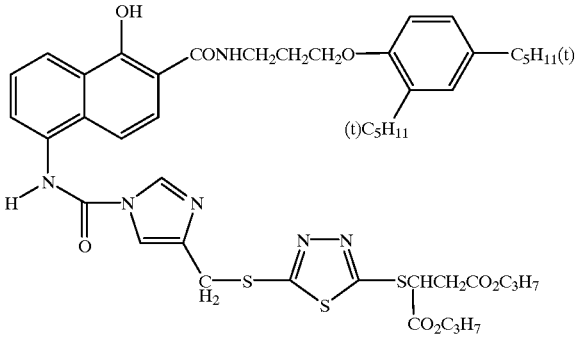
(31)
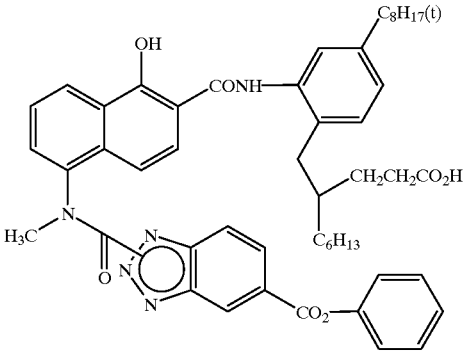
(32)
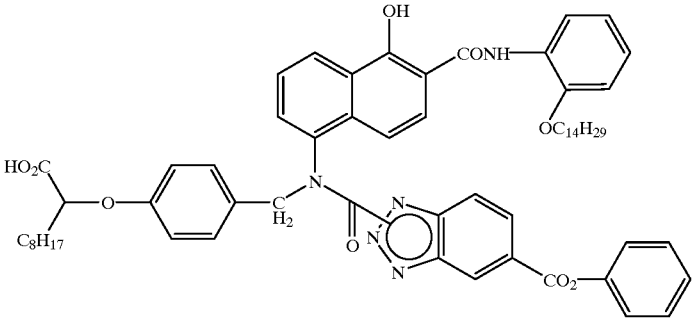
(33)
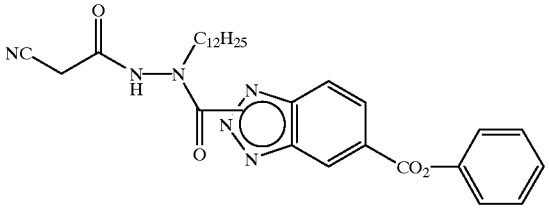
(34)
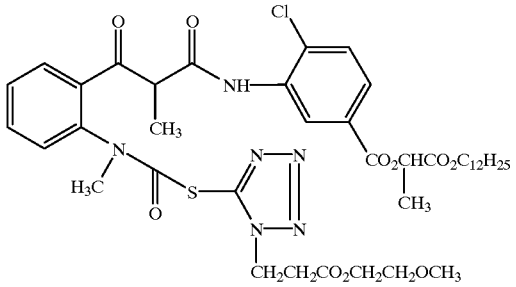

-continued
(35)
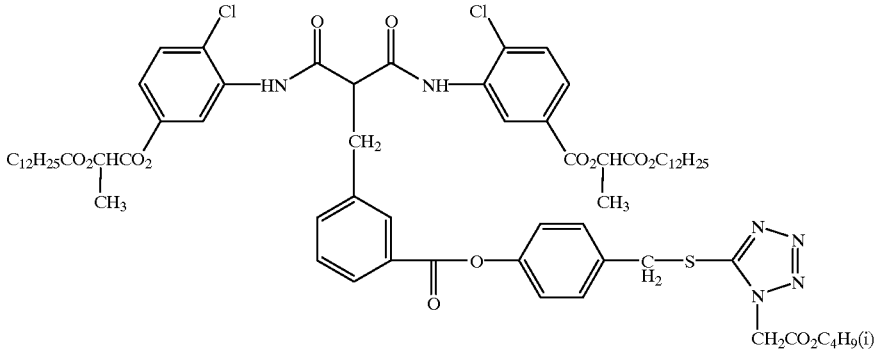
(36)
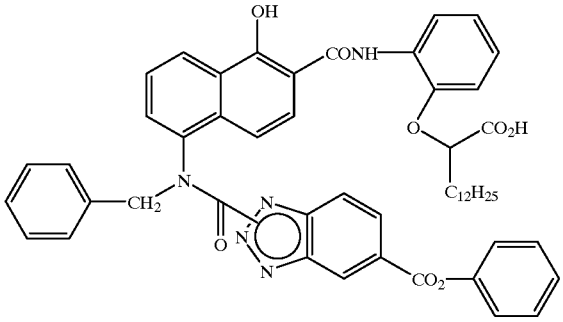
(37)
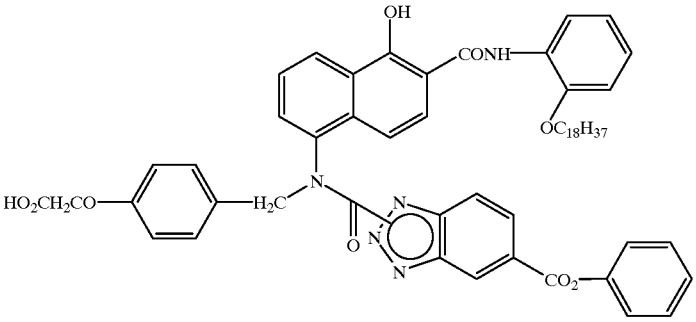
(38)
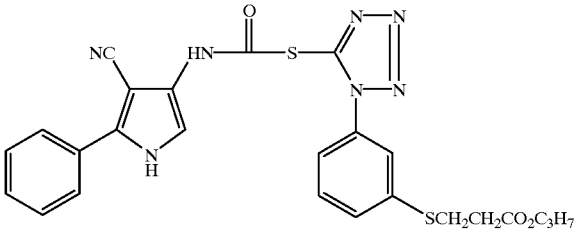

-continued
(39)
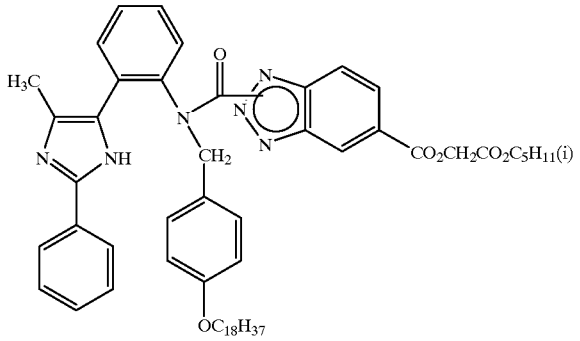
(40)
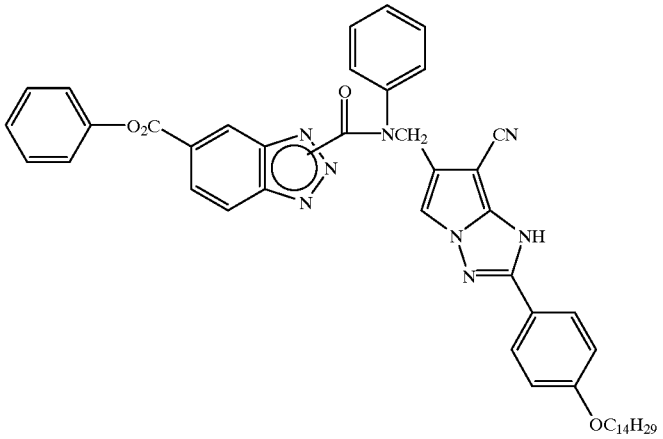
(41)
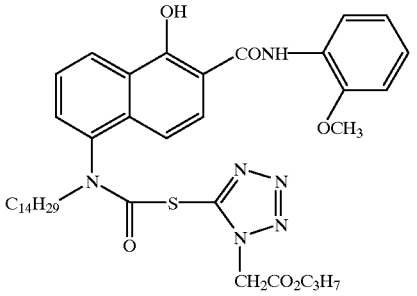
(42)
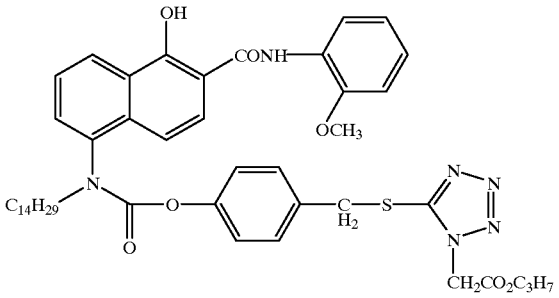

-continued
(43)
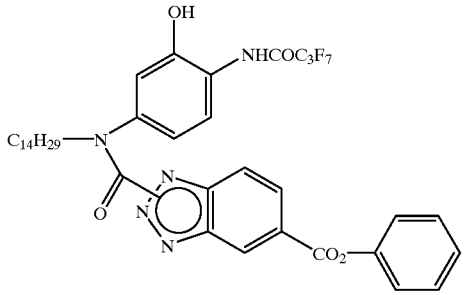
(44)
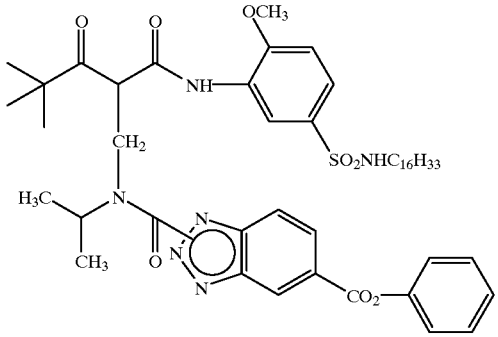
(45)
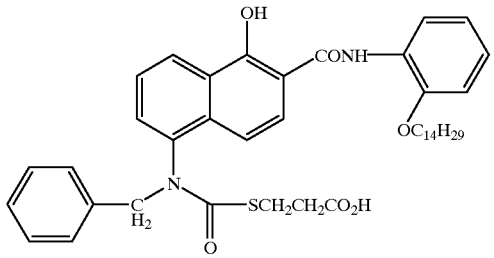
(46)
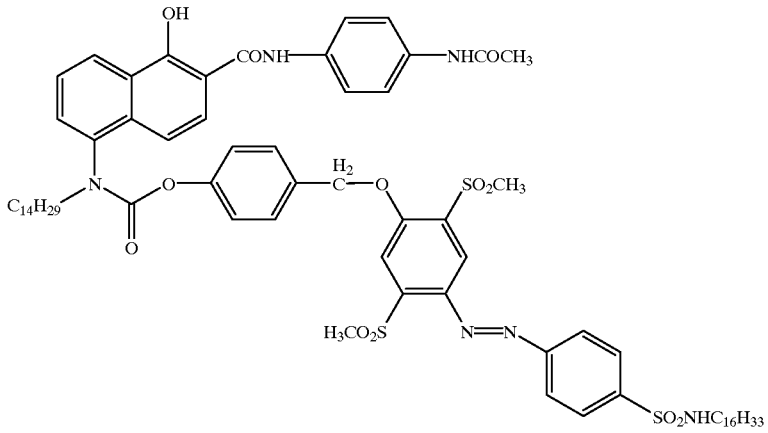

-continued
(47)
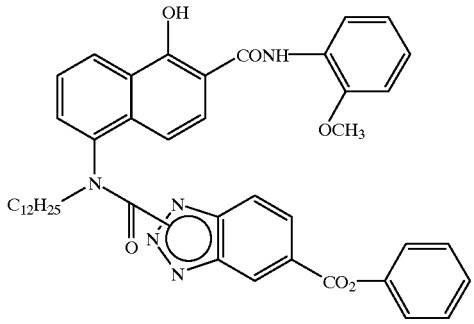
(48)
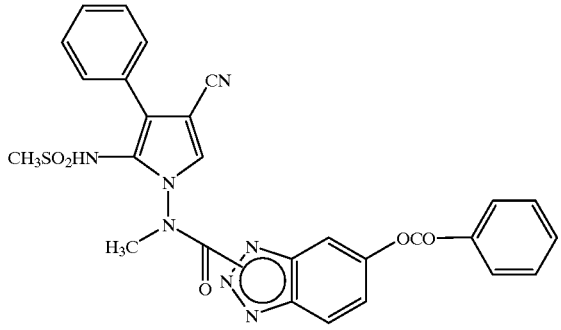
(49)
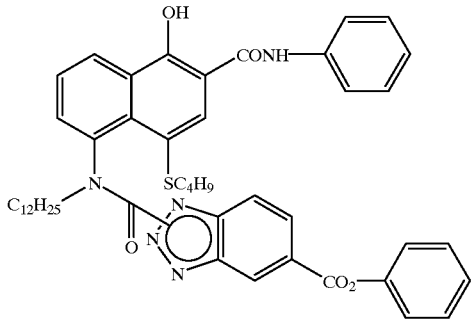
(50)
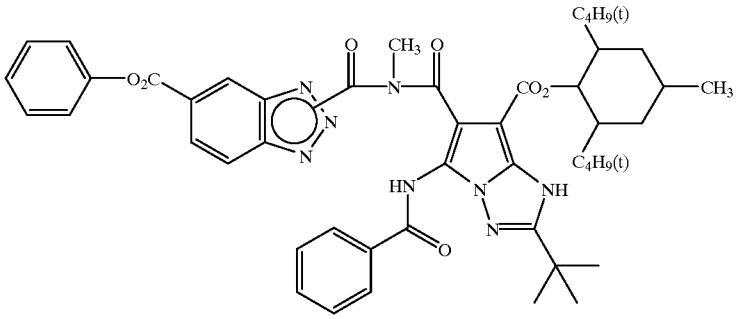

-continued
(51)
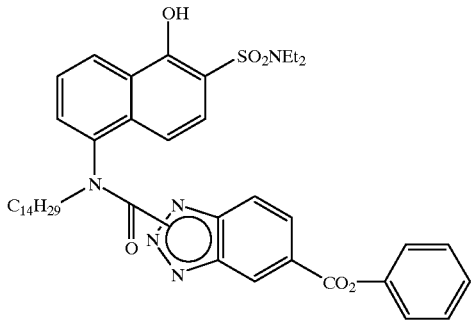
(52)
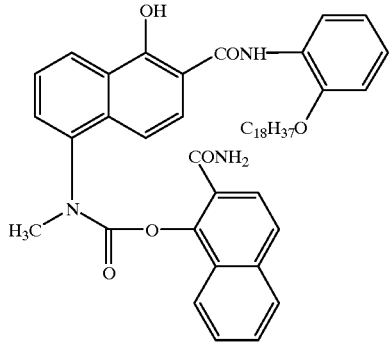
(53)
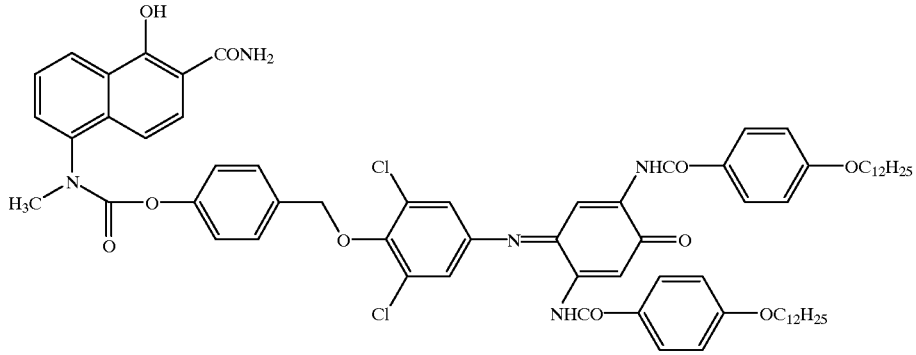
(54)
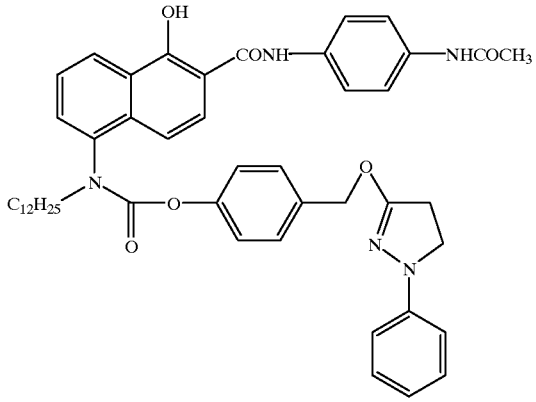

-continued
(55)
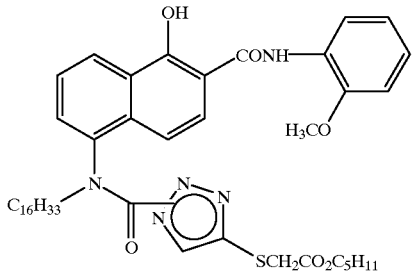
(56)
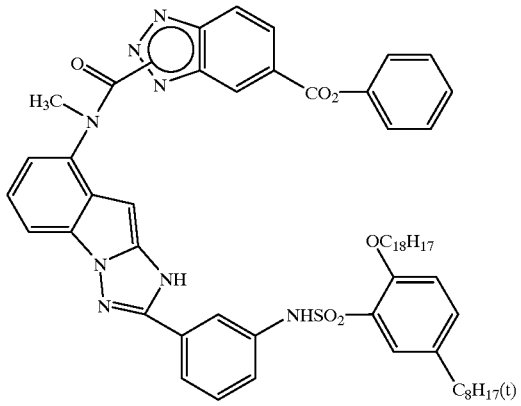
(57)
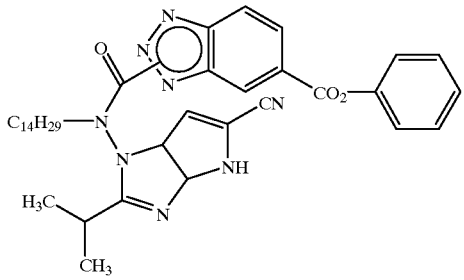
(58)
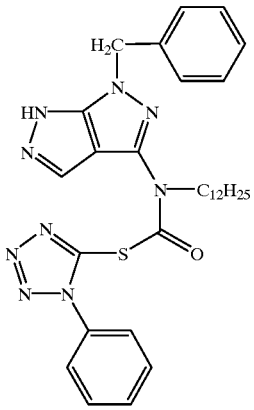

-continued
(59)
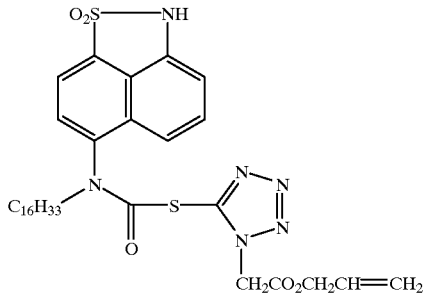
(60)
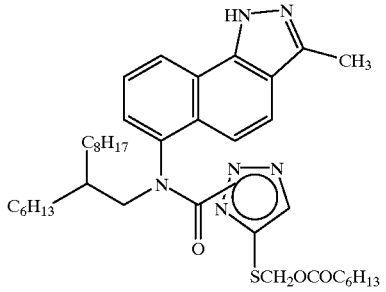
(61)
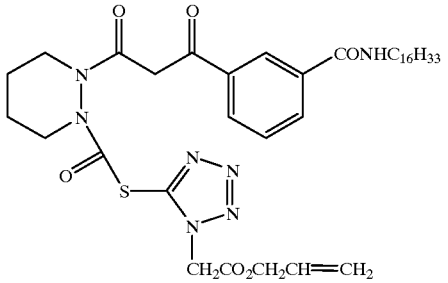
(62)
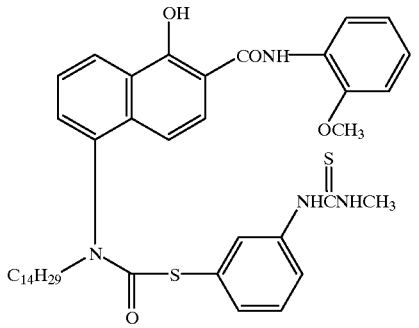

-continued
(63)
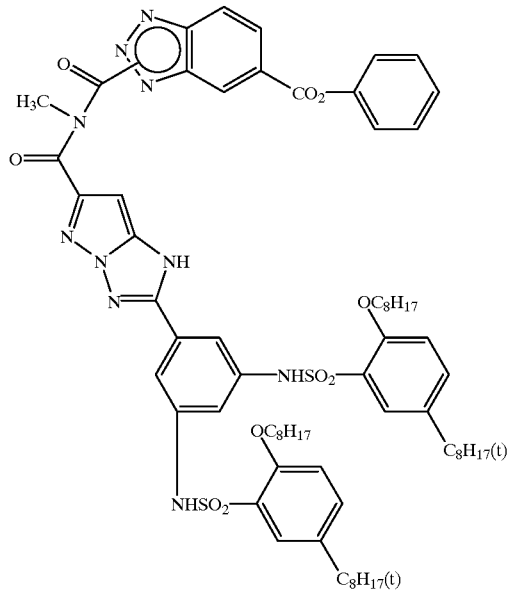
(64)
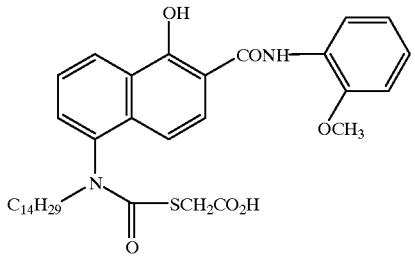
(65)
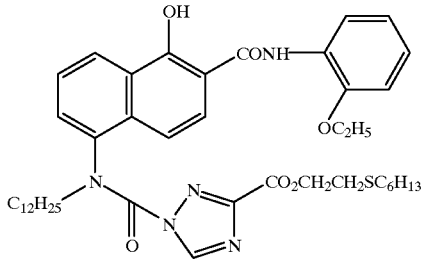
(66)
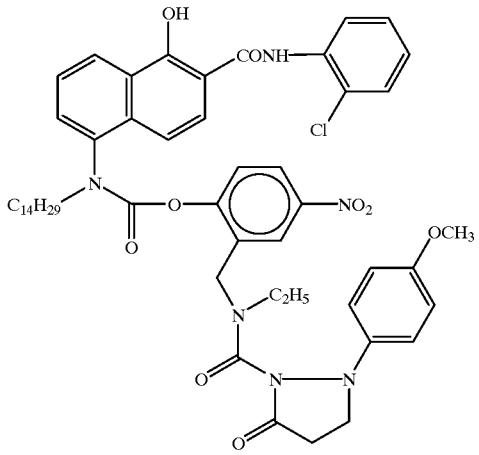

-continued
(67)
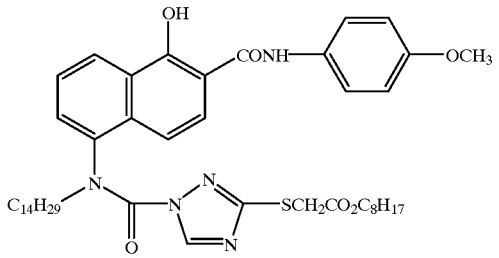
(68)
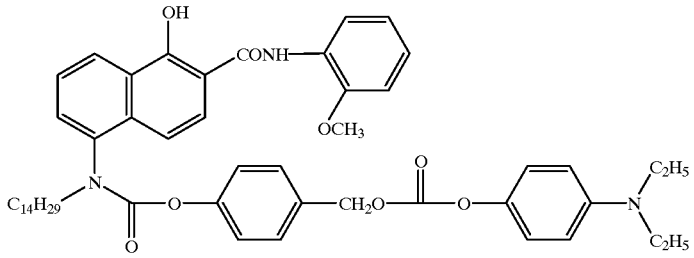
(69)
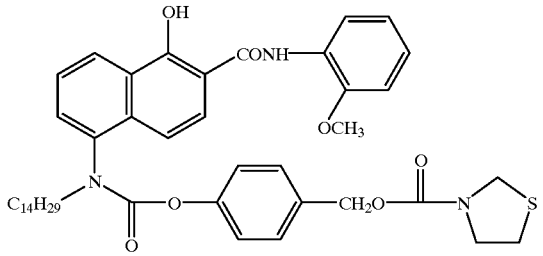
(70)
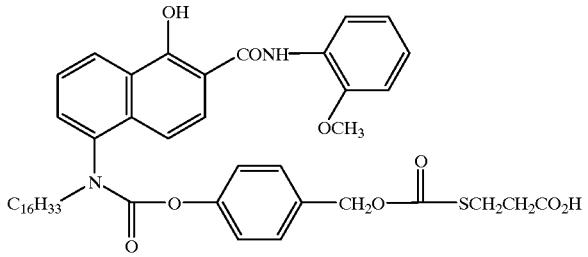
(71)
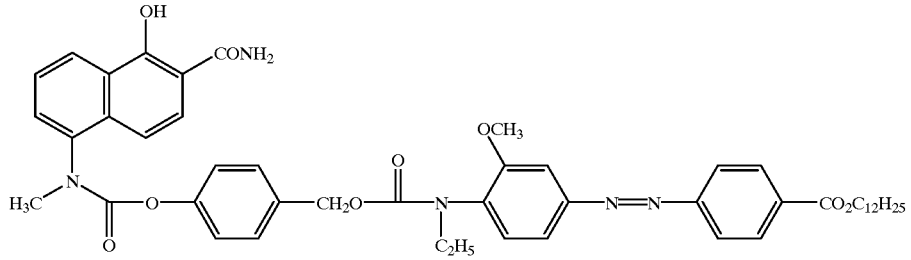

-continued
(72)
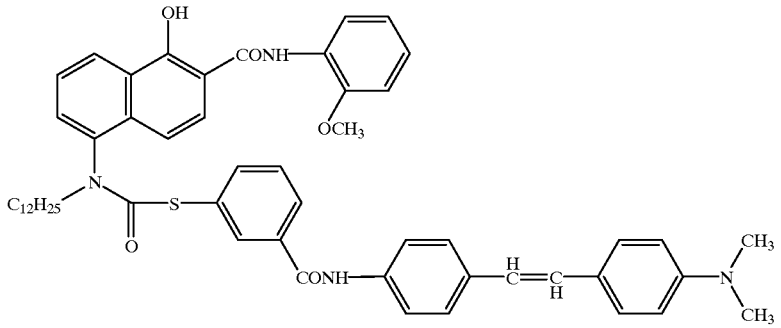
(73)
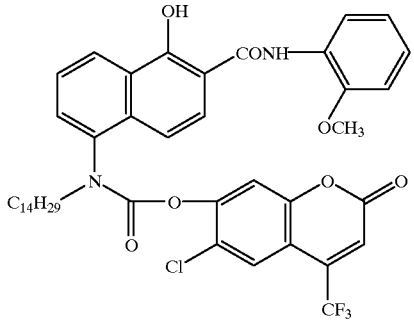
(74)
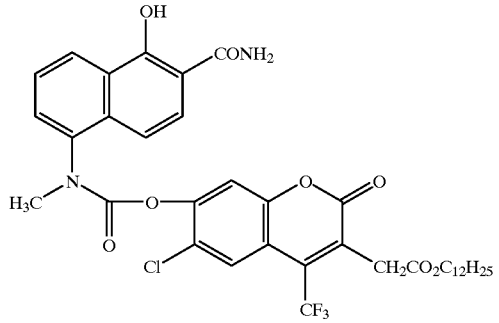
(75)
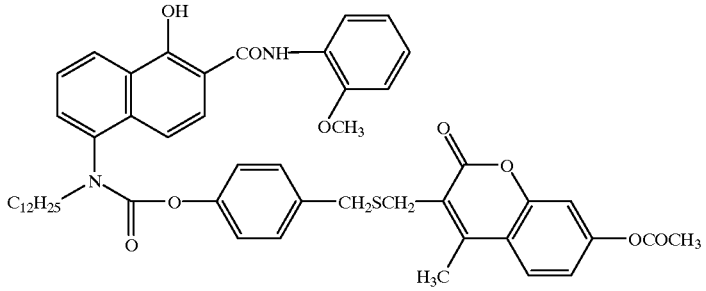
(76)
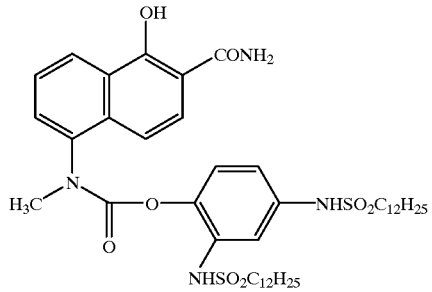

-continued
(77)
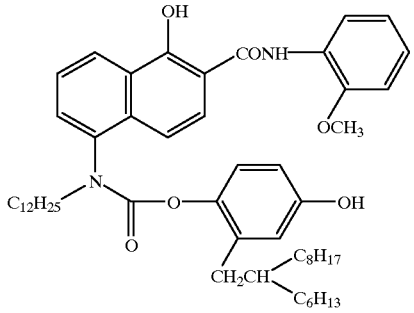
(78)
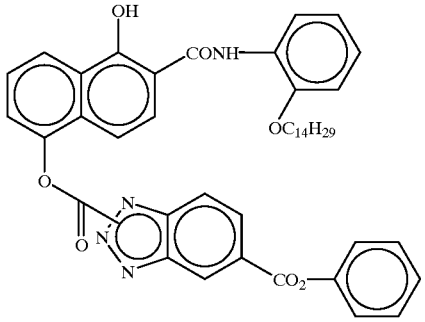
(79)
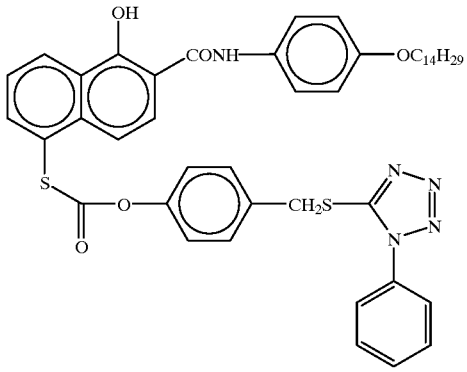
(80)
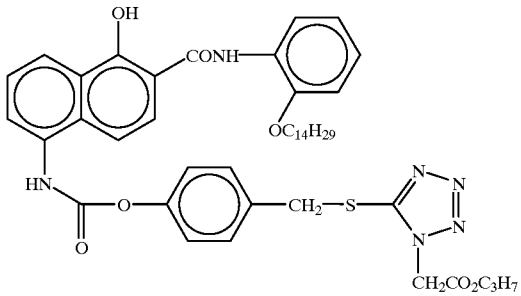

-continued
(81)
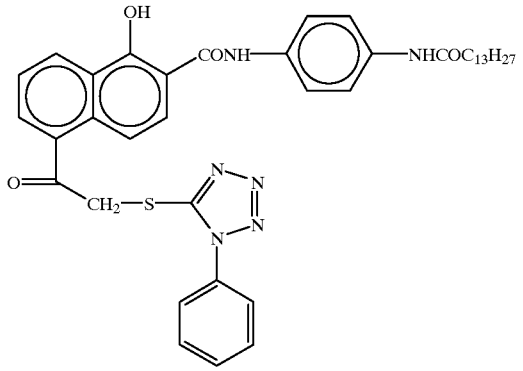
(82)
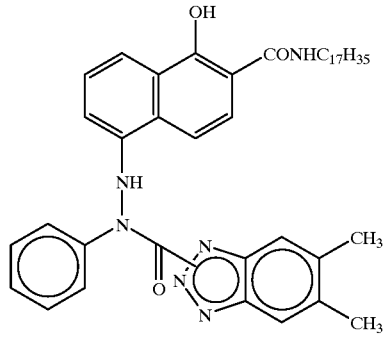
(83)
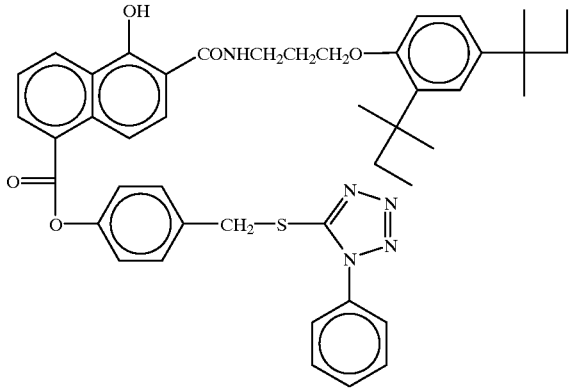
(84)
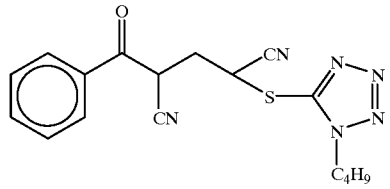

-continued
(85)
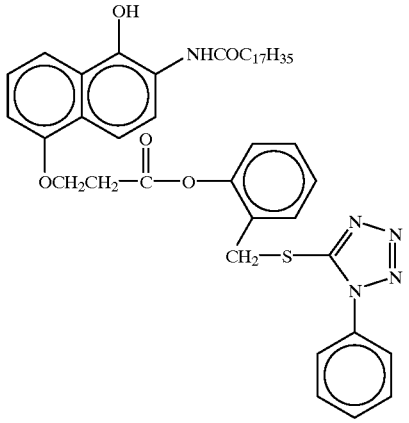
(86)
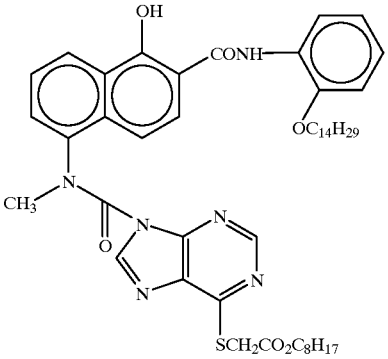
(87)
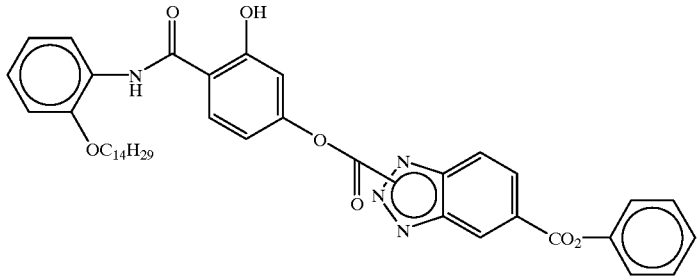
(88)
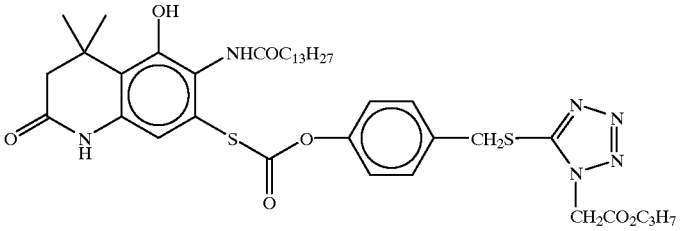

-continued
(89)
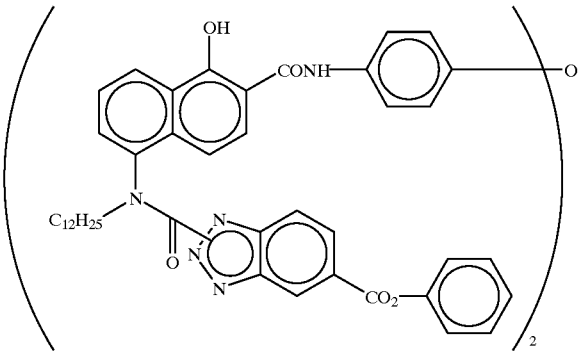
(90)
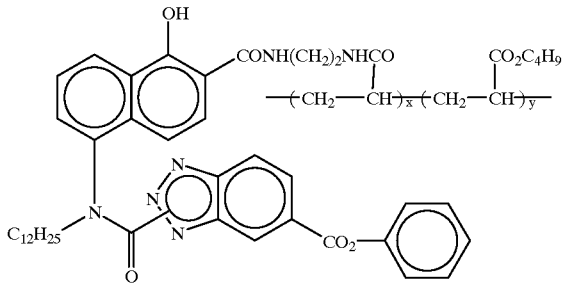
x:y = 70:30 (molar ratio)
Specific examples of the synthetic methods for the couplers of the present invention will be described below.
Synthesis of coupler of compound example (3):
Coupler of compound example (3) was synthesized according to the following scheme.
Synthesis of Exemplified Compound (3)
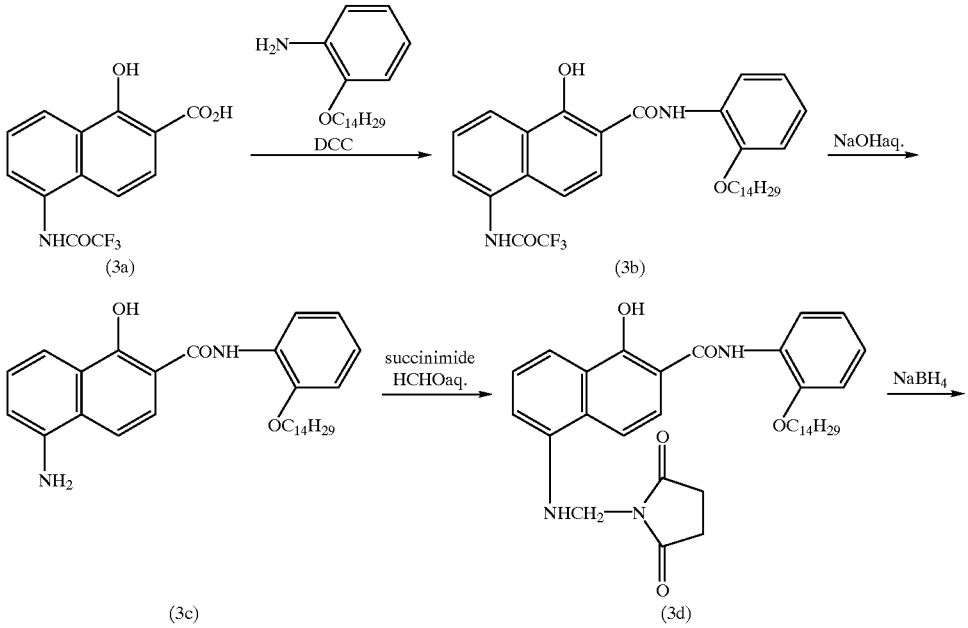

-continued

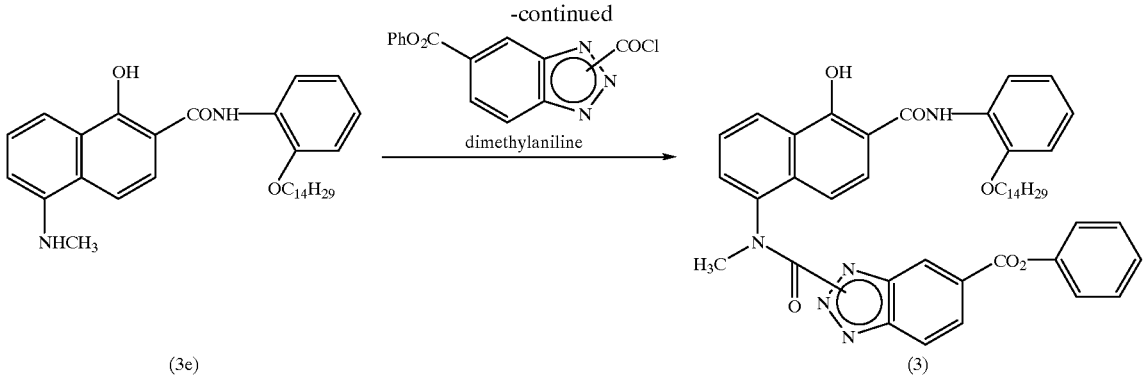

(3e) (3)

Synthesis of Compound 3b

A solution of 41.3 g of dicyclohexylcarbodiimide dissolved in 60 mL (milliliter) of N,N-dimethylacetamide was dropped at 30° C. into a solution of 50 g of compound 3a and 51.1 g of o-tetradecyloxyaniline dissolved in 250 mL of N,N-dimethylacetamide. The reaction mixture was agitated at 50° C. for 1 hr, and 250 mL of ethyl acetate was added thereto. The reaction mixture was cooled to 20° C. and suction-filtered. 250 mL of 1N aqueous hydrochloric acid was added to the obtained filtrate and fractionated. 100 mL of hexane was added to the obtained organic phase. The thus precipitated crystal was harvested by filtration, washed with acetonitrile and dried. As a result, 71 g of compound 3b was obtained.

Synthesis of Compound 3c 150 mL of an aqueous solution of 30 g of sodium hydroxide was dropped into a solution of 71 g of compound 3b dissolved in 350 mL of methanol and 70 mL of tetrahydrofuran and agitated in a nitrogen atmosphere at 60° C. for 1 hr. The reaction mixture was cooled to 20° C., and concentrated hydrochloric acid was dropped thereinto until the system was acidified. Precipitated crystal was harvested by filtration, washed with water and then acetonitrile and dried. Thus, 63 g of compound 3c was obtained.

Synthesis of Compound 3d 150 mL of a solution obtained by dissolving 20 g of compound 3c, 5.25 g of succinimide and 4.3 mL of a 37% aqueous formaldehyde solution in ethanol was agitated and refluxed for 5 hr, and cooled to 20° C. Precipitated crystal was harvested by filtration and dried. Thus, 16 g of compound 3d was obtained.

Synthesis of Compound 3e 1.32 g of sodium borohydride was added at 60° C. to a solution of 7 g of compound 3d dissolved in 70 mL of dimethyl sulfoxide so slowly that the temperature did not exceed 70° C. While maintaining the temperature, the mixture was agitated for 15 min. The thus obtained reaction mixture was slowly added to 100 mL of 1N aqueous hydrochloric acid and extracted with 100 mL of ethyl acetate. The organic phase was washed with water, dried over magnesium sulfate and concentrated at a reduced pressure. Original components were removed by short path column (development solvent: ethyl acetate/hexane=2/1), and recrystallization from ethyl acetate/hexane was performed to thereby obtain 3.3 g of compound 3e.

Synthesis of Compound (3)

A solution of 4.78 g of phenoxycarbonylbenzotriazole and 2.42 g of N,N-dimethylaniline dissolved in a mixture of 100 mL of dichloromethane and 200 mL of ethyl acetate was dropped into a solution of 1.98 g of bis(trichloromethyl) carbonate dissolved in 80 mL of dichloromethane and agitated at 20° C. for 2 hr to thereby obtain solution S.

120 mL of the above solution S was dropped at 10° C. into a solution of 2.0 g of compound 3e and 0.60 g of dimethylaniline dissolved in a mixture of 20 mL of tetrahydrofuran and 20 mL of ethyl acetate and agitated at 20° C. for 2 hr. The thus obtained reaction mixture was slowly added to 200 mL of 1N aqueous hydrochloric acid and extracted with 200 mL of ethyl acetate. The organic phase was washed with water, dried over magnesium sulfate and concentrated at a reduced pressure. Purification was conducted through column (development solvent: ethyl acetate/hexane=1/5), and recrystallization from ethyl acetate/hexane was performed to thereby obtain 1.3 g of compound example (3) (m.p.=138 to 140° C.). The identification of the obtained compound was performed by elementary analysis, NMR and mass spectrum.

Synthesis of Coupler of Compound Example (6):

Coupler of compound example (6) was synthesized according to the following scheme.

Synthesis of Exemplified Compound (6)

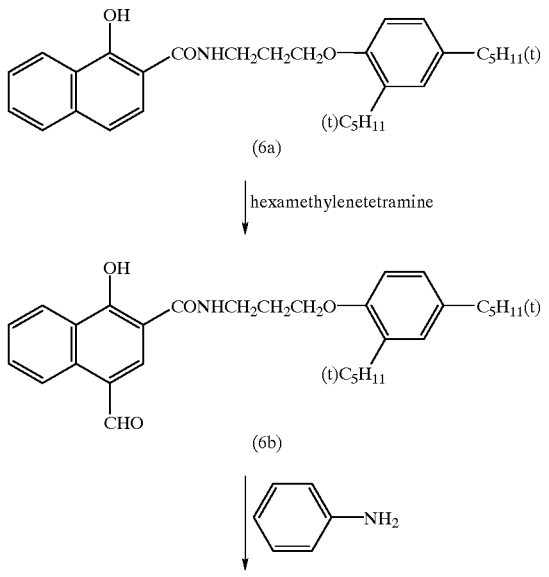

-continued

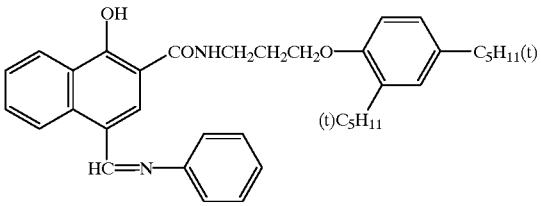

(6c)

$H_2$,Pd/C

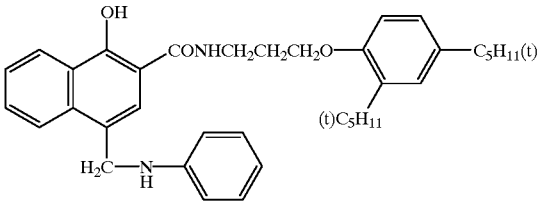

(6d)

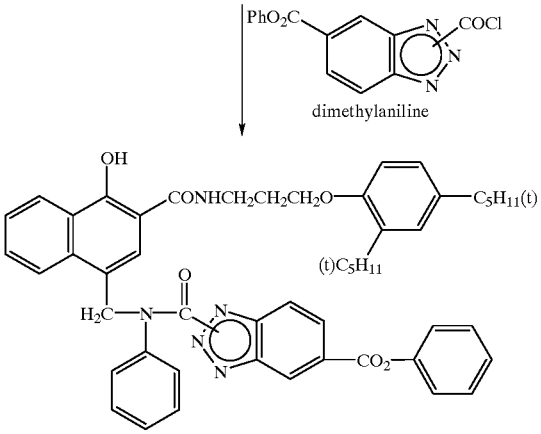

(6)

Synthesis of Compound 6b 23.1 g of compound 6a, 7.1 g of hexamethylenetetramine and 6.3 g of $Na_2SO_3$ were agitated in 150 mL of glacial acetic acid at 90° C. for 4 hr. The reaction mixture was cooled to 20° C. Precipitated crystal was harvested by filtration, washed with a small amount of methanol and dried. As a result, 19.8 g of compound 6b was obtained.

Synthesis of Compound 6d

A solution of 15.0 g of compound 6b and 3.0 g of aniline dissolved in 200 mL of toluene was agitated and refluxed for 5 hr while removing water. The reaction mixture was cooled to 20° C., and 100 mL of ethyl acetate was added thereto. The mixture was dried over magnesium sulfate and concentrated at a reduced pressure to thereby obtain crude compound 6c. 5 g of 10% Pd/C and 200 mL of ethyl acetate were added to the crude compound 6c and agitated at room temperature in a 20 kg/cm$^2$ hydrogen atmosphere for 3 hr. The catalyst was separated by filtration, and the mixture was concentrated at a reduced pressure. The concentrated residue was recrystallized from a mixture of ethyl acetate and hexane, thereby obtaining 13.0 g of compound 6d.

Synthesis of Compound (6)

100 mL of the above solution S was dropped at 10° C. into a solution of 2.5 g of compound 6d and 0.55 g of N,N-dimethylaniline dissolved in 10 mL of ethyl acetate and agitated at 20° C. for 2 hr. The thus obtained reaction mixture was slowly added to 200 mL of 1N aqueous hydrochloric acid and extracted with 200 mL of ethyl acetate. The organic phase was washed with water, dried over magnesium sulfate and concentrated at a reduced pressure. Purification was conducted through column (development solvent: ethyl acetate/hexane=1/3), and recrystallization from ethyl acetate/hexane was performed to thereby obtain 2.3 g of compound example (6) (m.p.=150 to 152° C.). The identification of the obtained compound was performed by elementary analysis, NMR and mass spectrum.

Synthesis of Coupler of Compound Example (16):

Coupler of compound example (16) was synthesized according to the following scheme.

Synthesis of Exemplified Compound (16)

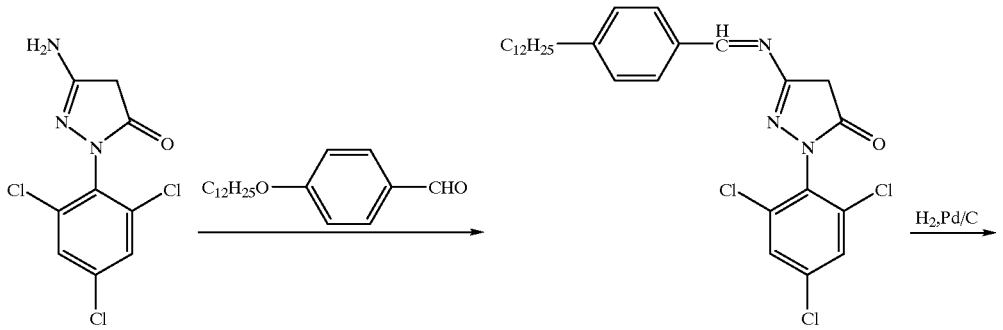

(16a) (16b)

-continued

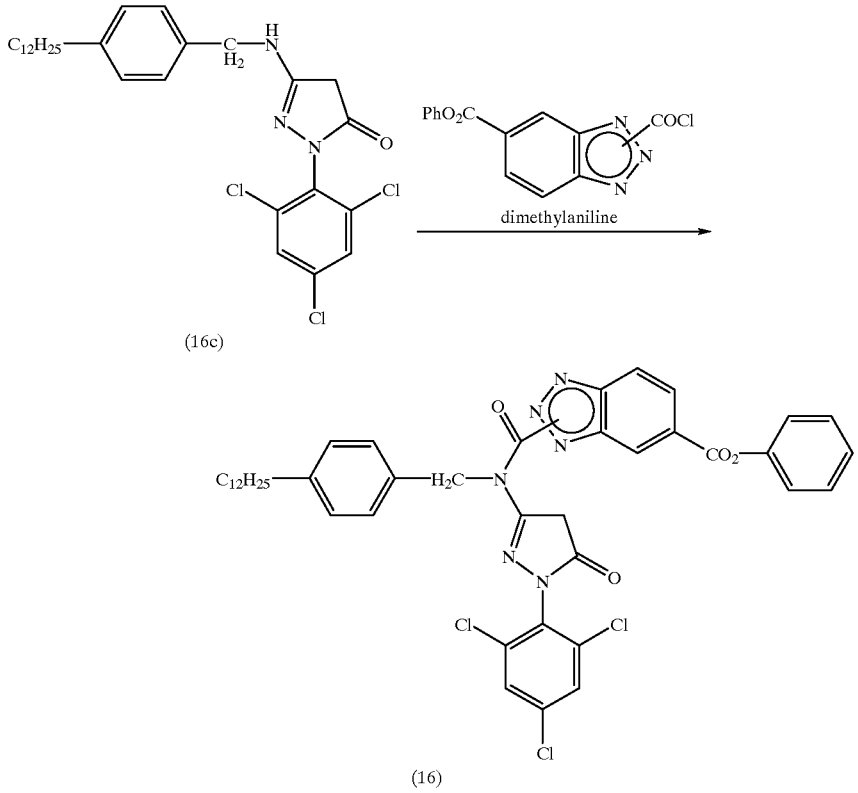

Synthesis of Compound 16b 27.8 g of compound 16a and 29 g of p-dodecyloxybenzaldehyde were agitated under a stream of nitrogen at 120° C. for 1 hr and cooled to room temperature. The reaction residue was purified through column (development solvent: ethyl acetate/hexane=1/3), thereby obtaining 17.3 g of compound 16b.

Synthesis of Compound 16c 4 g of 10% Pd/C and 250 mL of ethyl acetate were added to 17.3 g of compound 16b and agitated at room temperature in a 20 kg/cm$^2$ hydrogen atmosphere for 3 hr. The catalyst was separated by filtration, and the mixture was concentrated at a reduced pressure. The concentrated residue was recrystallized from a mixture of ethyl acetate and hexane, thereby obtaining 12.5 g of compound 16c.

Synthesis of Compound (16)

200 mL of the above solution S was dropped at 10° C. into a solution of 4.4 g of compound 16c and 1.1 g of N,N-dimethylaniline dissolved in a mixture of 30 mL of tetrahydrofuran and 30 mL of ethyl acetate and agitated at 20° C. for 2 hr. The thus obtained reaction mixture was slowly added to 250 mL of 1N aqueous hydrochloric acid and extracted with 250 mL of ethyl acetate. The organic phase was washed with water, dried over magnesium sulfate and concentrated at a reduced pressure. Purification was conducted through column (development solvent: ethyl acetate/hexane=1/5) to thereby obtain 2.9 g of compound example (16). The identification of the obtained compound was performed by elementary analysis, NMR and mass spectrum.

Synthesis of Coupler of Compound Example (40):

Coupler of compound example (40) was synthesized according to the following scheme.

Synthesis of Exemplified Compound (40)

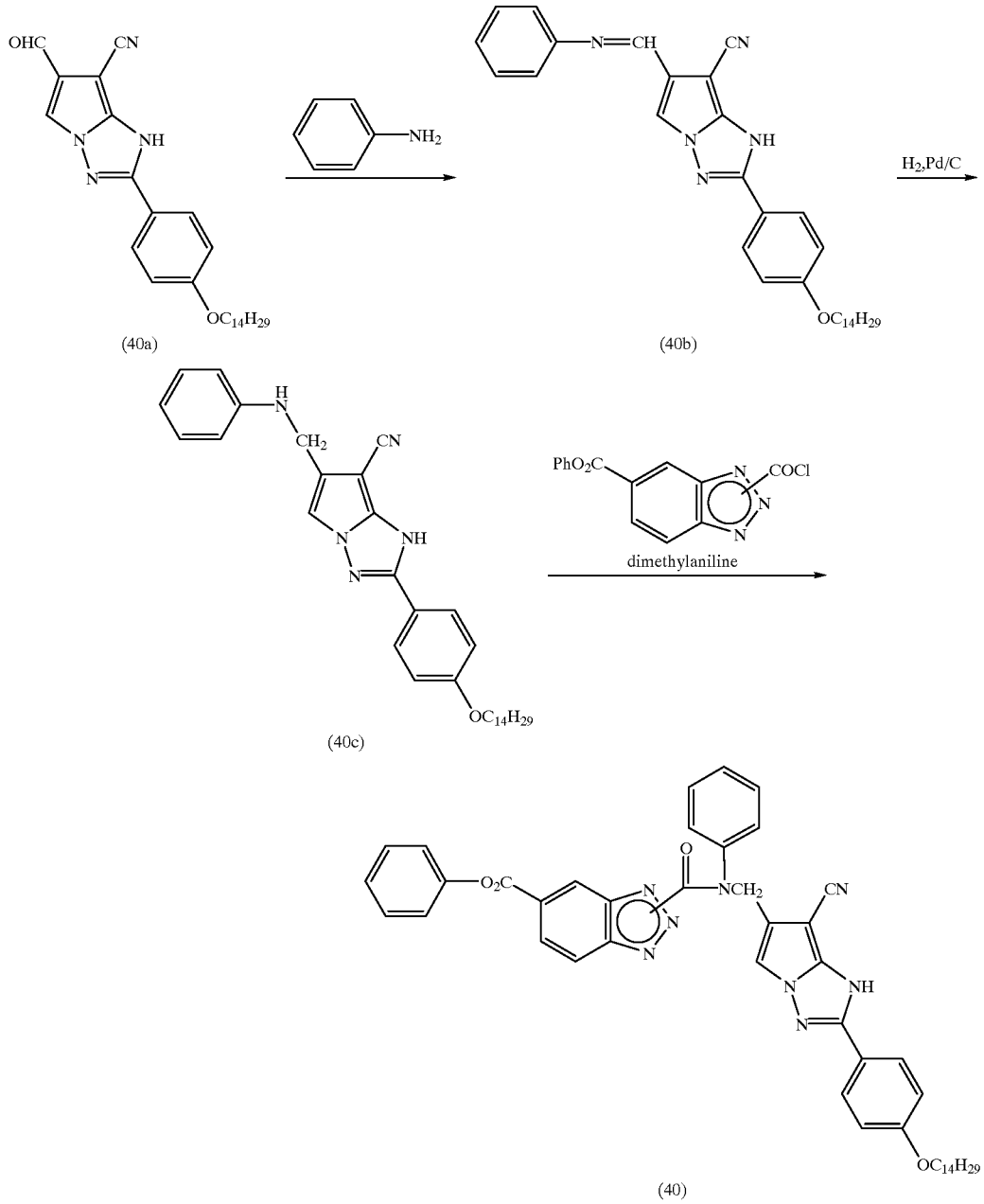

Synthesis of Compound 40c

A solution of 15.9 g of compound 40a and 3.0 g of aniline dissolved in 200 mL of toluene was agitated and refluxed for 5 hr while removing water. The reaction mixture was cooled to 20° C. and concentrated at a reduced pressure to thereby obtain crude compound 40b. 5 g of 10% Pd/C and 200 mL of ethyl acetate were added to the crude compound 40b and agitated at room temperature in a 20 kg/cm$^2$ hydrogen atmosphere for 5 hr. The catalyst was separated by filtration, and the mixture was concentrated at a reduced pressure. The concentrated residue was recrystallized from a mixture of ethyl acetate and hexane, thereby obtaining 11.5 g of compound 40c.

Synthesis of Compound (40)

A solution of 19.1 g of phenoxycarbonylbenzotriazole dissolved in 75 mL of tetrahydrofuran was dropped at 10° C. into 100 mL of a solution of 9.5 g of bis(trichloromethyl) carbonate dissolved in ethyl acetate and agitated at 40° C. for 3 hr. The solvent was distilled off in vacuum, and 200 mL of hexane was added to the concentrated residue and agitated for 1 hr. The crystal was harvested by filtration and dried, thereby obtaining 22.4 g of carbamoyl chloride of phenoxycarbonylbenzotriazole (hereinafter referred to as "PBT-COCl".

3.0 g of the above PBT-COCl was slowly added at 10° C. to a solution of 5.0 g of compound 40c and 2.0 g of N,N-dimethylaniline dissolved in 50 mL of tetrahydrofuran and agitated at 20° C. for 2 hr. The thus obtained reaction mixture was slowly added to a mixture of 200 mL of ethyl acetate and 200 mL of 1N aqueous hydrochloric acid. The organic phase was washed with water, dried over magnesium sulfate and concentrated at a reduced pressure. The concentrated residue was purified through column (development solvent: ethyl acetate/hexane=1/4), thereby obtaining 3.2 g of compound example (40). The identification of the obtained compound was performed by elementary analysis, NMR and mass spectrum.

Synthesis of Coupler of Compound Example (41):

Coupler of compound example (41) was synthesized according to the following scheme.

Synthesis of Exemplified Compound (41)

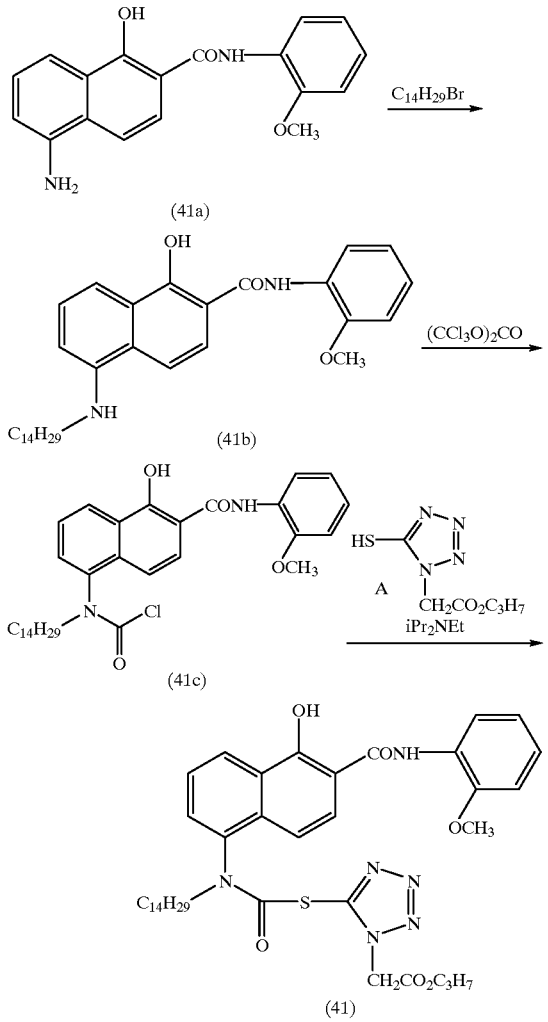

Synthesis of Compound 41b

A solution of 50 g of compound 41a, which was synthesized in the same manner as that of the compound 3c, and 78.6 g of bromotetradecane dissolved in 150 mL of 1-methylpyrrolidone was agitated at 120° C. for 5 hr, cooled to 25° C. and poured into a mixture of 600 mL of ethyl acetate and 600 mL of water. The organic phase was washed with water and concentrated at a reduced pressure. The concentrated residue was recrystallized from a mixture of ethyl acetate and hexane, thereby obtaining 48 g of compound 41b.

Synthesis of Compound 41c

A solution of 6.5 g of compound 41b and 3.1 g of dimethylaniline dissolved in 20 mL of tetrahydrofuran was dropped at 10° C. into a solution of 1.9 g of bis (trichloromethyl) carbonate dissolved in 5 mL of tetrahydrofuran. The reaction mixture was agitated at 25° C. for 1 hr and poured into a mixture of 100 mL of ethyl acetate and 100 mL of 1N aqueous hydrochloric acid. The organic phase was washed with water, dried over magnesium sulfate and concentrated at a reduced pressure. The concentrated residue was recrystallized from a mixture of ethyl acetate and hexane, thereby obtaining 5.4 g of compound 41c.

Synthesis of Compound 41

A solution of 3.0 g of compound 41c, 2.1 g of mercaptotetrazole derivative A and 1.2 g of N,N-diisopropyl-N-ethylamine dissolved in 50 mL of toluene was agitated at 80° C. for 5 hr. The reaction mixture was cooled to 30° C. and poured into a mixture of 100 mL of ethyl acetate and 100 mL of aqueous sodium hydrogencarbonate. The organic phase was washed with water, dried over magnesium sulfate and concentrated at a reduced pressure. The concentrated residue was purified through column (development solvent: ethyl acetate/hexane=1/2), thereby obtaining 2.5 g of compound example (41). The identification of the obtained compound was performed by elementary analysis, NMR and mass spectrum.

Synthesis of Coupler of Compound Example (42):

Coupler of compound example (42) was synthesized according to the following scheme.

Synthesis of Exemplified Compound (42)

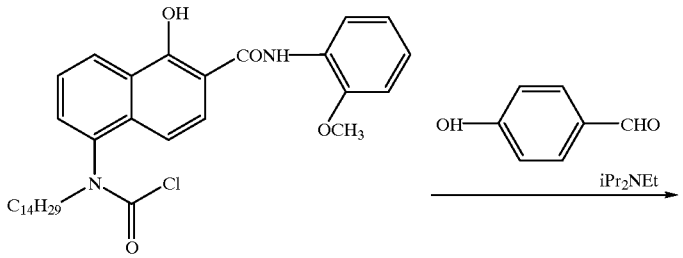

-continued

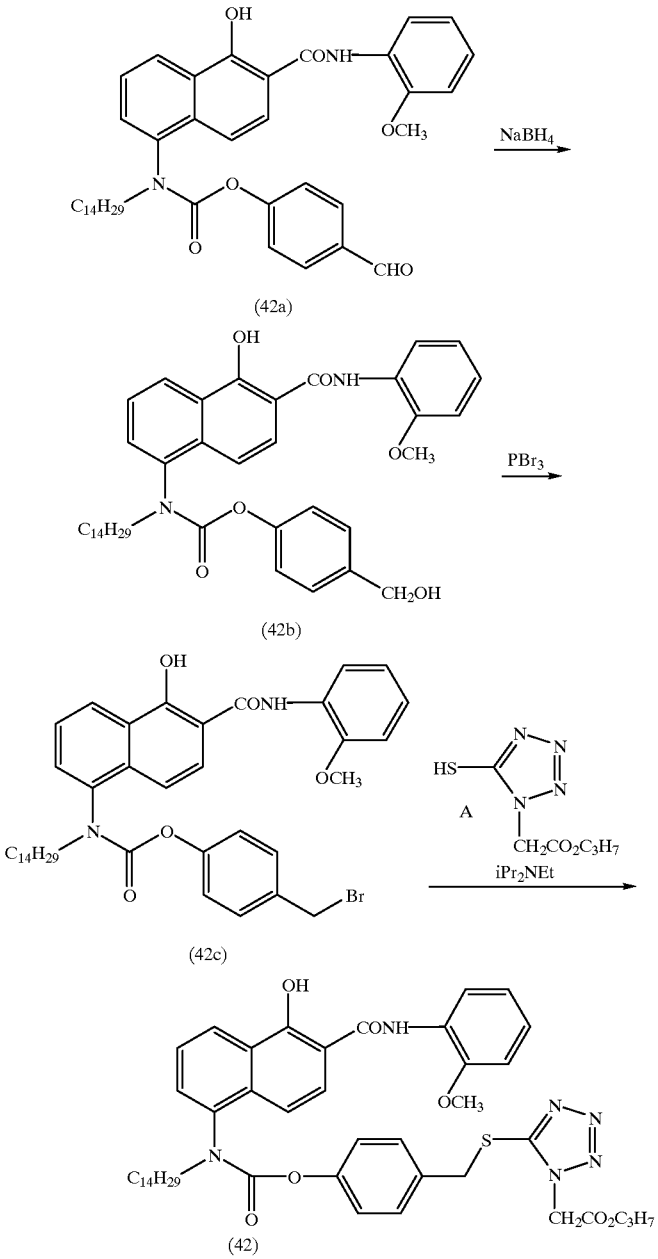

Synthesis of Compound 42a

A solution of 4.5 g of compound 41c, 5.0 g of p-hydroxybenzaldehyde and 4.8 g of N,N-diisopropyl-N-ethylamine dissolved in 100 mL of toluene was refluxed for 5 hr under agitation. The reaction mixture was cooled to 30° C. and poured into a mixture of 500 mL of ethyl acetate and 500 mL of aqueous sodium hydrogencarbonate. The organic phase was washed with water, dried over magnesium sulfate and concentrated at a reduced pressure. The concentrated residue was purified through column (development solvent: ethyl acetate/hexane=1/3), thereby obtaining 3.8 g of compound 42a.

Synthesis of Compound 42b 0.48 g of sodium borohydride was added at 25° C. to a solution of 3.8 g of compound 42a dissolved in 100 mL of methanol and 20 mL of tetrahydrofuran and agitated for 1 hr. The reaction mixture was poured into a mixture of 100 mL of ethyl acetate and 100 mL of 1N aqueous hydrochloric acid. The organic phase was washed with water, dried over magnesium sulfate and concentrated at a reduced pressure. The concentrated residue was purified through column (development solvent: ethyl acetate/hexane=1/2), thereby obtaining 3.7 g of compound 42b.

Synthesis of Compound 42c 0.7 g of phosphorus tribromide was added at 10° C. to a solution of 3.5 g of compound 42b dissolved in 20 mL of dichloromethane and agitated for 1 hr. The reaction mixture was poured into a mixture of 100 mL of ethyl acetate and 100 mL of 1N aqueous hydrochloric acid. The organic phase was washed with water, dried over magnesium sulfate and concentrated at a reduced pressure. The concentrated residue was purified through column (development solvent: ethyl acetate/hexane=1/4), thereby obtaining 2.8 g of compound 42c.

Synthesis of Compound 42

A solution of 2.5 g of compound 42c, 1.7 g of mercaptotetrazole derivative A and 1.0 g of N,N-diisopropyl-N-ethylamine dissolved in 10 mL of N,N-dimethylacetamide was agitated at 25° C. for 2 hr. The reaction mixture was poured into a mixture of 100 mL of ethyl acetate and 100 mL of aqueous sodium hydrogencarbonate. The organic phase was washed with water, dried over magnesium sulfate and concentrated at a reduced pressure. The concentrated residue was purified through column (development solvent: ethyl acetate/hexane=1/1), thereby obtaining 1.7 g of compound example (42). The identification of the obtained compound was performed by elementary analysis, NMR and mass spectrum.

Synthesis of Coupler of Compound Example (43):

Coupler of compound example (43) was synthesized according to the following scheme.

Synthesis of Exemplified Compound (43)

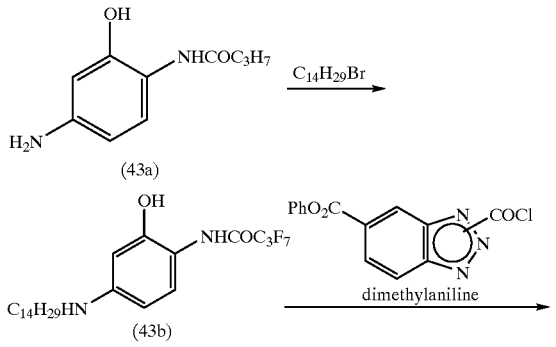

-continued

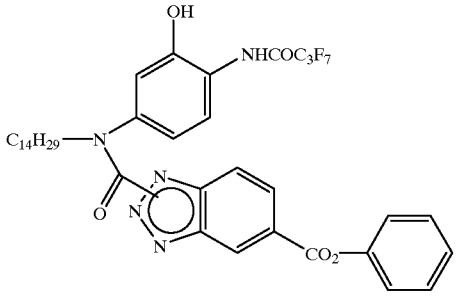

(43)

Synthesis of Compound 43b

A solution of 20 g of compound 43a and 26 g of bromotetradecane dissolved in 60 mL of 1-methylpyrrolidone was agitated at 120° C. for 5 hr, cooled to 25° C. and poured into a mixture of 400 mL of ethyl acetate and 600 mL of water. The organic phase was concentrated at a reduced pressure. The concentrated residue was purified through column (development solvent: ethyl acetate/hexane=1/3), thereby obtaining 9.0 g of compound 43b.

Synthesis of Compound 43

2.6 g of the above PBT-COCl was slowly added at 10° C. to a solution of 7.2 g of compound 43b and 4.4 g of N,N-dimethylaniline dissolved in 50 mL of tetrahydrofuran and agitated at 20° C. for 2 hr. The thus obtained reaction mixture was slowly added to a mixture of 200 mL of ethyl acetate and 200 mL of 1N aqueous hydrochloric acid. The organic phase was washed with water, dried over magnesium sulfate and concentrated at a reduced pressure. The concentrated residue was purified through column (development solvent: ethyl acetate/hexane=1/3), thereby obtaining 4.0 g of compound example (43). The identification of the obtained compound was performed by elementary analysis, NMR and mass spectrum.

Synthesis of Coupler of Compound Example (44):

Coupler of compound example (44) was synthesized according to the following scheme.

Synthesis of Exemplified Compound (44)

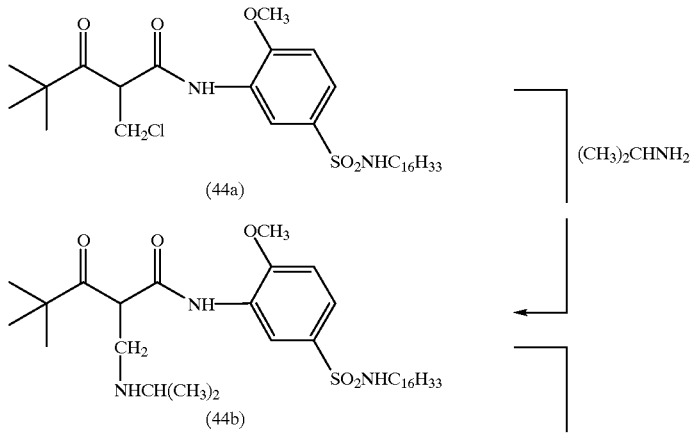

-continued

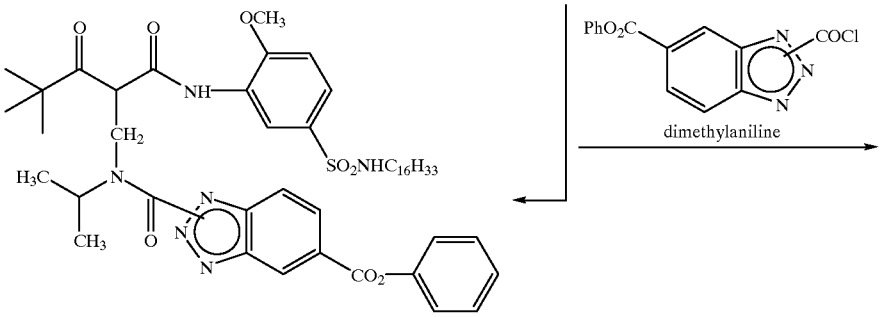

(44)

Synthesis of Compound 44b

A solution of 20 g of compound 44a and 20 g of isopropylamine dissolved in 200 mL of toluene was heated and agitated for 2 hr, and concentrated at a reduced pressure. The concentrated residue was purified through column (development solvent: ethyl acetate/hexane=1/2), thereby obtaining 7.6 g of compound 44b.

Synthesis of Compound 44

2.9 g of the above PBT-COCl was slowly added at 10° C. to a solution of 5.0 g of compound 44b and 1.5 g of N,N-dimethylaniline dissolved in 50 mL of tetrahydrofuran and agitated at 25° C. for 2 hr. The thus obtained reaction mixture was slowly added to a mixture of 200 mL of ethyl acetate and 200 mL of 1N aqueous hydrochloric acid. The organic phase was washed with water, dried over magnesium sulfate and concentrated at a reduced pressure. The concentrated residue was purified through column (development solvent: ethyl acetate/hexane=1/2), thereby obtaining 3.2 g of compound example (44). The identification of the obtained compound was performed by elementary analysis, NMR and mass spectrum.

Synthesis of Coupler of Compound Example (45):

Coupler of compound example (45) was synthesized according to the following scheme.

Synthesis of Exemplified Compound (45)

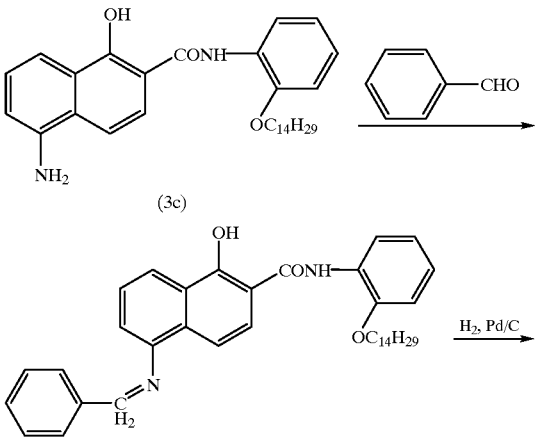

(3c)

(45a)

-continued

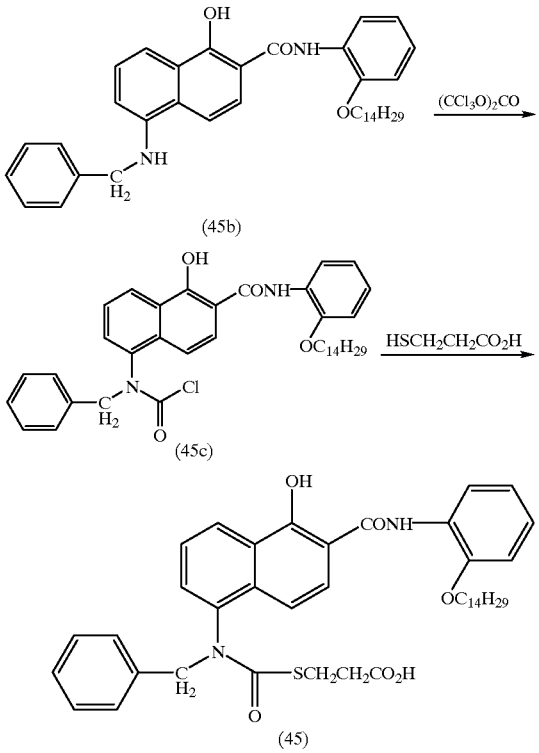

(45b)

(45c)

(45)

Synthesis of Compound 45a 10 g of compound 3c and 2.8 g of benzaldehyde were agitated under a stream of nitrogen at 120° C. for 1 hr and cooled to room temperature. The reaction residue was recrystallized from a mixture of ethyl acetate and hexane, thereby obtaining 10.1 g of compound 45a.

Synthesis of Compound 45b 1 g of 10% Pd/C and 150 mL of ethyl acetate were added to 10.1 g of compound 45a and agitated at room temperature in a 20 kg/cm$^2$ hydrogen atmosphere for 3 hr. The catalyst was separated by filtration, and the mixture was concentrated at a reduced pressure. The concentrated residue was recrystallized from a mixture of ethyl acetate and hexane, thereby obtaining 7.2 g of compound 45b.

Synthesis of Compound 45c

A solution of 7.2 g of compound 45b and 3.1 g of N,N-dimethylaniline dissolved in 20 mL of tetrahydrofuran was dropped at 10° C. into a solution of 1.9 g of bis (trichloromethyl) carbonate dissolved in 5 mL of tetrahydrofuran. The reaction mixture was agitated at 25° C. for 1 hr and poured into a mixture of 100 mL of ethyl acetate and 100 mL of 1N aqueous hydrochloric acid. The organic phase was washed with water, dried over magnesium sulfate and concentrated at a reduced pressure. The concentrated residue was purified through column (development solvent: ethyl acetate/hexane=1/4), thereby obtaining 5.5 g of compound 45c.

Synthesis of Compound 45

A solution of 3.0 g of compound 45c, 8.8 g of 1,8-diazabicyclo [5,4,0]-7-undecene and 2.0 g of 3-mercaptopropionic acid dissolved in 100 mL of toluene was stirred for 2 hr at 50° C. The reaction mixture was cooled to 30° C. and poured into a mixture of 500 mL of ethyl acetate and 500 mL of 1N aqueous hydrochloric acid. The organic phase was washed with water, dried over magnesium sulfate and concentrated at a reduced pressure. The concentrated residue was recrystallized from a mixture of ethyl acetate and hexane, thereby obtaining 1.6 g of compound example (45). The identification of the obtained compound was performed by elementary analysis, NMR and mass spectrum.

Synthesis of Coupler of Compound Example (46):

Coupler of compound example (46) was synthesized according to the following scheme.

Synthesis of Exemplified Compound (46)

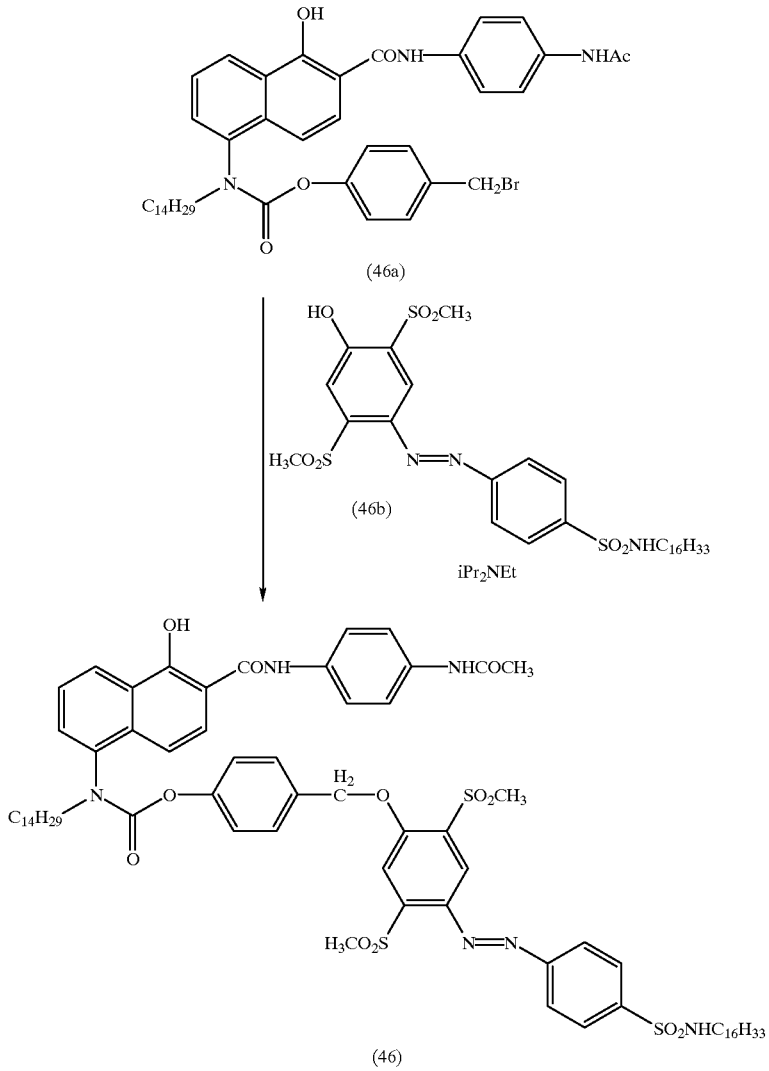

Synthesis of Compound 46

A solution of 3 g of compound 46a, which was synthesized in the same manner as that of the compound 42c, 1.9 g of azo dye 46b and 0.52 g of N,N-diisopropyl-N-ethylamine dissolved in 20 mL of N,N-dimethylacetamide was agitated for 5 hr. The reaction mixture was poured into a mixture of 200 mL of ethyl acetate and 200 mL of 1N aqueous hydrochloric acid. The organic phase was washed with water, dried over magnesium sulfate and concentrated at a reduced pressure. The concentrated residue was purified through column (development solvent: ethyl acetate/hexane=1/3), thereby obtaining 1.4 g of compound example (46). The identification of the obtained compound was performed by elementary analysis, NMR and mass spectrum.

Synthesis of Coupler of Compound Example (47):

Coupler of compound example (47) was synthesized according to the following scheme.

Synthesis of Exemplified Compound (47)

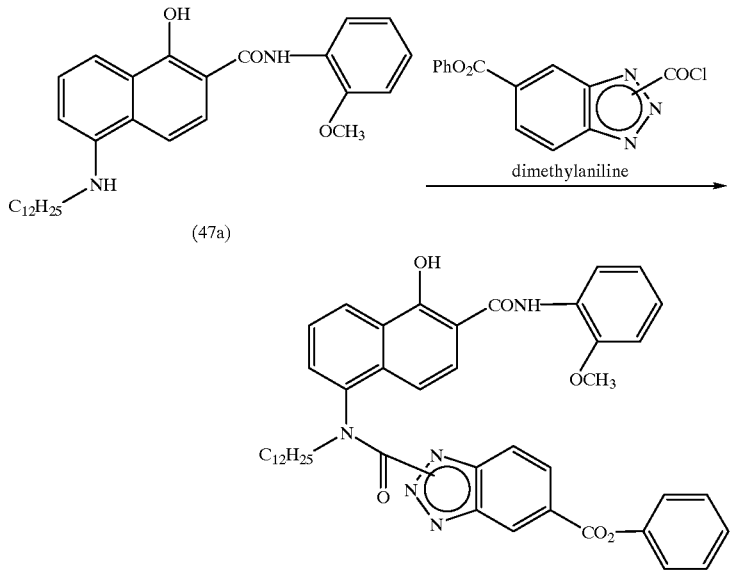

Synthesis of Compound (47)

6.6 g of the above PBT-COCl was slowly added at 10° C. to a solution of 10.0 g of compound 47a, which was synthesized in the same manner as that of the compound 41b, and 2.9 g of N,N-dimethylaniline dissolved in 100 mL of tetrahydrofuran and agitated at 20° C. for 2 hr. The thus obtained reaction mixture was slowly added to a mixture of 300 mL of ethyl acetate and 300 mL of 1N aqueous hydrochloric acid. The organic phase was washed with water, dried over magnesium sulfate and concentrated at a reduced pressure. The concentrated residue was purified through column (development solvent: ethyl acetate/hexane=1/4), thereby obtaining 7.9 g of compound example (47) (m.p.=99 to 103° C.). The identification of the obtained compound was performed by elementary analysis, NMR and mass spectrum.

In the present invention, the photographically useful group-releasing coupler can be incorporated in any of the layers of the lightsensitive material. Specifically, the photographically useful group-releasing coupler can be incorporated in any lightsensitive layer (a blue sensitive emulsion layer, a green sensitive emulsion layer, a red sensitive emulsion layer or a donor layer of interlayer effect having a spectral sensitivity distribution different from that of these principal lightsensitive layers) and any nonlightsensitive layer (for example, a protective layer, a yellow filter layer, an interlayer or an antihalation layer). When there are two or more layers which have the same color sensitivity but different speeds, the photographically useful group-releasing coupler can be added to any of the maximum sensitivity layer, minimum sensitivity layer and intermediate sensitivity layer, or can be added to all of the layers. Preferably, the photographically useful group-releasing coupler is incorporated in a lightsensitive layer and/or a nonlightsensitive layer adjacent to a lightsensitive layer.

In the present invention, the addition amount of photographically useful group-releasing coupler to the lightsensitive material is in the range of $5\times10^{-4}$ to 2 g/m$^2$, preferably $1\times10^{-3}$ to 1 g/m$^2$, and more preferably $5\times10^{-3}$ to $5\times10^{-1}$ g/m$^2$.

With respect to the application of the photographically useful group-releasing coupler to the lightsensitive material in the present invention, generally known dispersion methods can be employed in conformity with the type of the compound. For example, when it is soluble in alkali, it can be added in the form of an alkaline aqueous solution or a solution in an organic solvent miscible with water or can be added by the use of the oil-in-water dispersion method, in which use is made of a high-boiling-point organic solvent, or the solid dispersion method.

In the lightsensitive material of the present invention, photographically useful group-releasing couplers can be used either individually or in combination. Further, the same compound can be simultaneously used in two or more layers. Still further, the photographically useful group-releasing coupler can be used in combination with other generally known compounds capable of releasing a photographically useful group or its precursor, or can be used in combination with below described couplers or other additives. These are appropriately selected in conformity with the performance required to exhibit by the lightsensitive material.

In the lightsensitive material of the present invention, it is only required that at least one lightsensitive layer be formed on a support. A typical example thereof is a silver halide photographic lightsensitive material having, on its support, at least one lightsensitive layer constituted by a plurality of silver halide emulsion layers which have substantially the same color sensitivity but have different light sensitivities. This lightsensitive layer includes a unit lightsensitive layer which is sensitive to any of blue light, green light and red light. In a multilayered silver halide color photographic lightsensitive material, these unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit lightsensitive layer, a two-layered structure of high- and low-speed emulsion layers is preferably arranged so that the sensitivity is sequentially decreased toward a support as described in German Patent (hereinafter referred to as "DE") No. 1,121,470 or GB No. 923,045. Also, as described in JP-A-57-112751, JP-A-62-200350, JP-A-62-206541 and JP-A-62-206543, the disclosures of which are herein incorporated by reference, layers can be arranged so that a low-speed emulsion layer is formed on a side apart from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, layers can be arranged, from the farthest side from a support, in the order of blue-sensitive layer/GH/RH/GL/RL. Furthermore, as described in JP-A-56-25738 and JP-A-62-63936, layers can be arranged, from the farthest side from a support, in the order of blue-sensitive layer/GL/RL/GH/RH.

As described in JP-B-49-15495, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in U.S. Pat. No. 4,663,271, U.S. Pat. No. 4,705,744, U.S. Pat. No. 4,707,436, JP-A-62-160448 and JP-A-63-89850 is preferably arranged adjacent to or close to the main lightsensitive layers.

A preferable silver halide used in the present invention is silver iodobromide, silver iodochloride or silver iodochlorobromide containing about 30 mol % or less of silver iodide. A particularly preferable silver halide is silver iodobromide or silver iodochlorobromide containing about 2 mol % to about 10 mol % of silver iodide.

Silver halide grains contained in the photographic emulsion may those having regular crystals such as cubic, octahedral or tetradecahedral crystals, having irregular crystals such as spherical or tabular crystals or having crystal defects such as twinned crystal faces, or composite forms thereof.

With respect to the grain diameter, the silver halide can consist of fine grains having a grain size of about 0.2 $\mu$m or less or large grains having a projected area diameter of up to about 10 $\mu$m, and the emulsion may be either a polydispersed or monodispersed emulsion.

The silver halide photographic emulsion which can be used in the present invention can be prepared by methods described in, e.g., "I. Emulsion preparation and types," Research Disclosure (to be abbreviated as RD hereafter) No. 17643 (December, 1978), pp. 22 and 23; RD No. 18716 (November, 1979), page 648; RD No. 307105 (November, 1989), pp. 863 to 865; P. Glafkides, "Chemie et Phisique Photographiques", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, for example, U.S. Pat. No. 3,574,628, U.S. Pat. No. 3,655,394 and GB No. 1,413,748 are also preferable.

Also, tabular grains having an aspect ratio of about 3 or more can be used in the present invention. Tabular grains can be easily prepared by methods described in, e.g., Gutoff, "Photographic Science and Engineering", Vol. 14, pp. 248 to 257 (1970), U.S. Pat. No. 4,434,226, U.S. Pat. No. 4,414,310, U.S. Pat. No. 4,433,048, U.S. Pat. No. 4,439,520, and GB No. 2,112,157.

The crystal structure can be uniform, can have halogen compositions which are different between the inner part and the outer part thereof, or can be a layered structure. Alternatively, the silver halide can be bonded with a silver halide having a different composition by an epitaxial junction, for example, can be bonded with a compound other than silver halide such as silver rhodanide or lead oxide. A mixture of grains having various crystal forms can also be used.

The above emulsion can be any of a surface latent image type emulsion which mainly forms a latent image on the surface of a grain, an internal latent image type emulsion which forms a latent image in the interior of a grain and an emulsion of another type which has latent images on the surface and in the interior of a grain. However, the emulsion must be a negative type emulsion. The internal latent image type emulsion can be a core/shell internal latent image type emulsion described in JP-A-63-264740. The method of preparing this core/shell internal latent image type emulsion is described in JP-A-59-133542. Although the thickness of a shell of this emulsion depends on, e.g., development conditions, it is preferably 3 to 40 nm, more preferably 5 to 20 nm.

The silver halide emulsion is generally subjected to physical ripening, chemical ripening and spectral sensitization before use. Additives used in these steps are listed in RD No. 17643, RD No. 18716 and RD No. 307105, relevant portions of which are summarized in a below given table.

In the lightsensitive material of the present invention, two or more lightsensitive silver halide emulsions which are different from each other in at least one property among the grain size, grain size distribution, halogen composition, grain morphology and sensitivity thereof can be mixed together and used in a single layer.

Silver halide grains having their surface fogged as described in U.S. Pat. No. 4,082,553, silver halide grains having their internal part fogged as described in U.S. Pat. No. 4,626,498 and JP-A-59-214852 and colloidal silver are preferably used in the lightsensitive silver halide emulsion layer and/or substantially nonlightsensitive hydrophilic colloid layer. The silver halide grains having their internal part or surface fogged refers to the silver halide grains which can be developed uniformly (in nonimagewise manner), irrespective of the exposed or unexposed part of the lightsensitive material. The process for producing the same is described in U.S. Pat. No. 4,626,498 and JP-A-59-214852. Silver halides forming the internal nuclei of core/shell type silver halide grains having their internal part fogged may have different halogen compositions. The silver halide having its grain internal part or surface fogged can be any of silver chloride, silver chlorobromide, silver iodobromide and silver chloroiodobromide. The average grain size of these fogged silver halide grains is preferably 0.01 to 0.75 μm, more preferably 0.05 to 0.6 μm. With respect to grain morphology, use can be made of regular grains and polydispersed emulsion indiscriminately. However, monodispersion (at least 95% of the total weight or whole number of grains of the silver halide grains have a grain size which falls within ±40% of the average grain size) is preferred.

In the present invention, it is preferable to use a nonlightsensitive fine grain silver halide. The nonlightsensitive fine grain silver halide preferably consists of silver halide fine grains which are not sensitive during imagewise exposure for obtaining a dye image and are substantially not developed during a development step. These silver halide grains are preferably not fogged in advance. In the fine grain silver halide, the content of silver bromide is 0 to 100 mol %, and silver chloride and/or silver iodide can be contained if necessary. The fine grain silver halide preferably contains 0.5 to 10 mol % of silver iodide. The average grain size (the average value of equivalent circle diameters of projected areas) of the fine grain silver halide is preferably 0.01 to 0.5 μm, more preferably 0.02 to 0.2 μm.

The fine grain silver halide can be prepared in the same manner as that of common lightsensitive silver halide. The surface of silver halide grains need not be optically sensitized nor spectrally sensitized. However, before the addition of silver halide grains to a coating solution, it is preferable to add thereto a generally known stabilizer such as a triazole compound, an azaindene compound, a benzothiazolium compound, a mercapto compound, or a zinc compound. Colloidal silver can be incorporated in this fine grain silver halide containing layer.

The silver coating amount of the lightsensitive material of the present invention is preferably 6.0 g/m$^2$ or less, most preferably 4.5 g/m$^2$ or less.

Photographic additives usable in the present invention are also described in the RDs, the disclosures of which are herein incorporated by reference, and the relevant description portions are summarized in the following table.

| | Types of additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |

-continued

| | Types of additives | RD17643 | RD18716 | RD307105 |
|---|---|---|---|---|
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | pages 878–879 | |

Various dye-forming couplers can be used in the lightsensitive material of the present invention, and the following couplers are particularly preferable.

Yellow couplers: couplers represented by formulas (I) and (II) in EP No. 502,424A; couplers represented by formulas (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulas (II) to (IV) in column 7, lines 36 to 58, in U.S. Pat. No. B4,476,219 (particularly II-17, II-19 (column 17), and II-24 (column 19)), all the disclosures of which are herein incorporated by reference.

Magenta couplers: JP-A-3-39737 (L-57 (page 11, lower right column), L-68 (page 12, lower right column), and L-77 (page 13, lower right column); A-4-63 (page 134), and A-4-73 and A-4-75 (page 139) in EP No. 456,257; M-4 and M-6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, all the disclosures of which are herein incorporated by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, all the disclosures of which are herein incorporated by reference.

Polymer couplers: P-1 and P-5 (page 11) in JP-A-2-44345, all the disclosures of which are herein incorporated by reference.

Couplers for forming a colored dye with a proper diffusibility are preferably those described in U.S. Pat. No. 4,366,237, GB No. 2,125,570, EP No. 96,873B, and DE No. 3,234,533, all the disclosures of which are herein incorporated by reference.

Couplers for correcting the unnecessary absorption of a colored dye are preferably yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), the disclosures of which are herein incorporated by reference.

Examples of compounds (including a coupler) which react with a developing agent in an oxidized form to thereby release a photographically useful compound residue are as follows. Development inhibitor-releasing compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator-releasing compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand-releasing compounds: compounds represented by LIG-X described in claim 1 of U.S. Pat. No. 4,555,478 (particularly compounds in column 12, lines 21 to 41). Leuco dye-releasing compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator- or fogging agent-releasing compounds: compounds represented by formulas (1), (2), and (3) in column 3 of U.S. Pat. No. 4,656,123 (particularly (1-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36), all the disclosures of which are herein incorporated by reference.

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Developing agent oxidation product scavengers: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color amalgamation inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573; compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The present invention can be applied to various color lightsensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the lightsensitive material of the present invention, the total of film thicknesses of all hydrophilic colloid layers on the side having emulsion layers is preferably 28 $\mu$m or less, more preferably 23 $\mu$m or less, still more preferably 18 $\mu$m or less, and most preferably 16 $\mu$m or less. Film swell speed $T_{1/2}$ is preferably 30 sec or less, more preferably 20 sec or less. The film swell speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swell speed $T_{1/2}$ can be measured by using a swellometer described in A. Green et al., Photogr. Sci. Eng., Vol. 19, No. 2, pp. 124 to 129. The film swell speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

(maximum swollen film thickness−film thickness)/film thickness.

In the lightsensitive material of the present invention, hydrophilic colloid layers (called "back layers") having a total dried film thickness of 2 to 20 μm are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The lightsensitive material according to the present invention can be developed by conventional methods described in RD. No. 17643, pp. 28 and 29; RD. No. 18716, page 651, left to right columns; and RD No. 307105, pp. 880 and 881.

The color negative film processing solution for use in the present invention will be described below.

The color developing agents for use in the color developing solution are preferably used in an amount of 0.01 to 0.08 mol, more preferably 0.015 to 0.06 mol, and most preferably 0.02 to 0.05 mol per liter of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents such as alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonic salts, phosphoric salts, sulfosalicylic salts and boric salts are used for stabilizing the above pH value.

Although the amount of the replenisher of the color developing solution preferably ranges from 80 to 1300 mL per $m^2$ of the lightsensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

Wherein

C: bromide ion concentration of the color developing replenisher (mol/liter),

A: target bromide ion concentration of the color developing solution (mol/liter), W: amount of bromide ion leached from the lightsensitive material into the color developing solution when a color development of 1 $m^2$ of the lightsensitive material has been carried out (mol), and V: amount of color developing replenisher supplied per $m^2$ of the lightsensitive material (liter).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A-4-251845, JP-A-4-268552, EP No. 588,289, EP No. 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$CR=CT\times(V1+V2)/V1+CP$$

CR: concentration of each component in the replenisher,

CT: concentration of the component in the mother liquor (processing tank solution), CP: component concentration consumed during processing, V1: amount of replenisher having bleaching capability supplied per $m^2$ of lightsensitive material (mL), and V2: amount carried from previous bath by 1 $m^2$ of lightsensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL, of a bleaching replenisher per $m^2$ of the lightsensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL, per $m^2$ of the lightsensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP No. 504,609 and EP No. 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the lightsensitive material.

The replenishing amount of water washing and stabilizing solutions is preferably in the range of 80 to 1000 mL, more preferably 100 to 500 mL, and most preferably 150 to 300 mL, per $m^2$ of the lightsensitive material from the viewpoint that water washing and stabilizing functions are ensured and that the amount of waste solution is reduced to contribute to environment protection. In the processing with the above replenishing amount, known mildewproofing agents such as thiabenzazole, 1,2-benzoisothiazolin-3-one and 5-chloro-2-methylisothiazolin-3-one, antibiotics such as gentamicin and water deionized by the use of, for example, an ion exchange resin are preferably used for preventing the breeding of bacteria and mildew. The use of deionized water, a mildewproofing agent and an antibiotic in combination is more effective than individual uses.

With respect to the solution placed in the water washing or stabilizing solution tank, it is also preferred that the replenishing amount be reduced by conducting a reverse osmosis membrane treatment as described in JP-A-3-46652, JP-A-3-53246, JP-A-3-55542, JP-A-3-121448 and JP-A-3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably harvested from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent for use in the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A-4-19655 and JP-A-4-230748, granules containing a water soluble polymer in JP-A-4-221951, tablets in JP-A-51-61837 and JP-A-6-102628 and a paste processing agent in PCT National Publication 57-500485. Although any of these can be suitably used, from the viewpoint of easiness in use, it is preferred to employ a liquid prepared in the same concentration as in use in advance.

The container for storing the above processing agent is composed of, for example, any one or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 $\mu$m so that the oxygen permeability therethrough is 20 mL/m$^2$·24 hrs·atm or less.

The processing solution for color reversal film to be employed in the present invention will be described below. With respect to the processing for color reversal film, detailed descriptions are made in Public Technology No. 6 (Apr. 1, 1991) issued by Aztek, page 1, line 5 to page 10, line 5 and page 15, line 8 to page 24, line 2, any of which can be preferably applied thereto. In the color reversal film processing, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment, Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature. The magnetic recording layer preferably used in the lightsensitive material of the present invention will be described below.

The magnetic recording layer is obtained by coating a support with a water-base or organic solvent coating liquid having magnetic material grains dispersed in a binder.

The magnetic material grains for use in the present invention can be composed of any of ferromagnetic iron oxides such as $\gamma$ $Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific surface area is preferably at least 20 m$^2$/g, more preferably at least 30 m$^2$/g in terms of SBET. The saturation magnetization ($\sigma_s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A-4-259911 and JP-A-5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The weight ratio of magnetic material grains to binder is preferably in the range of 0.5:100 to 60:100, more preferably 1:100 to 30:100. The coating amount of magnetic material grains ranges from 0.005 to 3 g/m$^2$, preferably from 0.01 to 2 g/m$^2$, and more preferably from 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. No. 5,336,589, U.S. Pat. No. 5,250,404, U.S. Pat. No. 5,229,259, U.S. Pat. No. 5,215,874 and EP No. 466,130.

The polyester support for use in the present invention will be described below. Particulars thereof β the below mentioned lightsensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The subbing method will be described below. The substratum may be composed of either a single layer or at least two layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 μm) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 μm or a composite oxide thereof (Sb, P, B, In, S, Si, C, etc.) and fine grains of sol form metal oxides or composite oxides thereof. The content thereof in the lightsensitive material is preferably in the range of 5 to 500 mg/m$^2$, more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the lightsensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 μm. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A-1-312537 and JP-A-1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. No. 4,834,306 and U.S. Pat. No. 5,226,613. The photographic film for use in the present invention may be a generally so termed raw stock having not yet been developed or a developed photographic film. The raw stock and the developed photographic film may be accommodated in the same new patrone or in different patrones.

The color photographic lightsensitive material of the present invention is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Uturundesu Super Slim produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) rear touching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is preferably Fuji Film Minilabo Champion Super FA-298/FA-278/FA-258/FA-238 or Fuji Film Digital Labo System Frontier. Film processor of the Minilabo Champion is, for example, FP922AL/FP562B/FP562B, AL/FP362B/FP3622B, AL, and recommended processing chemical is Fuji Color Just It CN-16L or CN-16Q. Printer processor is, for example, PP3008AR/PP3008A/PP1828AR/PP1828A/PP1258AR/PP1258A/PP72 8AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

EXAMPLES

The present invention will be described in more detail below by way of its examples. However, the present invention is not limited to these examples as long as the invention does not depart from the gist of the invention.

Example 1

A support of cellulose triacetate film furnished with a substratum was coated with a plurality of layers of the following compositions, thereby preparing color lightsensitive material sample 101.

(Composition of lightsensitive layer)

Main materials for use in each layer are classified as follows:

ExC: cyan coupler UV: ultraviolet absorber

ExM: magenta coupler HBS: high b.p. organic solvent

ExY: yellow coupler H: gelatin hardener

ExS: sensitizing dye

The figure given beside the description of each component is for the coating amount expressed in the unit of $g/m^2$. With respect to a silver halide, the coating amount is in terms of silver, provided that, regarding the sensitizing dye, the coating amount is expressed in the unit of mol per mol of silver halide present in the same layer.

(Sample 101)

| | |
|---|---|
| 1st layer (green-sensitive emulsion layer) | |
| Silver iodobromide emulsion H silver | 0.10 |
| Silver iodobromide emulsion I silver | 0.25 |
| Silver iodobromide emulsion J silver | 0.10 |
| ExS-4 | $4.0 \times 10^{-5}$ |
| ExS-5 | $3.6 \times 10^{-5}$ |
| ExS-6 | $1.7 \times 10^{-4}$ |
| ExS-7 | $8.6 \times 10^{-4}$ |
| ExS-8 | $1.9 \times 10^{-4}$ |
| ExM-2 | 0.43 |
| HBS-1 | 0.30 |
| HBS-3 | $8.60 \times 10^{4}$ |
| 2nd layer (protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 2.00 |

In addition, W-1 to W-3, B-4 to B-6, F-1 to F-18, iron salt, lead salt, gold salt, platinum salt, palladium salt, iridium salt and rhodium salt were appropriately added to the individual layers in order to improve the storage stability, processability, resistance to pressure, antiseptic and mildew-proofing properties, antistatic properties and coating properties.

The AgI content, grain size, etc. of each of the emulsions indicated by abbreviations in this Example are listed in Table 1 below.

TABLE 1

| Emulsion | Average AgI content (%) | COV of inter-grain AgI content (%) | Average grain diameter (μm) (equivalent spherical diameter) | COV of grain diamter (%) | Equivalent circular diameter of projected area (μm) | Diameter/ thickness ratio |
|---|---|---|---|---|---|---|
| A | 5.0 | 18 | 0.54 | 19 | 0.81 | 5.1 |
| B | 3.7 | 16 | 0.43 | 19 | 0.58 | 3.2 |
| C | 5.4 | 15 | 0.51 | 19 | 1.1 | 7.0 |
| D | 4.7 | 16 | 0.66 | 22 | 1.36 | 5.5 |
| E | 4.0 | 15 | 1.00 | 20 | 1.58 | 6.0 |
| F | 6.3 | 18 | 0.60 | 19 | 0.82 | 5.5 |
| G | 7.5 | 22 | 0.85 | 24 | 1.30 | 5.0 |
| H | 3.7 | 16 | 0.43 | 19 | 0.58 | 3.2 |
| I | 5.4 | 15 | 0.55 | 20 | 0.86 | 6.2 |
| J | 5.4 | 15 | 0.66 | 23 | 1.10 | 7.0 |
| K | 8.8 | 18 | 0.84 | 26 | 1.03 | 3.7 |
| L | 1.7 | 10 | 0.46 | 15 | 0.5 | 4.2 |
| M | 8.8 | 24 | 0.64 | 23 | 0.85 | 5.2 |
| N | 7.2 | 20 | 0.50 | 16 | 0.80 | 4.7 |
| O | 6.3 | 18 | 1.05 | 20 | 1.46 | 3.7 |
| P | 0.9 | — | 0.07 | — | 0.07 | 1.0 |
| Q | 1.0 | — | 0.07 | — | 0.07 | 1.0 |

COV = coefficient of variation

In Table 1, (1) emulsions L to 0 are those subjected to a reduction sensitization using thiourea dioxide and thiosulfonic acid during grain preparation in accordance with Examples of JP-A-2-191938;

(2) emulsions A to 0 are those subjected to gold sensitization, sulfur sensitization and selenium sensitization in the presence of sensitizing dye and sodium thiocyanate described for each lightsensitive layer in accordance with Examples of JP-A-3-237450;

(3) in the preparation of tabular grains, low molecular weight gelatin was used in accordance with Examples of JP-A-1-158426; and (4) dislocation lines as described in JP-A-3-237450 were observed in tabular grains by means of a high voltage electron microscope.

The compounds employed for the formation of each layer in Examples of the present specification are as listed below.

ExC-1
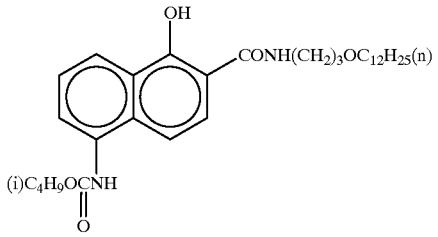
ExC-2
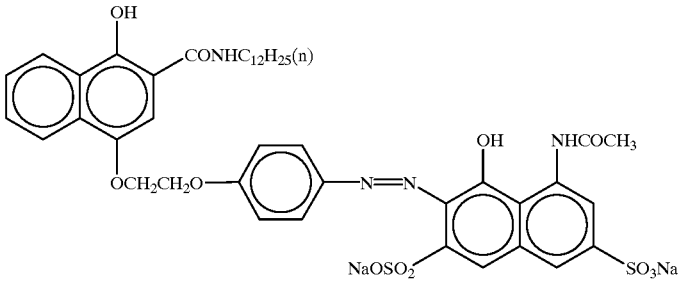
ExC-3
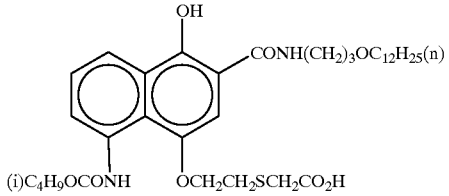
ExC-4
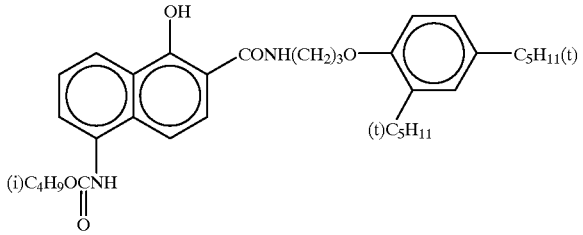
ExC-5
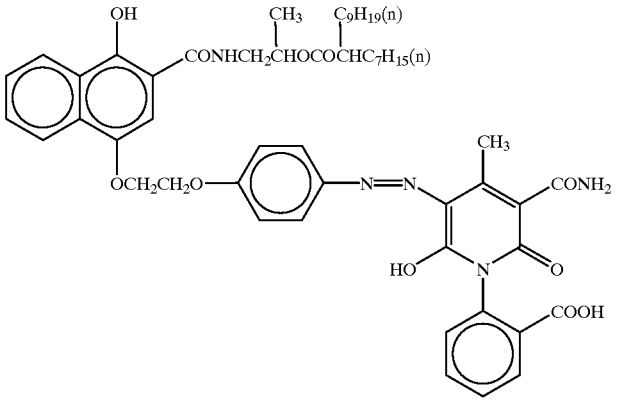

-continued
ExC-6
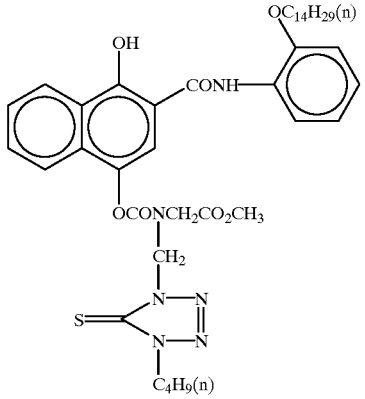
ExC-7
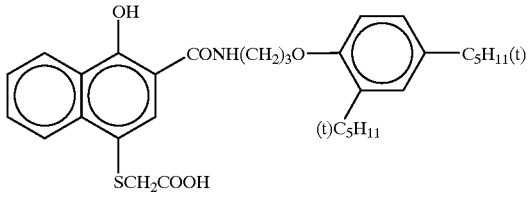
ExC-8
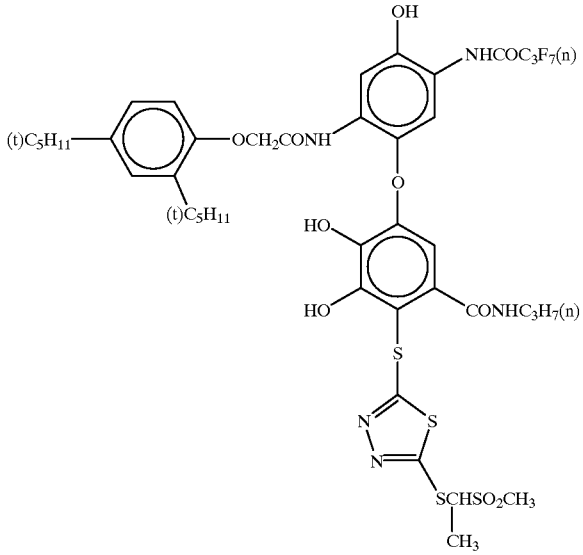
ExM-1
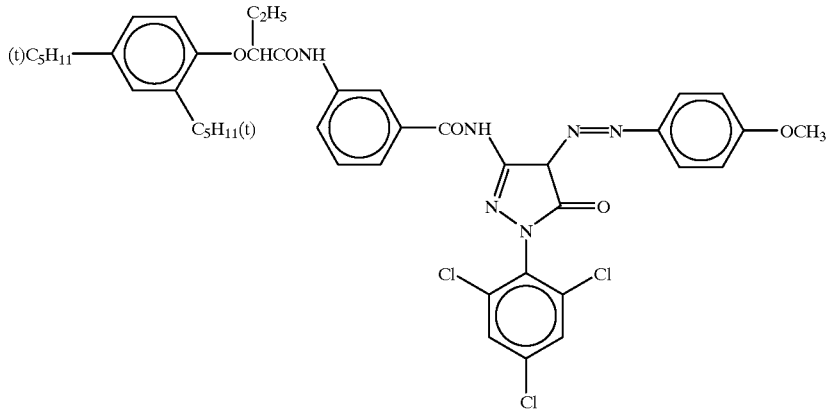

-continued
ExM-2
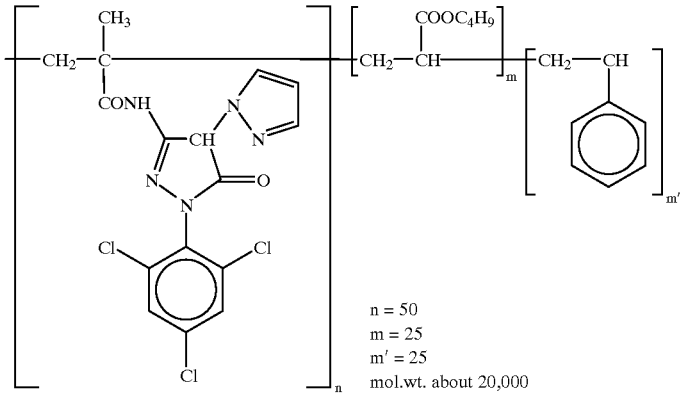
n = 50
m = 25
m′ = 25
mol.wt. about 20,000
ExM-3
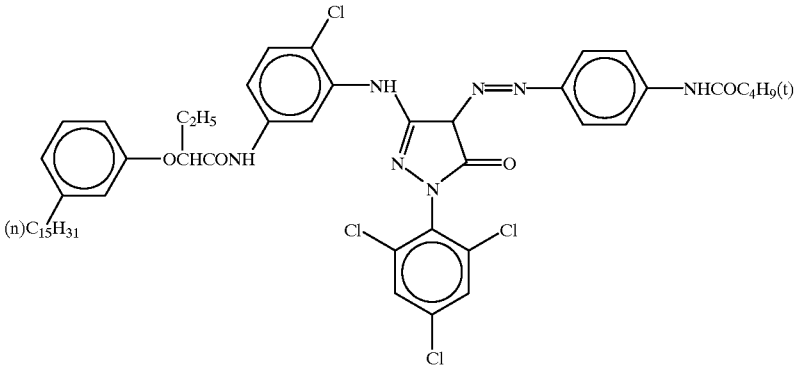
ExM-4
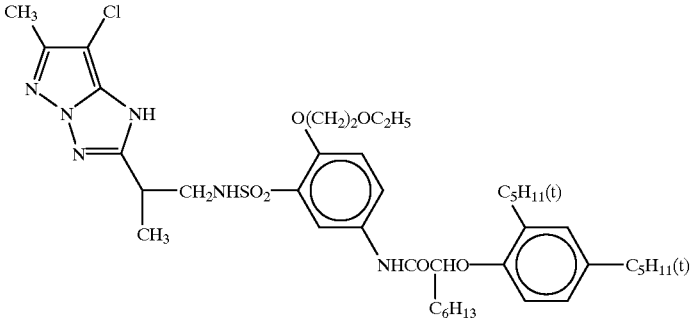
ExM-5
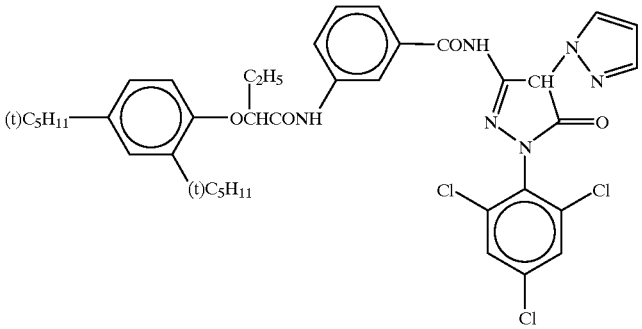

-continued
ExY-1
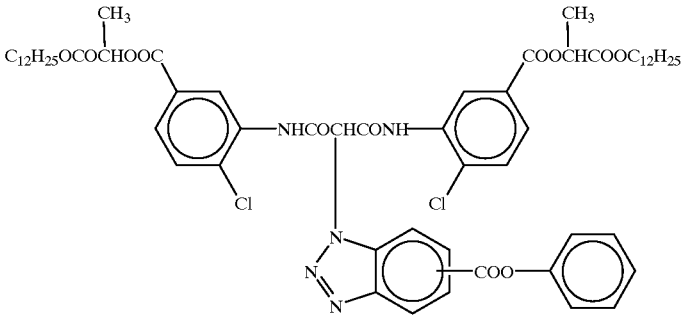
ExY-2
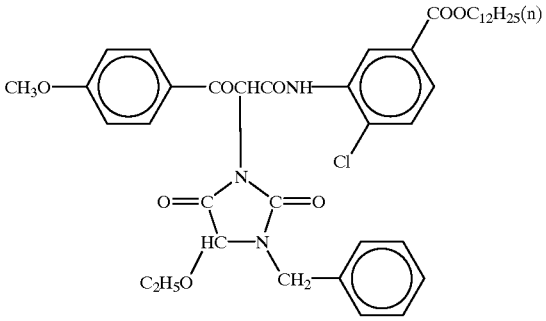
ExY-3
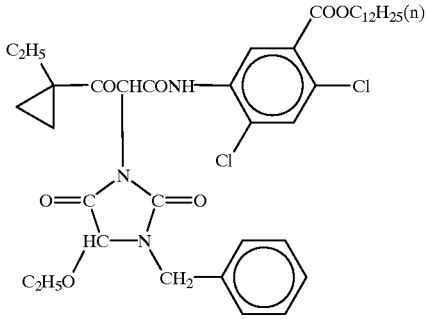
ExY-4
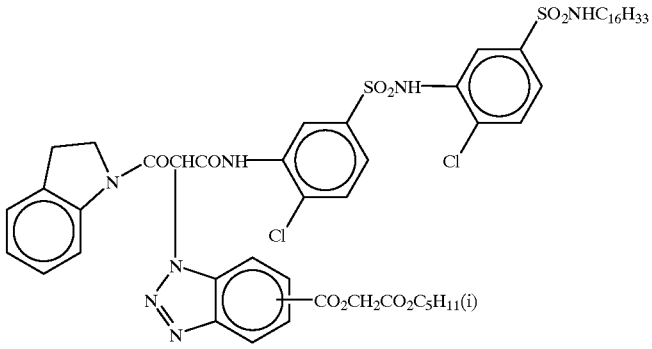

-continued
ExY-5
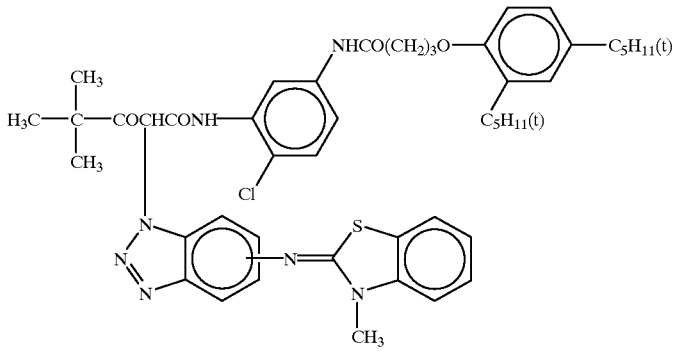
ExY-6
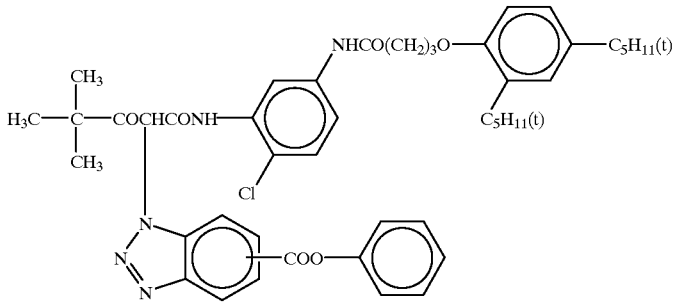
ExF-1
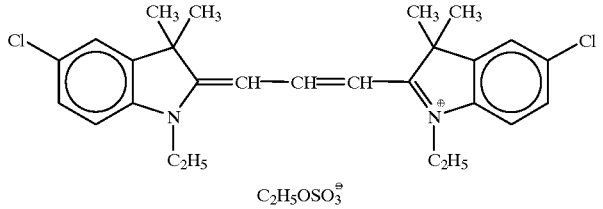
ExF-2
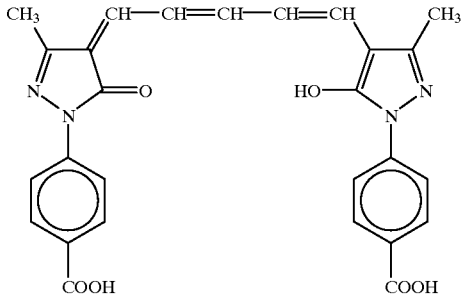
ExF-3
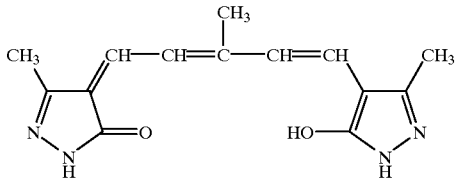

-continued
ExF-4
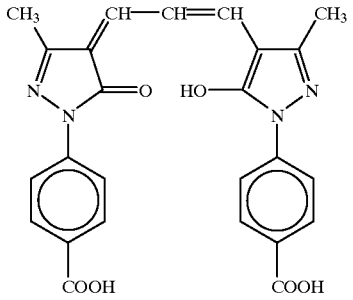
ExF-5
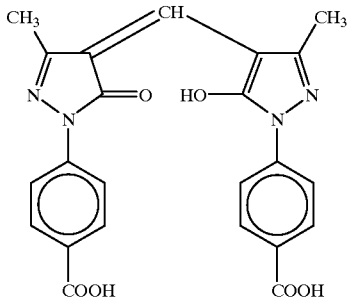
ExF-6
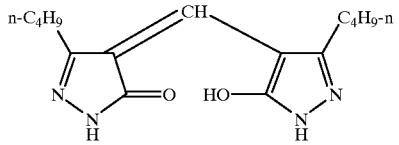
ExF-7
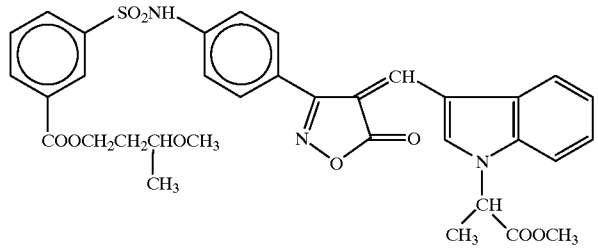
Cpd-1
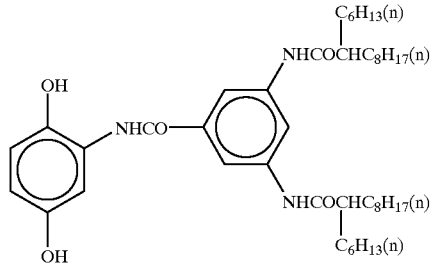
Cpd-2
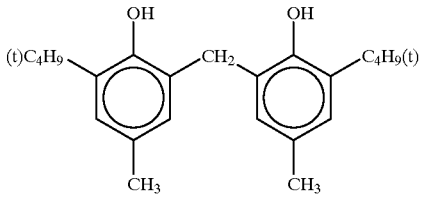

-continued
Cpd-3
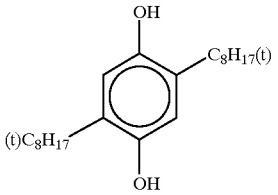
Cpd-4
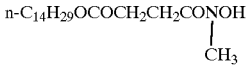
UV-1
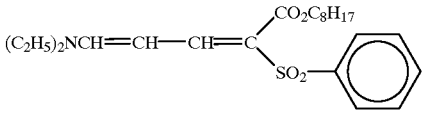
UV-2
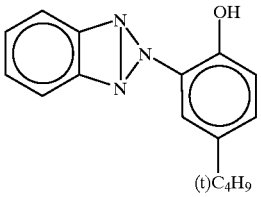
UV-3
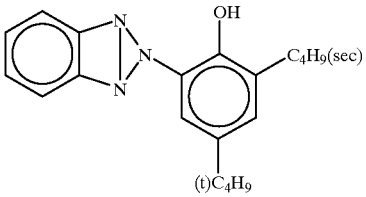
UV-4
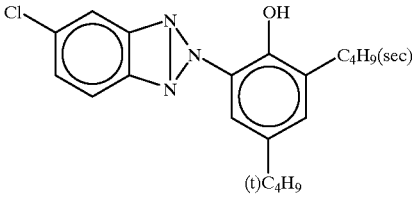
HBS-1
Tricresylphosphate
HBS-2
Di-n-buthylphthalate
HBS-3
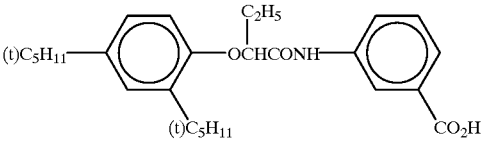
HBS-4
Tri(2-ethylhexyl)phosphate)

ExS-1
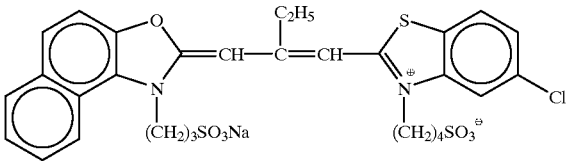
ExS-2
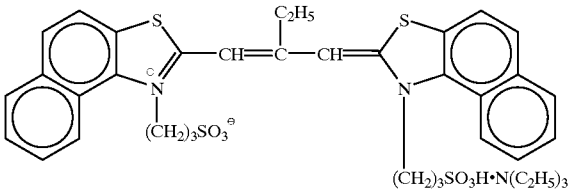
ExS-3
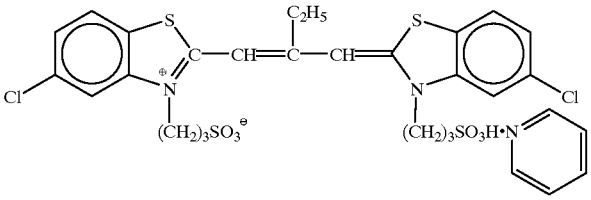
ExS-4
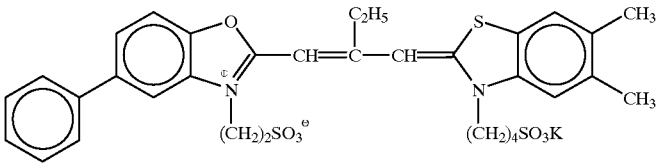
ExS-5
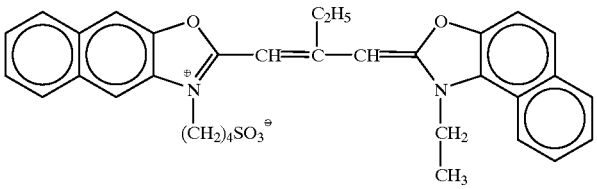
ExS-6
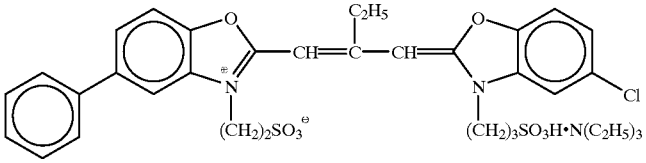
ExS-7
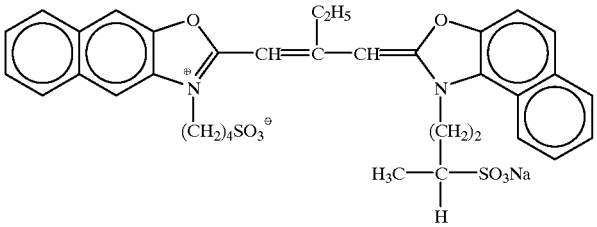

-continued
ExS-8
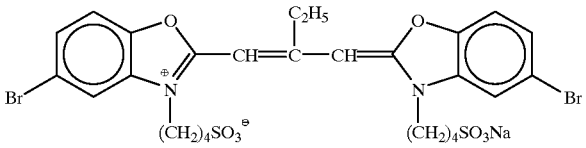
ExS-9
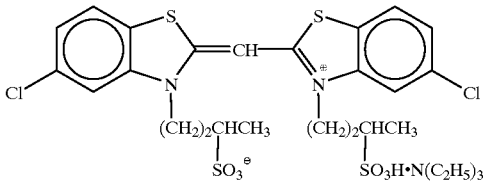
H-1
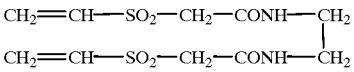
S-1
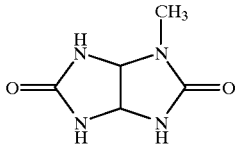
B-1
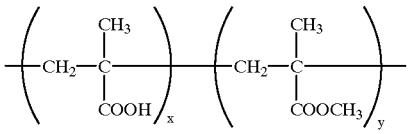
x/y = 10/90 (weight ratio)
Av. mol. wt.: about 35,000
B-2
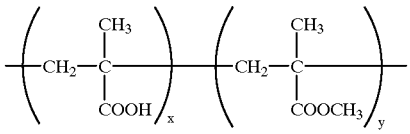
x/y = 40/60 (weight ratio)
Av. mol. wt.: about 20,000
B-3
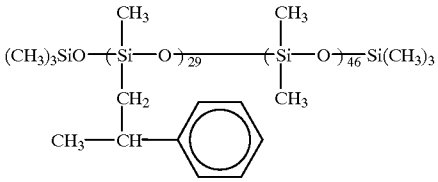
The numbers for each repeating unit indicats molar ratio
Av. mol. wt.: about 8,000
B-4
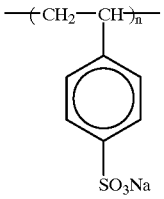
mol. wt.: about 750,000
B-5
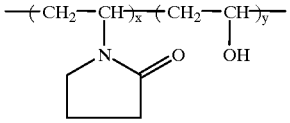
x/y = 70/30 (weight ratio)
Av. mol. wt.: about 17,000
B-6
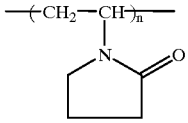
Av. mol. wt.: about 10,000
W-1
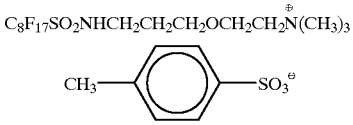
W-2
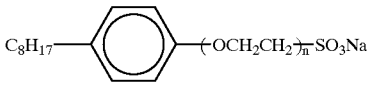
n = 2–4
W-3
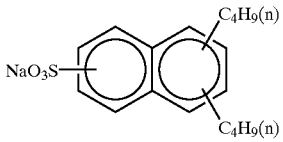
F-1
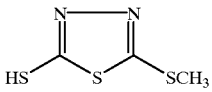

-continued
F-2
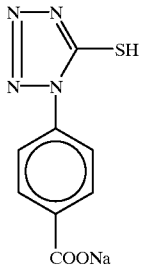
F-3
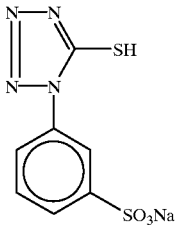
F-4
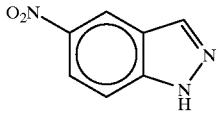
F-5
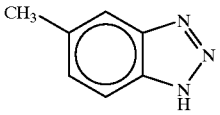
F-6
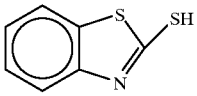
F-7
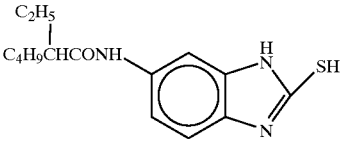
F-8
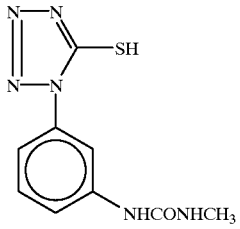
F-9
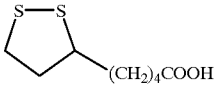
F-10
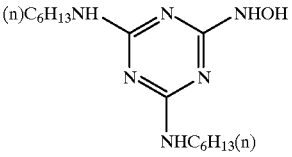
F-11
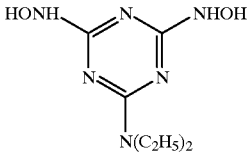
F-12
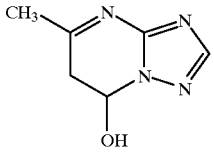
F-13
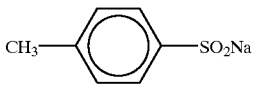
F-14
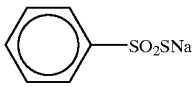
F-15
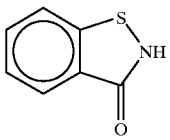
F-16
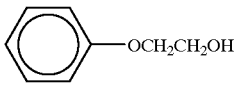
F-17
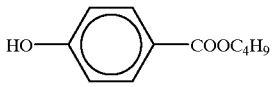
F-18
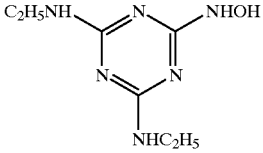

-continued

Comp-1

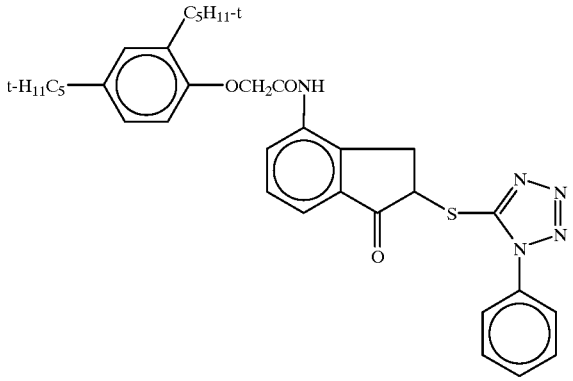

Comp-2

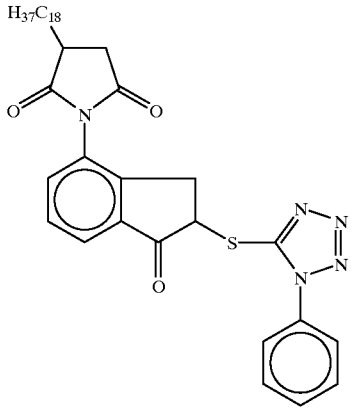

Compartive compound

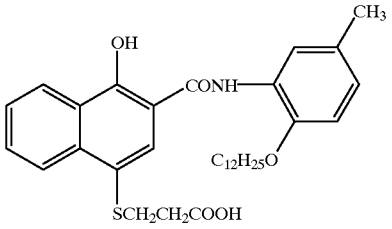

(Preparation of samples 102 to 115)

Samples 102 to 115 being identical with the above except that the photographically useful group-releasing coupler defined in the present invention listed in Table 2 was added to the first layer, were prepared.

The samples 101 to 115, after the coating, were hardened by aging them in a 25° C./68% humidity atmosphere for 8 days, subjected to wedge exposure using a standard white light source or a black body radiation light source having 4800° K. energy distribution, and developed.

After the processing, with respect to each of the samples, the cyan, magenta and yellow absorption densities were measured, thereby obtaining characteristic curves. The cyan color density differences of samples 102 to 115 from the cyan color density of sample 101, i.e., ΔDmax(C), and the yellow color density differences of samples 102 to 115 from the yellow color density of sample 101, i.e., ΔDmax(Y), and the gradient of magenta, $\gamma_M$, were determined from the obtained characteristic curves. The ΔDmax(C) and ΔDmax (Y) respectively correspond to the cyan and yellow colors (including colors attributed to dye release) of the couple releasing a photographically useful group defined in the present invention. The smaller the value of $\gamma_M$, the greater the development inhibiting effect of the photographically useful group-releasing coupler specified in the present invention. The greater the value of $\gamma_M$, the greater the development accelerating effect of the couple releasing a photographically useful group defined in the present invention.

Each of the samples was developed according to the following procedure.

(Processing steps)

| Step | Time | Temp. |
|---|---|---|
| Color development | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilization | 30 sec | 38° C. |
| Drying | 4 min 20 sec | 55° C. |

The composition of each processing solution was as follows.

| (Color developer) | (unit: g) |
|---|---|
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-((β)-hydroxyethyl)amino]-2-methylaniline sulfate | 4.5 |
| Water | q.s. ad 1.0 lit. |
| pH | 10.05. |

This pH was adjusted by the use of sulfuric acid and potassium hydroxide.

| (Bleach-fix soln.) | (unit: g) |
|---|---|
| Fe (III) sodium ethylenediaminetetraacetate trihydrate | 100.0 |
| Disodium ethylenediaminetetraacetate | 10.0 |
| 3-Mercapto-1,2,4-triazole | 0.03 |
| Ammonium bromide | 140.0 |
| Ammonium nitrate | 30.0 |
| Aq. ammonia (27%) | 6.5 mL |
| Water | q.s. ad 1.0 lit. |
| pH | 6.0 |

This pH was adjusted by the use of aqueous ammonia and nitric acid.

| (Fixing soln.) | (unit: g) |
|---|---|
| Disodium ethylenediaminetetraacetate | 0.5 |
| Sodium sulfite | 20.0 |
| Aq. soln. of ammonium thiosulfate (700 g/lit.) | 295.0 mL |
| Acetic acid (90%) | 3.3 |
| Water | q.s. ad 1.0 lit. |
| pH | 6.7 |

This pH was adjusted by the use of aqueous ammonia and acetic acid.

| (Stabilizer soln.) | (unit: g) |
|---|---|
| p-Nonylphenoxypolyglycidol (glycidol av. polymn. deg: 10) | 0.2 |
| Ethylenediaminetetraacetic acid | 0.05 |
| 1,2,4-Triazole | 1.3 |
| 1,4-Bis(1,2,4-triazol-1-ylmethyl)piperazine | 0.75 |
| Hydroxyacetic acid | 0.02 |
| Hydroxyethylcellulose (HEC SP-2000 produced by Daicel Chemical Industries, Ltd.) | 0.1 |
| 1,2-Benzisothiazolin-3-one | 0.05 |
| Water | q.s. ad 1.0 lit. |
| pH | 8.5. |

TABLE 2

| Sample NO. | Compound | Coated amount (mmol/m$^2$) | $\gamma_M$ | Δ Dmax(Y) | Δ Dmax(C) | Remarks |
|---|---|---|---|---|---|---|
| 101 | — | — | 1.75 | — | — | control |
| 102 | ExC-6 | 0.03 | 1.13 | 0.02 | 0.15 | Comp. |
| 103 | ExY-1 | 0.03 | 1.28 | 0.10 | 0.00 | Comp. |
| 104 | Comp-1 | 0.03 | 1.73 | 0.00 | 0.00 | Comp. |
| 105 | Comp-2 | 0.03 | 1.71 | 0.00 | 0.00 | Comp. |
| 106 | 1 | 0.03 | 1.45 | 0.00 | 0.00 | Inv. |
| 107 | 1 | 0.09 | 1.19 | 0.00 | 0.00 | Inv. |
| 108 | 3 | 0.03 | 1.30 | 0.00 | 0.00 | Inv. |
| 109 | 16 | 0.03 | 1.55 | 0.00 | 0.00 | Inv. |
| 110 | 31 | 0.03 | 1.22 | 0.00 | 0.00 | Inv. |
| 111 | 42 | 0.03 | 1.14 | 0.00 | 0.00 | Inv. |
| 112 | 47 | 0.03 | 1.32 | 0.00 | 0.00 | Inv. |
| 113 | 54 | 0.03 | 1.85 | 0.00 | 0.00 | Inv. |
| 114 | 62 | 0.03 | 1.87 | 0.00 | 0.00 | Inv. |
| 115 | 46 | 0.03 | 1.73 | 0.11 | 0.00 | Inv. |

It is apparent from the results of Table 2 that, when use is made of the development inhibitor-releasing coupler or development accelerator-releasing coupler specified in the present invention, the development inhibiting or development accelerating effect can be exerted without the coloring and dye formation of itself, and that the compound having a dye precursor introduced in place of the development inhibitor or development accelerator can also function as a dye release compound.

Example 2

A support of cellulose triacetate film furnished with a substratum was coated with a plurality of layers of the following compositions, thereby preparing multilayer color lightsensitive material sample 201.

(Sample 201)

1st layer (1st antihalation layer)

| | |
|---|---|
| Black colloidal silver | silver 0.10 |
| Silver iodobromide emulsion | silver 0.03 |
| Gelatin | 0.44 |
| EXC-1 | 0.004 |
| ExC-3 | 0.006 |
| Cpd-2 | 0.001 |
| HBS-1 | 0.008 |
| HBS-2 | 0.004 |

2nd layer (2nd antihalation layer)

| | |
|---|---|
| Black colloidal silver | silver 0.117 |
| Gelatin | 0.691 |
| ExM-1 | 0.050 |
| ExF-1 | $2.0 \times 10^{-3}$ |
| HBS-1 | 0.074 |
| Solid disperse dye ExF-2 | 0.015 |
| Solid disperse dye ExF-3 | 0.020 |
| 3rd layer (Interlayer) | |
| ExC-2 | 0.045 |
| Polyethyl acrylate latex | 0.20 |
| Gelatin | 0.515 |

4th layer (Low-speed red-sensitive emulsion layer)

| | |
|---|---|
| Silver iodobromide emulsion A | silver 0.20 |
| Silver iodobromide emulsion B | silver 0.40 |
| ExS-1 | $2.7 \times 10^{-4}$ |
| ExS-2 | $1.0 \times 10^{-5}$ |
| ExS-3 | $2.8 \times 10^{-4}$ |
| ExS-4 | $2.7 \times 10^{-4}$ |
| ExC-1 | 0.18 |
| ExC-3 | 0.036 |
| ExC-4 | 0.12 |
| ExC-5 | 0.018 |
| ExC-6 | 0.003 |
| Cpd-2 | 0.025 |
| HBS-1 | 0.17 |
| Gelatin | 1.26 |

5th layer (Medium-speed red-sensitive emulsion layer)

| | |
|---|---|
| Silver iodobromide emulsion C | silver 0.20 |
| Silver iodobromide emulsion D | silver 0.60 |
| ExS-1 | $2.2 \times 10^{-4}$ |
| ExS-2 | $8 \times 10^{-5}$ |
| ExS-3 | $2.3 \times 10^{-4}$ |
| ExS-4 | $2.2 \times 10^{-4}$ |
| ExC-1 | 0.18 |
| ExC-2 | 0.040 |

-continued

| | |
|---|---|
| ExC-3 | 0.042 |
| ExC-4 | 0.12 |
| ExC-5 | 0.015 |
| ExC-6 | 0.010 |
| Cpd-2 | 0.055 |
| Cpd-4 | 0.030 |
| HBS-1 | 0.15 |
| Gelatin | 1.04 |

6th layer (High-speed red-sensitive emulsion layer)

| | |
|---|---|
| Silver iodobromide emulsion E | silver 1.17 |
| ExS-1 | $4.0 \times 10^{-4}$ |
| ExS-2 | $1 \times 10^{-5}$ |
| ExS-3 | $2.1 \times 10^{-4}$ |
| ExC-1 | 0.08 |
| ExC-3 | 0.09 |
| ExC-6 | 0.037 |
| ExC-7 | 0.010 |
| Cpd-2 | 0.046 |
| Cpd-4 | 0.03 |
| HBS-1 | 0.22 |
| HBS-2 | 0.10 |
| Gelatin | 1.14 |

7th layer (Interlayer)

| | |
|---|---|
| Cpd-1 | 0.094 |
| Solid disperse dye ExF-4 | 0.030 |
| HBS-1 | 0.050 |
| Polyethyl acrylate latex | 0.15 |
| Gelatin | 0.89 |

8th layer (Layer capable of imparting interlayer effect to red-sensitive layer)

| | |
|---|---|
| Silver iodobromide emulsion F | silver 0.40 |
| Silver iodobromide emulsion G | silver 0.90 |
| ExS-4 | $3.1 \times 10^{-5}$ |
| ExS-5 | $2.0 \times 10^{-4}$ |
| ExS-6 | $8.2 \times 10^{-4}$ |
| Cpd-4 | 0.030 |
| ExM-2 | 0.23 |
| ExM-3 | 0.049 |
| ExY-1 | 0.054 |
| HBS-1 | 0.20 |
| HBS-3 | 0.007 |
| Gelatin | 1.29 |

9th layer (Low-speed green-sensitive emulsion layer)

| | |
|---|---|
| Silver iodobromide emulsion H | silver 0.16 |
| ExS-4 | $2.4 \times 10^{-5}$ |
| ExS-5 | $1.4 \times 10^{-4}$ |
| ExS-6 | $6.5 \times 10^{-4}$ |
| ExM-2 | 0.13 |
| ExM-3 | 0.047 |
| HBS-1 | 0.10 |
| HBS-3 | 0.04 |
| Gelatin | 0.38 |

10th layer (Medium-speed green-sensitive emulsion layer)

| | |
|---|---|
| Silver iodobromide emulsion H | silver 0.08 |
| Silver iodobromide emulsion I | silver 0.21 |
| Silver iodobromide emulsion J | silver 0.08 |
| ExS-4 | $3.3 \times 10^{-5}$ |
| ExS-5 | $3.0 \times 10^{-5}$ |
| ExS-6 | $1.4 \times 10^{-4}$ |
| ExS-7 | $7.2 \times 10^{-4}$ |
| ExS-8 | $1.6 \times 10^{-4}$ |
| ExC-6 | 0.015 |
| ExM-2 | 0.093 |
| ExM-3 | 0.037 |
| ExY-5 | 0.004 |
| HBS-1 | 0.08 |
| HBS-3 | $4.0 \times 10^{-3}$ |
| Gelatin | 0.41 |

11th layer (High-speed green-sensitive emulsion layer)

| | |
|---|---|
| Silver iodobromide emulsion K | silver 1.10 |
| ExS-4 | $4.3 \times 10^{-5}$ |
| ExS-7 | $1.0 \times 10^{-4}$ |
| ExS-8 | $4.7 \times 10^{-4}$ |
| ExC-6 | 0.005 |
| ExM-3 | 0.070 |
| ExM-4 | 0.028 |
| ExM-5 | 0.026 |
| Cpd-3 | 0.010 |
| Cpd-4 | 0.050 |
| HBS-1 | 0.23 |
| Polyethyl acrylate latex | 0.15 |
| Gelatin | 1.18 |

12th layer (Yellow filter layer)

| | |
|---|---|
| Yellow colloidal silver | silver 0.047 |
| Cpd-1 | 0.18 |
| Solid disperse dye ExF-5 | 0.060 |
| Solid disperse dye ExF-6 | 0.060 |
| Oil-soluble dye ExF-7 | 0.010 |
| HBS-1 | 0.094 |
| Gelatin | 1.204 |

13th layer (Low-speed blue-sensitive emulsion layer)

| | |
|---|---|
| Silver iodobromide emulsion L | silver 0.15 |
| Silver iodobromide emulsion M | silver 0.20 |
| Silver iodobromide emulsion N | silver 0.15 |
| ExS-9 | $8.0 \times 10^{-4}$ |
| ExC-1 | 0.067 |
| ExC-8 | 0.013 |
| ExY-1 | 0.047 |
| ExY-2 | 0.50 |
| ExY-3 | 0.20 |
| ExY-4 | 0.010 |
| Cpd-2 | 0.10 |
| Cpd-3 | $4.0 \times 10^{-3}$ |
| HBS-1 | 0.23 |
| Gelatin | 1.45 |

14th layer (High-speed blue-sensitive emulsion layer)

| | |
|---|---|
| Silver iodobromide emulsion O | silver 0.96 |
| ExS-9 | $3.6 \times 10^{-4}$ |

-continued

| | |
|---|---|
| ExC-1 | 0.013 |
| ExY-2 | 0.42 |
| ExY-3 | 0.05 |
| ExY-6 | 0.104 |
| Cpd-2 | 0.07 |
| Cpd-3 | $1.0 \times 10^{-3}$ |
| HBS-1 | 0.14 |
| Gelatin | 1.20 |

15th layer (1st protective layer)

| | |
|---|---|
| Silver iodobromide emulsion Q | silver 0.10 |
| UV-1 | 0.12 |
| UV-2 | 0.10 |
| UV-3 | 0.16 |
| UV-4 | 0.025 |
| HBS-1 | 0.10 |
| HBS-4 | $4.0 \times 10^{-2}$ |
| Gelatin | 2.0 |

16th layer (2nd protective layer)

| | |
|---|---|
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition, W-1 to W-3, B-4 to B-6, F-1 to F-18, iron salt, lead salt, gold salt, platinum salt, palladium salt, iridium salt, and rhodium salt were appropriately added to the individual layers in order to improve the storage stability, processability, resistance to pressure, antiseptic and mildew-proofing properties, antistatic properties, and coating properties. Preparation of dispersions of organic solid disperse dyes:

The above dye ExF-2 was dispersed by the following method. Specifically, 21.7 mL of water, 3 mL of a 5% aqueous solution of sodium p-octylphenoxyethoxyethoxyethanesulfonate and 0.5 g of a 5% aqueous solution of p-octylphenoxypolyoxyethylene ether (polymerization degree: 10) were placed in a 700-mL pot mill, and 5.0 g of the dye ExF-2 and 500 mL of zirconium oxide beads (diameter 1 mm) were added thereto. The contents were dispersed for 2 hr. This dispersion was conducted by the use of BO type oscillating ball mill manufactured by Chuo Koki K.K. Thereafter, the contents were taken out from the mill and added to 8 g of a 12.5% aqueous solution of gelatin. The beads were removed by filtration, thereby obtaining a gelatin dispersion of the dye. The average diameter of the dye fine grains was 0.44 μm.

Solid dispersions of ExF-3, ExF-4 and ExF-6 were obtained in the same manner. The average diameters of these dye fine grains were 0.24, 0.45, and 0.52 μm, respectively. ExF-5 was dispersed by the micro-precipitation dispersion method described in Example 1 of EP No. 549,489A. The average grain diameter thereof was 0.06 μm.

(Preparation of samples 202 to 208)

Samples 202 to 208 being identical with the above, except that ExC-6 of the 10th and 11th layers was replaced by an equimolar amount of other development inhibitor-releasing coupler as specified in Table 3, were prepared.

The samples 201 to 208, after the coating, were hardened by aging them in a 25° C./68% humidity atmosphere for 8 days. Thereafter, in the same manner as in Example 1, the samples were subjected to wedge exposure using a standard white light source or a black body radiation light source having 4800° K. energy distribution, and developed. In addition, in order to evaluate storability of the sensitive materials, the samples were stored under the temperature and humidity conditions of 50° C. and 80%, respectively for 3 days, and then they were subjected to light and developed in the similar manner.

After the processing, with respect to each of the samples, the cyan, magenta and yellow absorption densities were measured, thereby obtaining characteristic curves. The cyan, magenta and yellow gradations $\gamma_C$, $\gamma_M$ and $\gamma_Y$ were determined from the obtained characteristic curve. The $\gamma_M$ indicates the development inhibiting effect of the DIR compound, and the $\gamma_C$ and $\gamma_Y$ indicate the interlayer effects of the DIR compound. The smaller the value thereof, the greater the effect exerted thereby. Increment in the density at the portion giving a magenta minimum density of each sample after the storage under the temperature and humidity conditions of 50° C. and 80% for 3 days, with respect to each sample before the storage, is indicated as ΔDmin(M).

TABLE 3

| Sample No. | Compound | $\gamma_C$ | $\gamma_M$ | $\gamma_Y$ | ΔDmin(M) | Remarks |
|---|---|---|---|---|---|---|
| 201 | ExC-6 | 0.78 | 0.74 | 0.79 | 0.03 | Comp. |
| 202 | ExY-1 | 0.64 | 0.76 | 0.85 | 0.02 | Comp. |
| 203 | Comp-1 | 0.95 | 0.94 | 0.96 | 0.03 | Comp. |
| 204 | Comp-2 | 0.96 | 0.96 | 0.97 | 0.03 | Comp. |
| 205 | 3 | 0.66 | 0.78 | 0.81 | 0.02 | Inv. |
| 206 | 47 | 0.67 | 0.78 | 0.79 | 0.01 | Inv. |
| 207 | 31 | 0.64 | 0.75 | 0.78 | 0.02 | Inv. |
| 208 | 80 | 0.68 | 0.77 | 0.80 | 0.08 | Inv. |

It is apparent from the above Table 3 that, when use is made of the development inhibitor-releasing coupler specified in the present invention, the development inhibiting effect on the layer having this coupler added thereto (green-sensitive layer) per se and the satisfactory interlayer effect (IIE) on the layer adjacent thereto (blue-sensitive layer and red-sensitive layer) can simultaneously be realized by the use of the development inhibitor-releasing coupler specified in the present invention.

Example 3

Comparative sample 301 was prepared in exactly the same manner as that of the sample 201.

(Preparation of samples 302 to 307)

Sample 302 was prepared in exactly the same manner as that of the sample 301, except that the comparative compound was added to the 6th layer of the sample 301 in an amount of 0.2 mmol/m$^2$. Further, sample 303 was prepared in exactly the same manner as that of the sample 302, except that the comparative compound of the sample 302 was replaced by an equimolar amount of photographically useful group-releasing coupler (45) specified in the present invention. Still further, sample 304 was prepared in exactly the same manner as that of the sample 301, except that the Cpd-1 in the 7th layer of the sample 301 was removed and 0.2 mmol/m$^2$ of the comparative compound was substituted therefor. Still further, samples 305 and 306 were prepared by replacing the comparative compound of the sample 304 with equimolar amounts of photographically useful group-releasing couplers (45) and (64) specified in the present invention, respectively. Still further, sample 307 was prepared by replacing 0.1 mmol/m$^2$, out of 0.2 mmol/m$^2$, of the compound (45) of the sample 304 with Cpd-1. A list of the compounds added to the 6th and 7th layers is given in Table 4.

The samples 301 to 307, after the coating, were hardened by aging them in a 25° C./68% humidity atmosphere for 8 days. Thereafter, the samples were subjected to the same exposure and development as in Example 2. The amount of silver remaining in the developed samples was determined by fluorescent X-ray to thereby evaluate the bleach ability of each of the samples. Also, in the same manner as in Example 2, the cyan, magenta and yellow absorption densities were measured with respect to each of the samples, and the cyan, magenta and yellow gradations $\gamma_C$, $\gamma_M$ and $\gamma_Y$ were determined from the obtained characteristic curves, respectively. The results are given in Table 4.

TABLE 4

| Sample No. | Bleach accelerator-releasing agent in 6th layer | Bleach accelerator-releasing agent in 7th layer | Bleach ability ($\mu g/m^2$) | $\gamma_C$ | $\gamma_M$ | $\gamma_Y$ | Remarks |
|---|---|---|---|---|---|---|---|
| 301 | — | — | 7.1 | 0.78 | 0.74 | 0.79 | Comp. |
| 302 | Comparative compound | — | 2.7 | 0.86 | 0.75 | 0.81 | Comp. |
| 303 | 45 | — | 1.9 | 0.78 | 0.73 | 0.8 | Inv. |
| 304 | — | Comparative compound | 2.1 | 0.84 | 0.74 | 0.79 | Comp. |
| 305 | — | 45 | 0.9 | 0.78 | 0.74 | 0.8 | Inv. |
| 306 | — | 64 | 1.1 | 0.78 | 0.74 | 0.79 | Inv. |
| 307 | — | 45 | 1.9 | 0.78 | 0.74 | 0.79 | Inv. |

A half of the bleach accelerator-releasing agent (comparative compound) used in Sample 304 is replaced by the bleach accelerator-releasing agent No. 45 to prepare Sample 304. That is, the amount of bleach accelerator-releasing agent No. 45 in Sample 307 is 0.1 mmol/$m^2$.

Although it is known that, in practical use, the performance in terms of color reproducibility and/or gradation balance is extremely degraded when the amount of residual silver exceeds 3 $\mu g/m^2$, the photographically useful group-releasing coupler specified in the present invention exerts a satisfactory bleach ability-enhancing effect without changing the gradation balance even if the addition amount thereof is small.

Example 4

Sample A was prepared in the same manner as that of the sample 101 of Example 1 of JP-A-8-254801, except that compound (77) of the general formula (I) of the present invention was used in place of the color mixing inhibitor Cpd-A employed in the 8th and 13th layers of the above sample 101 in an amount of ½ mol per Cpd-A. The sample A was evaluated by the method described in the above Example 1 of JP-A-8-254801. It was found that excellent color mixing inhibiting capability and storage stability were exhibited.

Example 5

Sample B was prepared in the same manner as that of the sample 126 of Example 1 of JP-A-7-219172, except that compound (77) of the general formula (I) of the present invention was used in place of the color mixing inhibitor (I-14) employed in the 2nd and 4th layers of the above sample 126 in an amount of ½ mol per color mixing inhibitor (I-14), and except that compound (75) of the general formula (I) of the present invention was added to the 1st layer in an amount of 0.20 g/$m^2$. The sample B was evaluated by the method described in the above Example 1 of JP-A-8-254801. It was found that excellent color mixing inhibiting capability and white ground improving effect were exhibited.

The present invention enables providing the silver halide photographic lightsensitive material containing the coupler which exhibits high coupling activity with the developing agent in an oxidized form and which, after the coupling reaction with the developing agent in an oxidized form, can rapidly release the photographically useful group or its precursor without any dye formation, the coupler being excellent in storage life.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic material containing a coupler capable of releasing a photographically useful group or its precursor by a coupling reaction between the coupler and a developing agent in an oxidized form, wherein the coupler releases the photographically useful group or its precursor by an intramolecular nucleophilic substitution reaction using the nitrogen atom that directly bonds to a coupling position of a product obtained by the coupling reaction and that originates from the developing agent.

2. The material according to claim 1, wherein the coupler is represented by formula (I):

$$\text{COUP—A—E—B} \qquad \text{(I)}$$

wherein

COUP represents a coupler residue capable of coupling with the developing agent in an oxidized form;

E represents an electrophilic portion;

A represents a single bond or a divalent linking group capable of releasing B along with forming a 4- to 8-membered ring by the intramolecular nucleophilic substitution reaction using the nitrogen atom that directly bonds to the coupling position of the product obtained by the coupling reaction and that originates from the developing agent, wherein A may bond to the coupling position of COUP or A may bond to the position other than the coupling position of COUP; and B represents the photographically useful group or its precursor.

3. The material according to claim 2, wherein the divalent linking group represented by A bonds to the coupling position of COUP.

4. The material according to claim 2, wherein the linking group represented by A bonds to an atom other than the coupling position of COUP.

5. The material according to claim 2, wherein the linking group represented by A represents a group selected from the group consisting of:

$X—(CO)_{n1}—(Y')_{n2}—\{C(R_{41})(R_{42})\}_{n4}—XX$, $X—(CO)_{n1}—\{N(R_{43})\}_{n3}—\{C(R_{41})(R_{42})\}_{n4}—XX$, $X—(Y')_{n2}—(CO)_{n1}—\{C(R_{41})(R_{42})\}_{n4}—XX$, $X—\{N(R_{43})\}_{n3}—(CO)_{n1}—\{C(R_{41})(R_{42})\}_{n4}—XX$, $X—(CO)_{n1}—\{C(R_{41})(R_{42})\}_{n4}—(Y')_{n2}—XX$, $X—(CO)_{n1}—\{C(R_{41})(R_{42})\}_{n4}—\{N(R_{43})\}_{n3}—XX$, $X—(Y')_{n2}—XX$, and $X—\{N(R_{43})\}_{n3}—XX$ wherein X represents a position that bonds to COUP;

XX represents a position that bonds to E;

Y' represents an oxygen atom or a sulfur atom;

$R_{41}$, $R_{42}$, and $R_{43}$ each represent a hydrogen atom, an aliphatic group, an aryl group, or a heterocyclic group, wherein two of $R_{41}$, $R_{42}$, and $R_{43}$ may bond together to form a ring, or COUP and any one of $R_{41}$, $R_{42}$, and $R_{43}$ may bond together to form a ring;

n1 and n3 each represent an integer from 0 to 2;

n2 represents 0 or 1;

n4 represents an integer from 1 to 5;

provided that when each of n3 and n4 represents an integer of 2 or more, each of the groups $N(R_{43})$'s and each of the groups $C(R_{41})(R_{42})$'s may be the same or different from each other, and each of the values n1+n2+n4, n1+n3+n4, n2, and n3 is so selected that the 4- to 8-membered ring can be formed by the intramolecular nucleophilic substitution reaction of the electrophilic portion represented by E, with the nitrogen atom of the coupling product obtained by the reaction between COUP and the developing agent in an oxidized form, wherein the nitrogen atom directly bonds to the coupling position and originates from the developing agent;

when $—N(R_{43})—$ directly bonds to E, $R_{43}$ is not a hydrogen atom; and when the linking group represented by A bonds to the coupling position of COUP, A does not bond to COUP directly via Y'.

6. The material according to claim 2, wherein E in formula (I) represents —CO—, —CS—, —COCO—, —SO—, $—SO_2—$, $—P(=O)(R_{51})—$, $—P(=S)(R_{51})$, or $—C(R_{52})(R_{53})—$, wherein $R_{51}$ represents an aliphatic group, an aryl group, an aliphatic oxy group, an aryl oxy group, an aliphatic thio group, or an aryl thio group; and $R_{52}$ and $R_{53}$ each represent a hydrogen atom, an aliphatic group, an aryl group, or a heterocyclic group.

7. The material according to claim 2, wherein B in formula (I) is represented by formula (III):

$$-(T)_k-PUG \quad (III)$$

wherein T represents a timing group capable of releasing PUG after T is released from E in formula (I); k represents an integer from 0 to 2; and PUG represents the photographically useful group.

8. The material according to claim 2, wherein the linking group represented by A bonds to the coupling position of COUP in formula (I); and A represents a group selected from the group consisting of:

$X—CO—C(R_{41})(R_{42})—C(R_{41})(R_{42})—XX$, $X—C(R_{41})(R_{42})—C(R_{41})(R_{42})—XX$, $X—C(R_{41})(R_{42})—C(R_{41})(R_{42})—C(R_{41})(R_{42})—XX$, $X—C(R_{41})(R_{42})—N(R_{43})—XX$ $X—C(R_{41})(R_{42})—C(R_{41})(R_{42})—O—XX$, $X—C(R_{41})(R_{42})—C(R_{41})(R_{42})—S—XX$, and $X—C(R_{41})(R_{42})—C(R_{41})(R_{42})—N(R_{43})—XX$ wherein X represents the position that bonds to COUP;

XX represents the position that bonds to E;

$R_{41}$, $R_{42}$, and $R_{43}$ each represent a hydrogen atom, an aliphatic group, an aryl group, or a heterocyclic group, and two of $R_{41}$, $R_{42}$, and $R_{43}$ may bond together to form a ring, or COUP and any one of $R_{41}$, $R_{42}$, and $R_{43}$ may bond together to form a ring; and when the linking group represented by A has two ore more $—C(R_{41})(R_{42})—$'s, each of $R_{41}$'s and each of $R_{42}$'s may be the same or different from each other.

9. The material according to claim 2, wherein the linking group represented by A bonds to the atom next to the coupling position of COUP in formula (I); and A represents a group selected from the group consisting of:

$X—C(R_{41})(R_{42})—XX$, $X—C(R_{41})(R_{42})—C(R_{41})(R_{42})—XX$,

X—O—XX,

X—S—XX, $X—N(R_{43})—XX$, $X—C(R_{41})(R_{42})—O—XX$, $X—C(R_{41})(R_{42})—S—XX$, and $X—C(R_{41})(R_{42})—N(R_{43})—XX$ wherein X represents the position that bonds to COUP;

XX represents the position that bonds to E; $R_{41}$, $R_{42}$, and $R_{43}$ each represent a hydrogen atom, an aliphatic group, an aryl group, or a heterocyclic group;

two of $R_{41}$, $R_{42}$, and $R_{43}$ may bond together to form a ring, or COUP and any one of $R_{41}$, $R_{42}$, and $R_{43}$ may bond together to form a ring; and when the linking group represented by A has two or more $—C(R_{41})(R_{42})—$'s, each of $R_{41}$'s and each of $R_{42}$'s may be the same or different from each other.

10. The material according to claim 2, wherein the bonding group represented by A bonds to the atom next but one to the coupling position of COUP in formula (I); and A represents a group selected from the group consisting of:

$X—C(R_{41})(R_{42})—XX$,

X—O—XX,

X—S—XX, and $X—N(R_{43})—XX$, wherein

X represents the position that bonds to COUP in formula (I);

XX represents the position that bonds to E in formula (I);

$R_{41}$, $R_{42}$, and $R_{43}$ each represent a hydrogen atom, an aliphatic group, an aryl group, or a heterocyclic group; and two of $R_{41}$, $R_{42}$, and $R_{43}$ may bond together to form a ring, or COUP and one of $R_{41}$, $R_{42}$, and $R_{43}$ may bond together to form a ring.

11. The material according to claim 1, wherein the photographically useful group is a development inhibitor.

12. The material according to claim 1, wherein the photographically useful group is a bleach accelerator.

13. The material according to claim 1, wherein the photographically useful group is a development accelerator.

14. The material according to claim 1, wherein the photographically useful group is a dye.

15. The material according to claim 1, wherein the photographically useful group is a brightening agent.

16. The material according to claim 1, wherein the photographically useful group is a reducing agent.

17. The material according to claim 1, wherein the photographically useful group is a coupler.

18. The material according to claim 1, wherein the coupler represented by formula (I) is represented by formula (I-3a):

(I-3a)

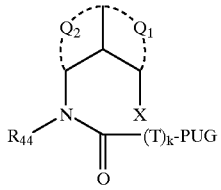

wherein $Q_1$ and $Q_2$ each represent a group of nonmetallic atoms required to form a 5-membered or 6-membered ring and to induce the coupling reaction, with a developing agent in an oxidized form, at the atom of the joint part of X; X represents a hydrogen atom, a halogen atom, $R_{31}$—, $R_{31}O$—, $R_{31}S$—, $R_{31}OCOO$—, $R_{32}COO$—, $R_{32}(R_{33})NCOO$—, or $R_{32}CON(R_{33})$—, wherein $R_{31}$ represents an aliphatic group, an aryl group or a heterocyclic group, $R_{32}$ and $R_{33}$ each represent a hydrogen atom, an aliphatic group, an aryl group, or a heterocyclic group; T represents a timing group capable of releasing PUG after T is released from —C(=O)— in formula (I-3a); k represents an integer from 0 to 2; PUG represents the photographically useful group; $R_{44}$ represents a hydrogen atom, an aliphatic group, an aryl group, or a heterocyclic group.

19. The material according to claim 1, wherein the coupler represented by formula (I) is represented by formula (I-3b):

(I-3b)

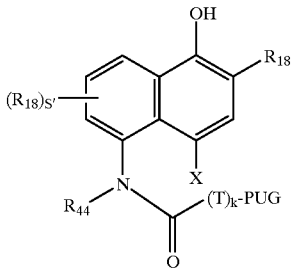

wherein $R_{18}$ represents $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$—, $R_{32}(R_{33})NCO$—, $R_{32}(R_{33})NSO_2$—, $R_{31}OCO$—, a cyano group or a halogen atom, wherein $R_{31}$ represents an aliphatic group, an aryl group or a heterocyclic group, $R_{32}$ and $R_{33}$ each represent a hydrogen atom, an aliphatic group, an aryl group or a heterocyclic group; s' represents an integer of 0 to 4; $R_{44}$ represents a hydrogen atom, an aliphatic group, an aryl group, or a heterocyclic group; X represents a hydrogen atom, a halogen atom, $R_{31}$—, $R_{31}O$—, $R_{31}S$—, $R_{31}OCOO$—, $R_{32}COO$—, $R_{32}(R_{33})NCOO$—, or $R_{32}CON(R_{33})$—, wherein $R_{31}$ represents an aliphatic group, an aryl group or a heterocyclic group, $R_{32}$ and $R_{33}$ each represent a hydrogen atom, an aliphatic group, an aryl group, or a heterocyclic group; T represents a timing group capable of releasing PUG after T is released from —C(=O)— in formula (I-3b); k represents an integer from 0 to 2; and PUG represents the photographically useful group.

20. The material according to claim 1, wherein the coupler represented by formula (I) is represented by formula (I-3c):

(I-3c)

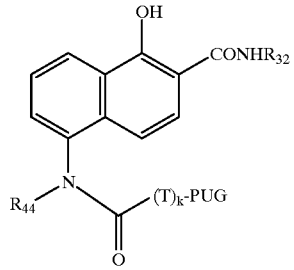

wherein $R_{32}$ represents a hydrogen atom, an aliphatic group, an aryl group or a heterocyclic group; $R_{44}$ represents a hydrogen atom, an aliphatic group, an aryl group, or a heterocyclic group; T represents a timing group capable of releasing PUG after T is released from —C(=O)— in formula (I-3c); k represents an integer from 0 to 2; and PUG represents the photographically useful group.

21. The material according to claim 20, wherein $R_{44}$ represents an aliphatic group, an aryl group, or a heterocyclic group.

* * * * *

UNITED STATES PATENT AND TRADEMARK OFFICE

CERTIFICATE OF CORRRECTION

PATENT NO. : 6,107,016
DATED : August 22, 2000
INVENTOR(S) : Takayuki Ito, et al.

It is certified that error appears in the above-identified patent and that said Letters Patent is hereby corrected as shown below:

On the title page, item [56] insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 6 | 0 | 5 | 4 | 2 | 5 | 7 | 4-25-00 | Boff et al | 430 | 544 | |

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*